US005555567A

United States Patent [19]

Corpus

[11] Patent Number: 5,555,567

[45] **Date of Patent: * Sep. 17, 1996**

[54] ADJUSTABLE SIDE ATTACHMENT STRAP FOR HELMET AND FACE SHIELD

[76] Inventor: Thomas A. Corpus, 2682 Mulberry La., Arlington Sq., Greenville, N.C. 27858

[ * ] Notice: The portion of the term of this patent subsequent to Mar. 15, 2011, has been disclaimed.

[21] Appl. No.: 34,691

[22] Filed: Mar. 19, 1993

Related U.S. Application Data

[63] Continuation-in-part of Ser. No. 786,093, Oct. 31, 1991, Pat. No. 5,293,649.

[51] Int. Cl.[6] ..... A41D 13/00; A42B 3/00

[52] U.S. Cl. ..... 2/424; 2/9

[58] Field of Search ..... 2/424, 9, 425, 2/10; 24/458, 563; 248/74.1, 74.2, 74.3, 74.4; 403/385, 398, 399, 400

[56] References Cited

U.S. PATENT DOCUMENTS

| | | | |
|---|---|---|---|
| 3,139,624 | 7/1964 | Humphrey | 2/9 |
| 3,263,236 | 8/1966 | Humphrey | 2/9 |
| 4,086,664 | 5/1978 | Humphrey et al. | 2/9 |
| 4,233,687 | 11/1980 | Lancellotti | 2/9 |
| 4,370,759 | 2/1983 | Zide | 2/424 |
| 4,594,737 | 6/1986 | Butash | 2/424 |
| 4,633,531 | 1/1987 | Nimmons | 2/424 |
| 4,837,866 | 6/1989 | Rector et al. | 2/424 |
| 4,933,993 | 6/1990 | McClelland | 2/424 |
| 4,985,938 | 1/1991 | Snow | 2/424 |
| 5,095,552 | 3/1992 | Parkinson | 2/424 |
| 5,123,619 | 6/1992 | Tomlinson et al. | 248/74.1 |

FOREIGN PATENT DOCUMENTS

| | | | |
|---|---|---|---|
| 0423146 | 1/1935 | United Kingdom | 403/285 |

*Primary Examiner*—Peter Nerbun

[57] ABSTRACT

An improved adjustable "L" side attachment strap means for attaching a face guard to a helmet comprises two straps: a main attachment strap and an adjustable retention strap, where the two straps are approximately orthogonal. The main attachment strap encircles the rear-most vertical bar of the guard, restricting the guard from moving in the fore and aft directions, while the adjustable retention strap encircles the lowest horizontal bar, of the rear section of the guard, restricting the guard from moving in the vertical direction. The adjustable retention strap fits into a notch in the main attachment strap, where both straps can be secured to the helmet by a single screw and T-Nut so that there is approximately a 90 degree angle between the straps, allowing for greater variability in fit.

8 Claims, 56 Drawing Sheets

PRIOR ART

PRIOR ART

ADJUSTABLE SIDE ATTACHMENT STRAP FOR HELMET AND FACE SHIELD

BACKGROUND OF THE INVENTION

This is a continuation in part of Ser. No. 07/786,093, filed Oct. 31, 1991 now U.S. Pat. No. 5,293,649. The present invention pertains to securing a faceguard to a football helmet so that the faceguard is restricted, to a significant degree, from moving in both the vertical and fore and aft directions.

A football helmet can be a plastic shell that protects one's head while playing football. This shell, however, leaves the face unprotected. Thus, a grid-like series of plastic coated metal bars is attached to the top and sides of the helmet to protect the face. However, the faceguard can also be constructed of just plastic segments. Football is a collision sport and this-system of the helmet, faceguard and attachments must withstand all blows encountered by the player's head and distribute and redirect these forces away from the player's face and head.

Three prior art patents which disclose mounting systems for mounting a faceguard to a helmet are U.S. Pat. Nos. 4,086,664, 4,633,531 and 4,837,866 herein incorporated by reference. In all three of these, faceguard mounting systems are disclosed wherein the side attachment straps provide no means of restricting the faceguard from moving through the loop of the prior art side attachment straps upon contact. The direction of this movement is perpendicular to the direction that the prior art side attachment straps point in. U.S. Pat. No. 4,837,866 consists of two straps, one inside the other, both straps preventing movement in the same direction, the fore and aft direction. Neither strap restricts movement in the inclined vertical direction. Of course, this invention includes such obvious modifications as producing the straps as a "pair of looped straps" as seen in U.S. Pat. No. 4,837,866. U.S. Pat. No. 4,086,664 has its side attachment straps mounted in compression while U.S. Pat. No. 4,633,531 and 4,837,866 have their side attachment straps mounted in tension; however, it turns out that this problem of vertical movement through the loops is not restricted to one attachment method, tension or compression, but rather a problem in that none of the methods restrict movement in all directions.

In prior art faceguard mounting assemblies, the faceguard is considered to be hinged, about a horizontal axis, by the front attachments. This allows, if the side attachment straps were not in place, for the guard to be swung in an arc pattern on the helmet in the fore and aft directions. Thus, if the side attachment straps were not in place and the faceguard was pushed back from its designated position on the helmet, it would swing angularly upwards toward the rear of the helmet in an arc pattern. The faceguard can be attached to the helmet by two front attachment straps and by a single attachment strap on each side of the helmet.

Background information is also needed on where the prior art side attachment straps are placed and in what direction they restrict the faceguard from moving in. The faceguard has a rear portion that extends over the ear flaps of the helmet shell. On the faceguards that the leading manufacturer produces, there is a rear portion comprising a lower and an upper bar, that bend angularly upward towards the rear of the helmet. These bars project from the main frame of the faceguard. The lower of these two horizontal bars has a bar stemming from it, at approximately a 90 degree angle, forming an "L" shape, that is upwardly inclined toward the top of the faceguard. This upwardly inclined bar connects to the upper horizontal bar, of the rear portion of the guard, and then connects to the top bar of the faceguard; thus completing the rear portion of the faceguard. These two horizontal bars and the upwardly inclined bar, that connects the two, form the rear portion of the faceguard that gets secured to the helmet. The 90 degree angle, although it could conceivably vary between approximately 40 and 140 degrees, referred to above, is a constant on all of the faceguards that the leading manufacturer produces. The improved side attachment strap utilizes the consistency of this angle, enabling it to be used on all of these faceguards. Another company manufactures faceguards that also have an "L" shaped rear portion of the faceguard. However, the upper bar, of the rear portion, is different than the leading manufacturer's. This variation in upper bars does not affect the adjustable "L" side attachment strap because the adjustable "L" side attachment strap utilizes the consistent 90 degree angle of the "L" shaped rear portion of the faceguards.

The designed placement of the prior art side attachment straps is as close as possible to the lowest of the two horizontal bars that comprise the rear portion of the guard. The horizontal bars are slightly angularly inclined upwardly toward the rear of the helmet, and the prior art side attachment straps should follow this inclined path toward the rear of the helmet. The prior art side attachment straps were designed to sit as close as possible to the lower of these two horizontal bars of the rear section of the guard, this is because the top front attachment straps act as a hinge for the faceguard. Thus, it is better when the prior art side attachment straps are lower because there is a longer moment arm to absorb the impact. One prior art side attachment strap is designed to secure each rear portion of the guard to the helmet. The prior art side attachment straps consist of a loop that encircles the vertically inclined bar of the rear portion of the guard. Therefore, each prior art side attachment strap restricts the guard from moving only along the arc pattern that is set up as a result of the guard being hinged at the top of the helmet by the front attachment straps.

However, the prior art side attachment straps have no means of restricting the upwardly inclined bar, of the rear portion of the guard, from being moved down, upon contact, through the loop of the prior art side attachment straps. The bar moving down through the loop of the prior art side attachment straps, can be looked at on some helmet systems as a tilting phenomenon. Since the guard is attached by the front attachment straps at the top of the helmet, both sides of the faceguard cannot move down; however, one side of the guard can slide down through the loop upon contact approximately one inch. Thus, the guard appears to be tilted on the helmet. This movement is both a safety problem and an enormous inconvenience to the player and equipment manager. A major safety problem is that unexpected stresses can be set up in the helmet, faceguard or prior art side attachment straps that could cause any or all of them to fail. When one rear portion of the guard moves down approximately one inch, the chin strap buckle gets covered over, which does not allow the chin strap buckle to be disengaged from the chin strap snap until the equipment manager loosens the prior art side attachment straps and readjusts the faceguard on the helmet. This is very inconvenient to the player and the equipment manager; because, when one's chin strap moves from the original place that it was adjusted to, which often occurs, the player cannot readjust the chin strap himself. A safety hazard occurs if the chin strap had to be removed from the player in an emergency, the process would be delayed because of this movement. Also, the prior art side attachment straps allow the guard to shake and rattle around during the course of play, which is very distracting to a player during game situations.

SUMMARY OF INVENTION

The present invention overcomes the disadvantages of the prior art side attachment straps described above by providing an improved mounting system that more securely attaches the faceguard to the helmet.

The rear-most portion of the faceguard is the section of the guard that gets attached to the helmet. The basic outline of this rear portion of the faceguard is in the form of an "L." The prior art side attachment straps only encircle the vertical bar of this "L."

The present invention adjustable "L" side attachment strap is comprised of two straps: a main attachment strap and an adjustable retention strap, one strap for each section of the "L" shaped rear portion of the guard. There is an angle between the two straps, where each strap comprises a loop portion. The main attachment strap encircles the vertical bar of this "L" while the adjustable retention strap encircles the horizontal bar of this "L." Each strap will restrict movement perpendicular to the direction that the loop aperture, of that strap, points in; hence restricting the guard from movement, to a significant degree, in any direction. Each loop of the present invention adjustable "L" side attachment strap is mounted so that when the faceguard encounters a downwardly angled frontal blow, the loops of the adjustable "L" side attachment strap are put in tension. To enable the side attachment straps to absorb most of the shock, they should be made of a resilient material and fashioned in such a manner that they offer the stiffness and flexibility to achieve this task. Materials that meet these needs are polyurethane, fiber reinforced polyurethane or a polycarbonate/polyurethane resin; however, these are only three of many materials that are available to be used.

The improved adjustable "L" side attachment strap will solve the problems that the prior art side attachment straps encountered. The improved adjustable "L" side attachment strap not only solves the prior art problems but has the additional advantage of universally fitting on at least all of the leading manufacturer's faceguards.

Another advantage of the improved adjustable "L" side attachment strap is that no new mounting holes will need to be drilled in the helmet. The present invention can be secured in the same location as the prior art side attachment straps.

As previously stated, the improved adjustable "L" side attachment strap comprises two straps: a main attachment strap and an adjustable retention strap, where there is an angle between the straps. When mounted on the helmet, these two straps become a unitary attachment means. The adjustable retention strap fits into a notched out area n the main attachment strap. The notch in the main attachment strap includes the location of the screw and T-Nut apertures. The apertures of the adjustable retention strap are aligned with the apertures of the main attachment strap; then one screw and one T-Nut assembly can be used to secure both straps to the helmet to act as a unitary means. The main attachment strap is notched to accommodate the adjustable retention strap; thus, the main attachment strap can be closed flush while the adjustable retention strap is in the notch. This invention can be used for other sports such as hockey, baseball and lacrosse.

BRIEF DESCRIPTION OF THE DRAWINGS

The above-mentioned invention along with other features an objects of the invention and manner of attaining them will become apparent and better understood in view of the following figures:

FIG. 4 shows where the faceguard, held in place by the prior art side attachment straps, frequently gets moved to.

DETAILED DESCRIPTION OF THE DRAWINGS

Figure 5:
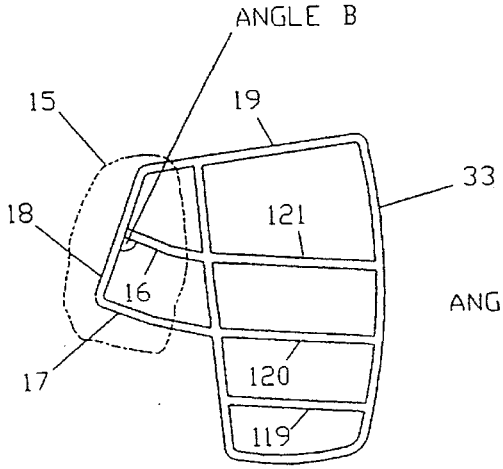
FIG. 5 shows a side view of a full cage single wire faceguard, with the rear portion of the guard highlighted.
Figure 6:
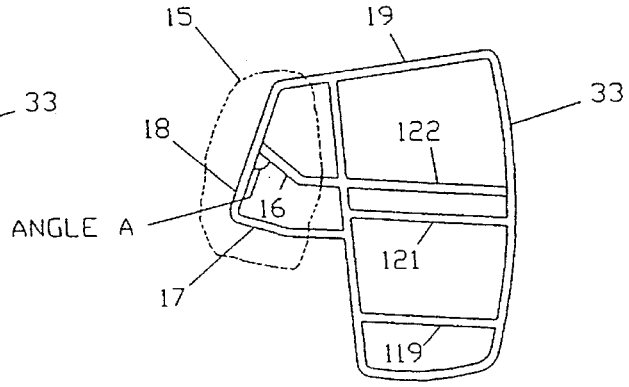
FIG. 6 shows a side view of a full cage double wire faceguard, with the rear portion of the guard highlighted.
Figure 9A:
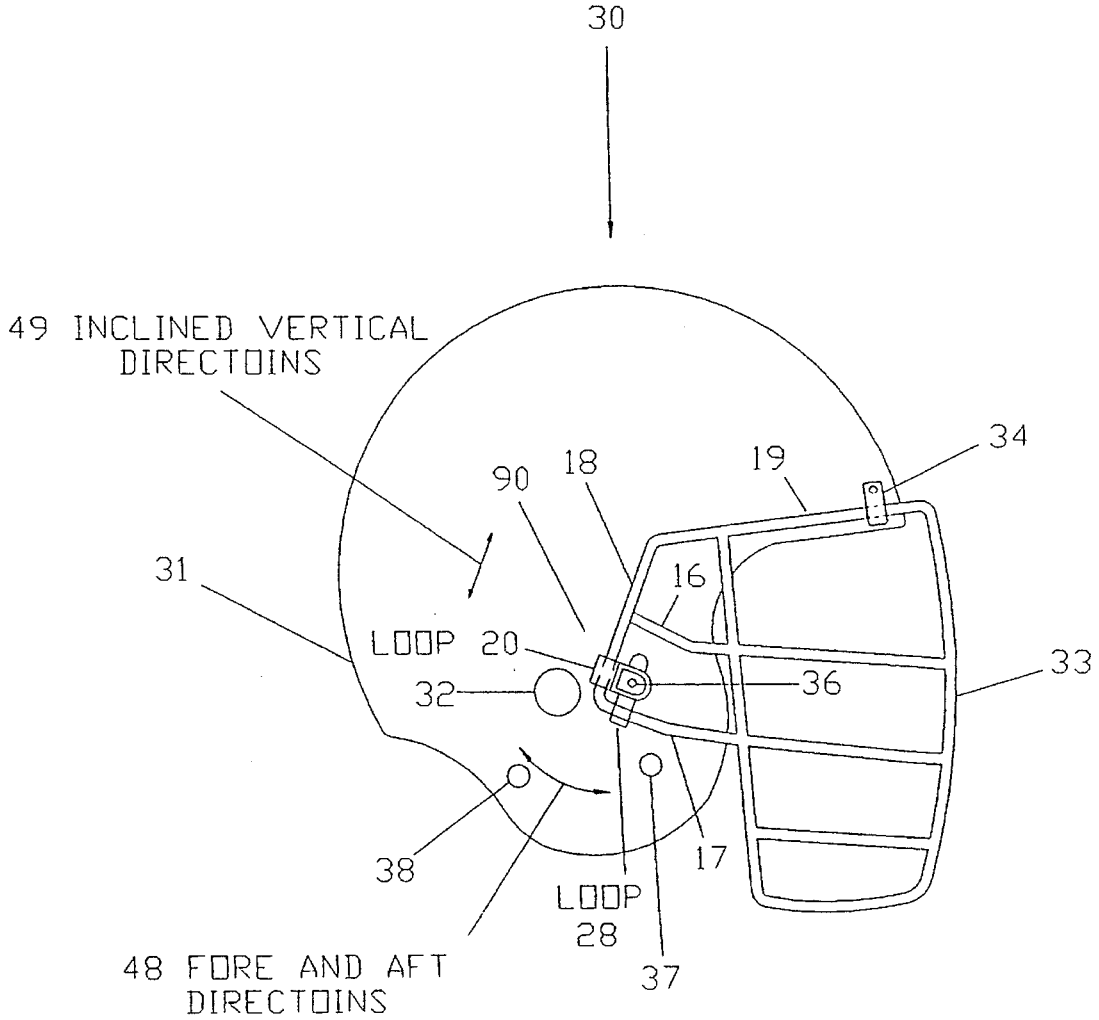
FIG. 9A is a perspective view showing the improved adjustable "L" side attachment strap 90 mounted to the helmet, totally securing a single wire faceguard to a helmet.

A football helmet system 30 is referred to in FIG. 9A. The helmet system 30 includes the helmet 31, ear holes 32, faceguard 33, front attachments 34, present invention adjustable "L" side attachment straps 90, fasteners (screw) 36, top-most chin strap snap 37 and bottom-most chin strap snap 38. Referring to FIGS. 5 and 6, the section of the faceguard enclosed by dotted region 15 will be referred to as the rear section 15 of the faceguard 33. This rear section 15 is the part of the faceguard 33 that gets attached to the sides of the helmet 31.

Referring to FIG. 5, the rear section 15 of the guard 33 is disclosed by dotted region 15. This rear section 15 of the guard 33 is comprised of two bars 16 and 17, that extend from the main grid of the guard 33 horizontally then bend angularly upward toward the rear of the helmet 31, these bars project from the main grid of the faceguard 33. In FIG.

5, segment 16 refers to the upper of these two bars while segment 17 refers to the lower of these two bars.

The lower of these two horizontal bars 17 has an upwardly inclined bar 18 stemming from it at approximately a 90 degree angle. This angle varies and on some of the less popular faceguards 33, the angle just referred to above is much less than 90 degrees. Bar 18 is upwardly inclined toward the main frame of the guard 33. This upwardly inclined bar 18 connects to the top-most horizontal bar 16 of the rear section 15 of the guard 33 then continues upward to connect to the top-most bar 19 of the main grid of the faceguard 33.

Figure 1:
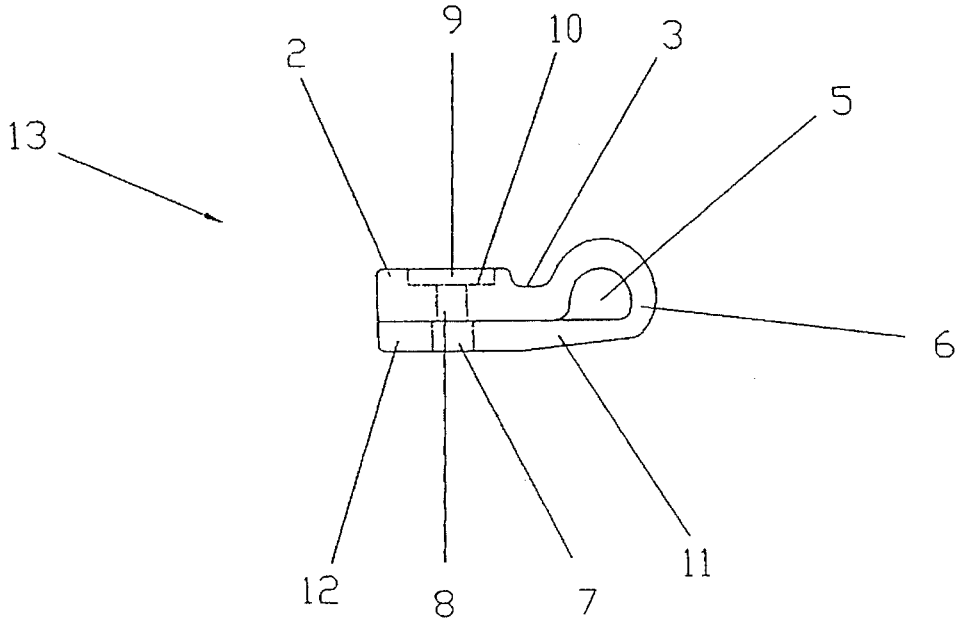
FIG. 1 PRIOR ART
FIG. 1 is a sectional evaluational view of the prior art side attachment strap.
Figure 2:
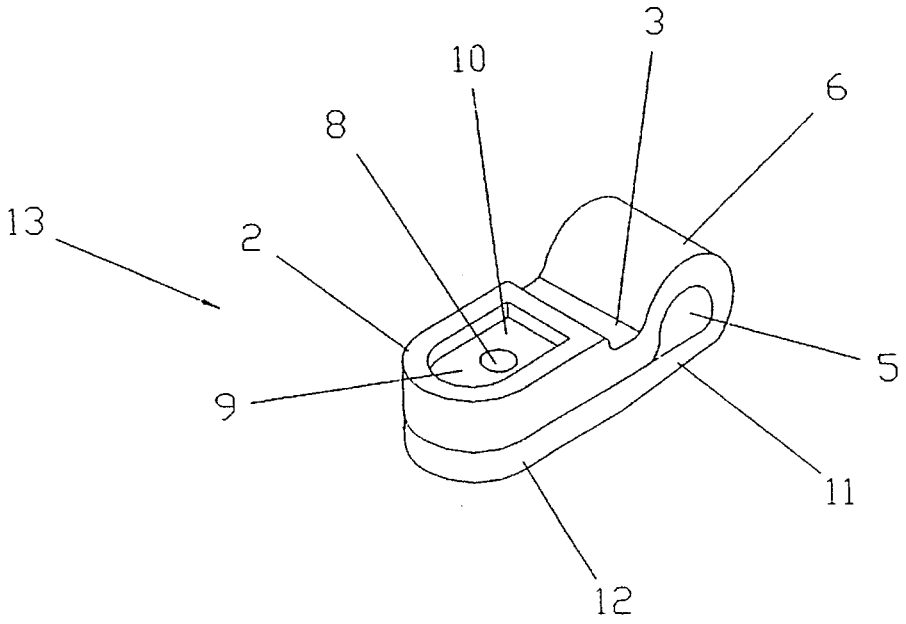
FIG. 2 is an isometric view of the prior art side attachment strap.

FIGS. 1 and 2 disclose the more popular side attachment strap 13 (U.S. Pat. No. 4,633,531) of the prior art side attachment straps. Prior art side attachment strap 13 is formed in the shape of a strap having a loop portion 6. There is a first strap end portion 12 on prior art side attachment strap 13 and a second strap end portion 2; portion 2 is also referred to as the head section. There is also a neck portion 3 on prior art side attachment strap 13. Section 11 denotes the tapered section of the first strap end portion 12 which provides added flexibility. A recess 9 is provided in head section 2 to house the head of the fastener 36, that runs through apertures 7 and 8. Aperture 8 is in head section 2 and aperture 7 is in the first strap end portion 12. Shoulder 10 of recess 9 is engaged by the head of fastener 36; aperture 7 is larger in diameter than aperture 8 because it houses the T-Nut that fastener 36 screws into through aperture 8.

Figure 7:
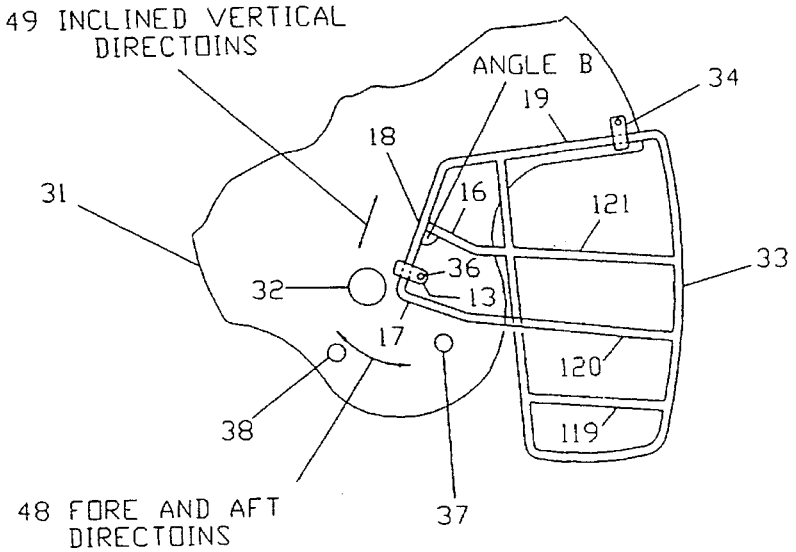
FIG. 7 PRIOR ART
FIG. 7 is a fragmentary view of a full cage single wire guard attached to the helmet by the prior art side attachment straps.

FIG. 7 is a fragmentary view of a helmet 31 depicting a faceguard 33 attached to the side of a helmet 31 by the prior art side attachment straps 13 and front attachments 34 in such a manner that the faceguard 33 is considered to be hinged by the front attachments 34 about the horizontal axis of bar 19. If the prior art side attachments 13 were not in place, the faceguard 33 could be swung in an arc pattern in the fore and aft directions 48 about front attachments 34. The inclined vertical direction 49 is approximately in the direction of the lower part of bar 18, when bar 18 is mounted properly on the helmet 31 as shown in FIG. 7.

Figure 3:
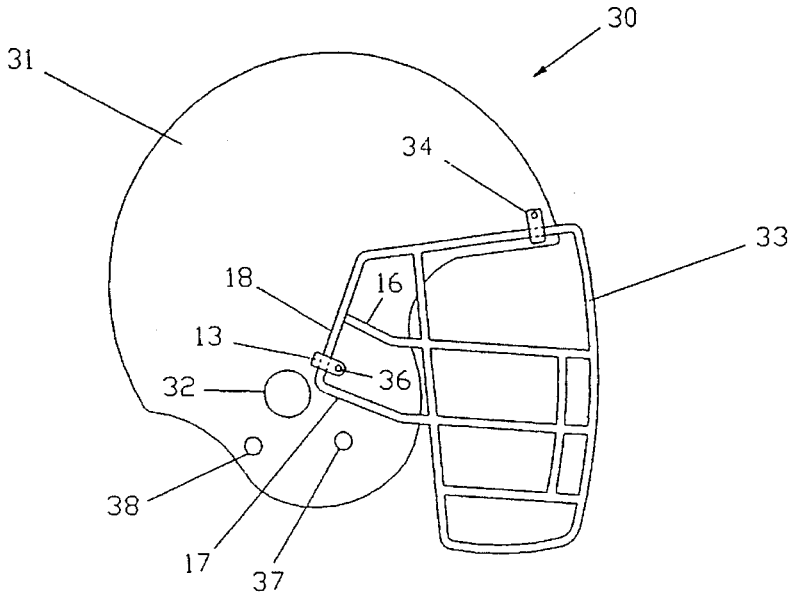
FIG. 3 PRIOR ART
FIG. 3 depicts where the prior art side attachment is originally positioned on the helmet and where it should stay.

FIG. 3 shows the location where the prior art side attachment strap 13 should begin. The prior art side attachment strap 13 should ideally be located as close to bar 17 of the guard 33 as possible. This is because the face guard 33 can be modeled, during a stress analysis, as if it is hinged at the top of the helmet by the two front attachments 34. Thus, by the prior art side attachment straps 13 being as close to the bottom of bar 17 of the guard 33 as possible, the longest moment arm is set up to absorb the impact of the collisions.

Figure 4:
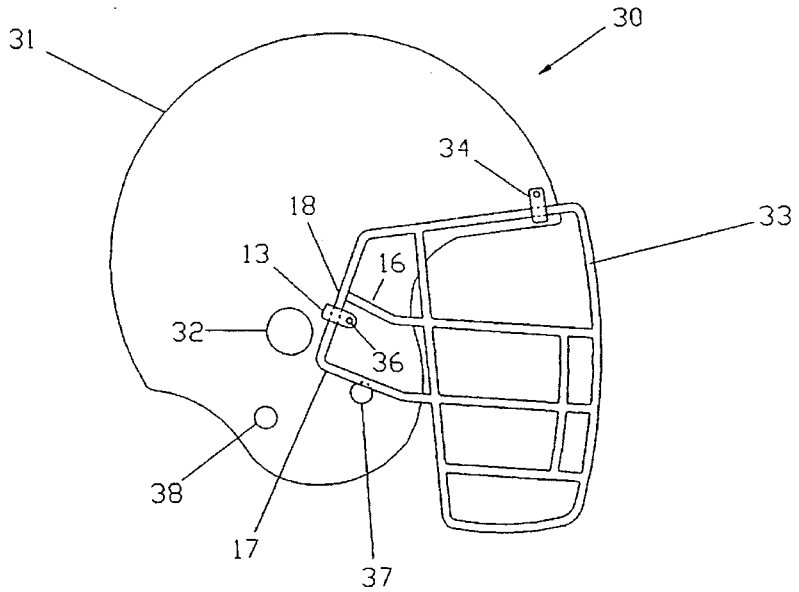

The problems encountered when using the prior art side attachment straps are a result of the fact that they have no means of restricting bar 18, of guard 33, from being moved down through the loop in the prior art side attachment straps 13 due to contact or the normal movements of game play. Note, that in FIG. 4, the prior art side attachment strap 13 remains screwed in the same location that it was in in FIG. 3. However, FIG. 4 shows the worst case scenario for one helmet system 30, where bar 18 of faceguard 33 has been knocked down through the loop of the prior art side attachment strap 13 approximately one inch, bar 16 of guard 33 is now positioned next to the prior art side attachment strap 13 instead of bar 17 as it is designed to be. The faceguard 33 actually remains in the four prior art side attachment straps 13, but it is tilted in one direction. Note, that when the guard gets tilted down an inch to one side, it has moved so far that it is lodged there and cannot return to its original position.

A major problem, depicted in FIG. 4, that is raised by the movement phenomenon described above is that the rear section 15 of the faceguard 33 covers over the chin strap buckle. When the chin strap buckle gets covered over it is impossible to remove that buckle of the chin strap from the chin strap snap 37 on the helmet 31 until the equipment manager loosens the two prior art side attachment straps 13 and un-tilts the faceguard 33; thus, uncovering the chin strap buckle. However, one side of the guard 33 does not always get tilted to a specific side. Rather, the guard 33 can rattle around upon each collision. That is, one side would not get tilted down permanently, and stuck there, but rather while running or on each collision, the guard 33 can rattle up and down or continuously tilt from one side to the other, which is very annoying and distracting to the player.

Figure 8A:
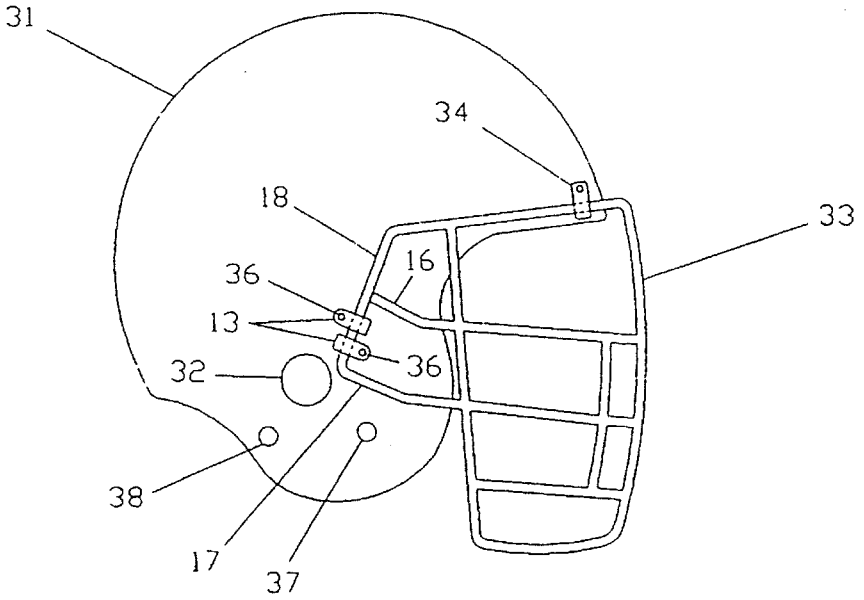
FIG. 8(a) PRIOR ART
FIG. 8A and 8B show two methods of using two of the prior art side attachment straps in parallel, in a not so successful attempt at reducing the amount of movement of the faceguard on the helmet.
Figure 8B:
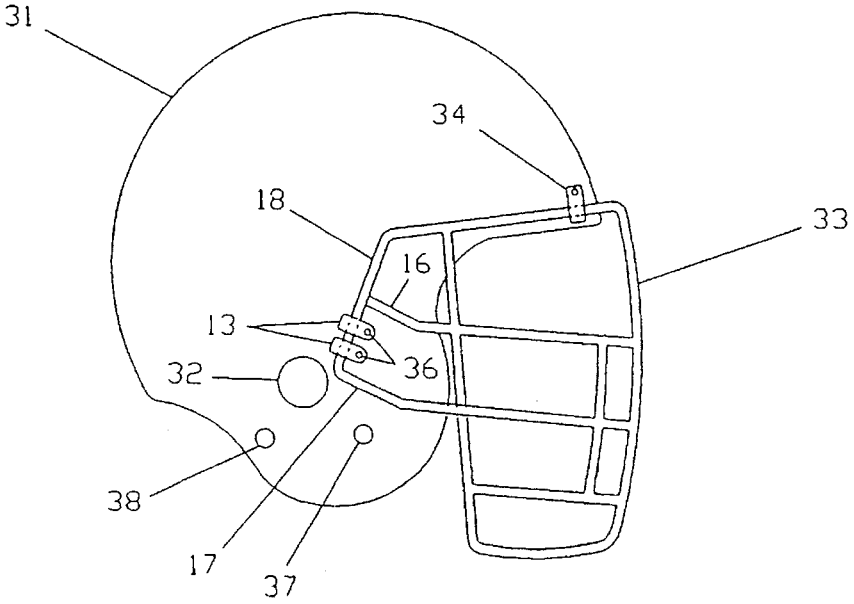
FIG. 8(b) PRIOR ART

FIGS. 8A and 8B depict two methods equipment managers in the NFL and CFA (College Football Association) have used in an attempt to solve this movement problem. Note, that they can fit two of the prior art side attachment straps 13, U.S. Pat. No. 4,633,531, between bars 16 and 17 of faceguard 33. FIG. 8A depicts the first method, where one strap 13 is placed in compression and the other is placed in tension. In the second method, FIG. 8B, both prior art side attachment straps 13 are placed in tension. This jerry-rigging of the two prior art side attachment straps 13 in parallel does eliminate some of the movement of bar 18 because the two straps essentially act as a block. However, this method does not solve all of the problems because there is still room for bar 18 of the rear section 15 of guard 33 to move and rattle around. This is because the rear section 15 of guard 33 was not designed to snugly fit two of the prior art side attachment straps 13 in parallel; thus, the equipment managers in the NFL and CFA, that Tom Corpus has spoken with, are not satisfied with the results they have obtained from using two of the prior art side attachment straps 13 in parallel. One other problem with this make-shift corrective method is that an extra hole that was not deigned to be there, has to be drilled into the helmet 31 by the equipment manager to secure the second side attachment strap in. In fact, they have created more problems in the form of weakening the helmet shell when they drill an extra hole in the helmet 31 to mount the second side attachment strap 13 in. When a faceguard 33 needs to be changed or serviced, there are now twice as many screws, T-Nuts and washers to deal with. When the faceguards 33 are double strapped, there is still movement of bar 18 of the rear section 15 of guard 33; also, the faceguard 33 continues to rattle and move around.

Figure 9B:
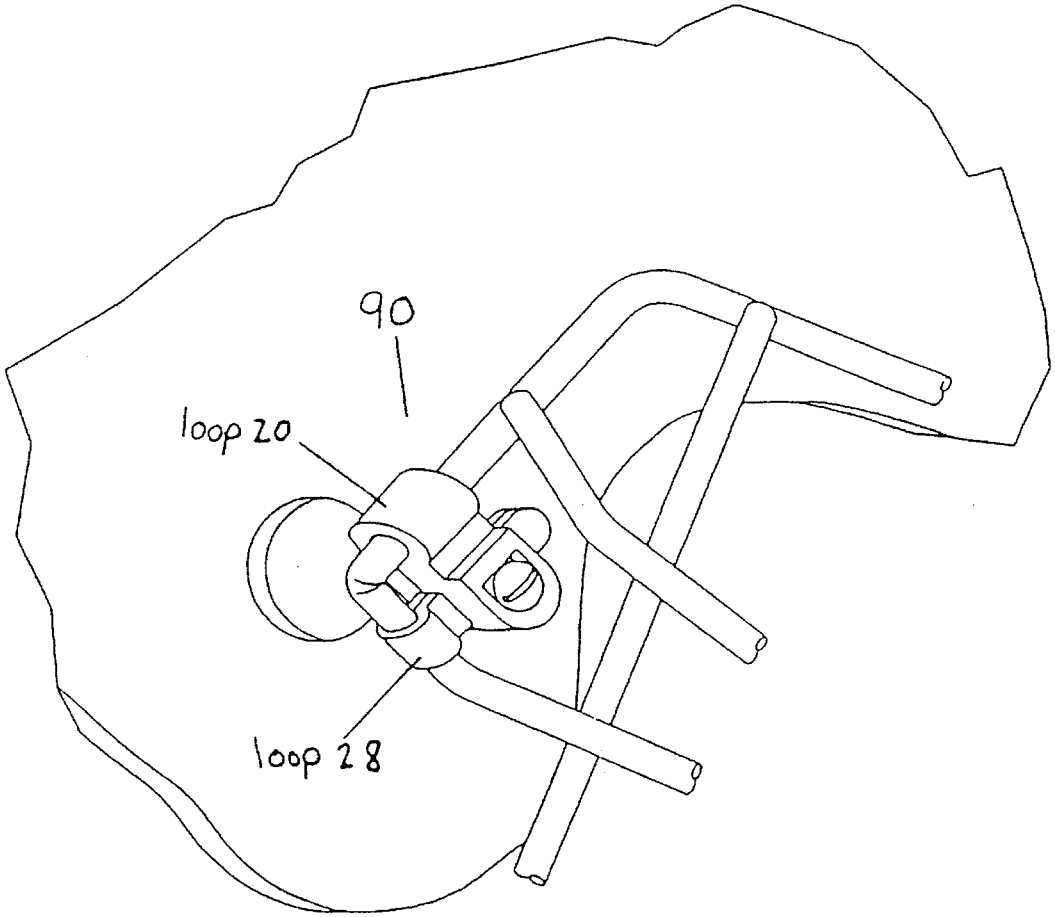
FIG. 9B is a close up view of FIG. 9A highlighting the present invention adjustable "L" side attachment strap 90.
Figure 10A:
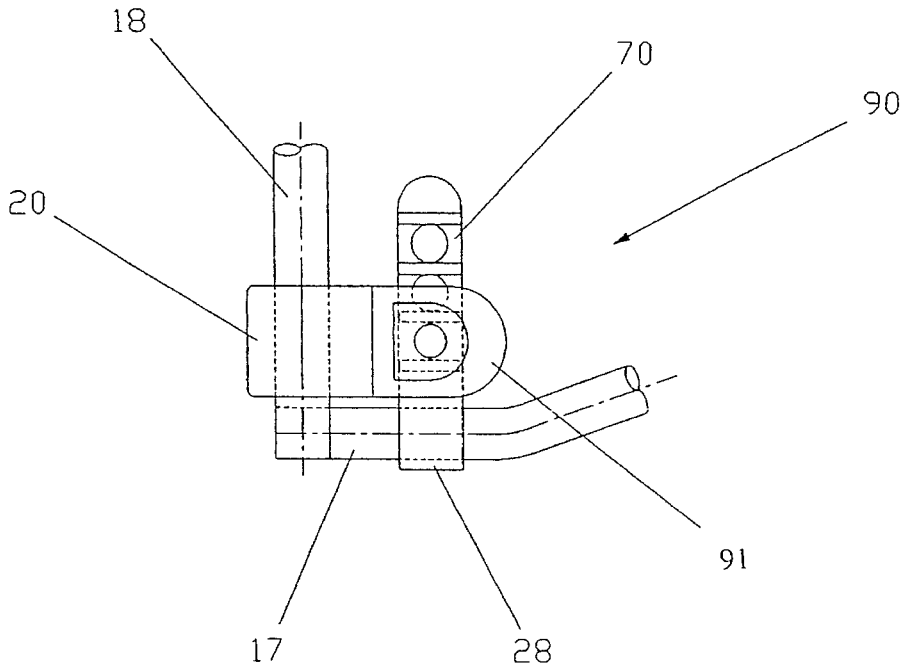
FIG. 10A is a side view of the adjustable "L" side attachment strap 90 encircling bars 17 and 18 of the rear section of the faceguard.
Figure 10B:
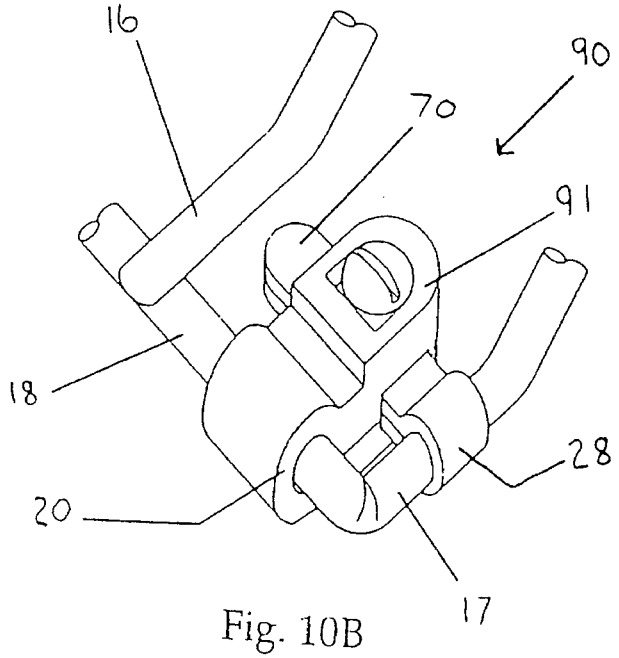
FIG. 10B is an isometric view of the adjustable "L" side attachment strap 90 encircling bars 17 and 18 of the rear section of the faceguard.
Figure 11:
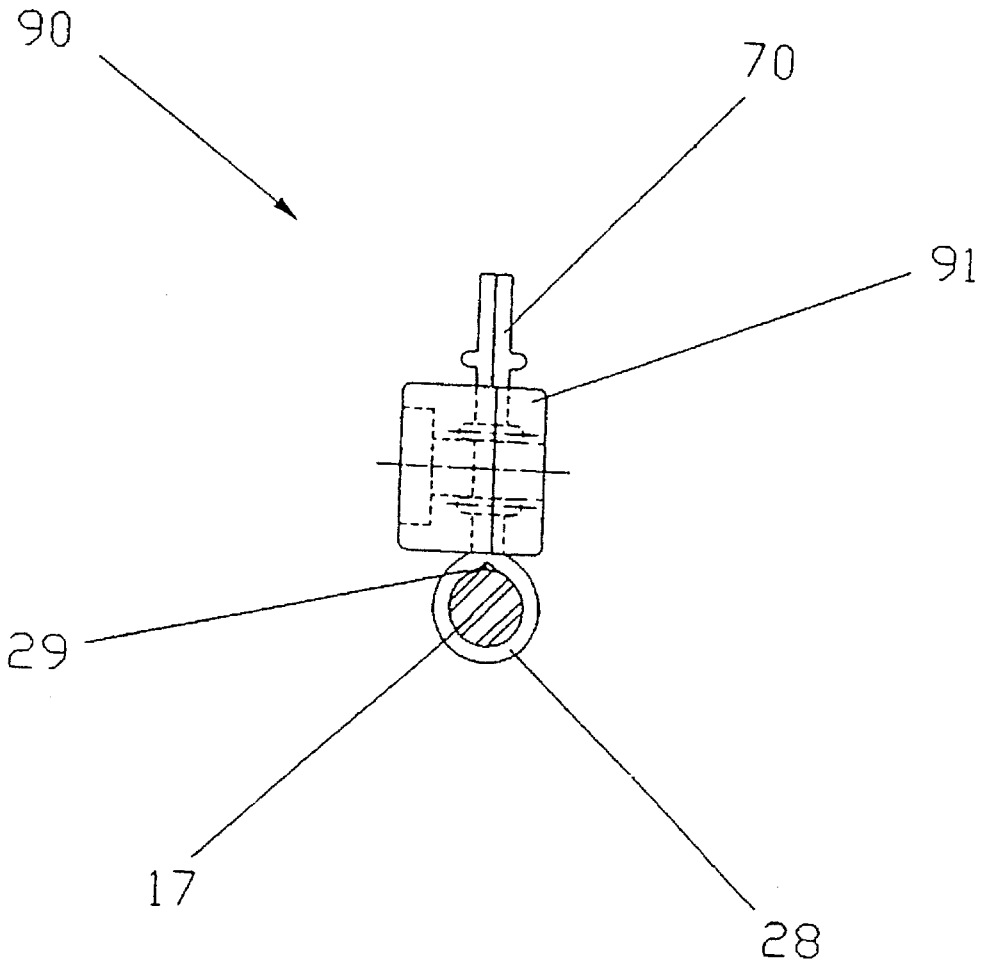
FIG. 11 is a front view of the adjustable "L" side attachment strap 90 encircling bar 17 of the rear section of the faceguard.

Referring now to FIGS. 9–11, an adjustable "L" side attachment strap 90 according to the present invention is disclosed comprising two attachment straps: 91 and 70 each with single loop portions 20 and 28 respectively. Main attachment strap 91 encircles the rear-most vertical bar 18 of the rear section 15 of the faceguard 33 while retention strap 70 encircles the lowest horizontal bar 17 of the rear section 15 of the faceguard 33 and fits into the notch 52 in main attachment strap 91. The loop portions 20 and 28 can include any shape as long as it is capable of wrapping around a bar or plastic segment.

Figure 12A:
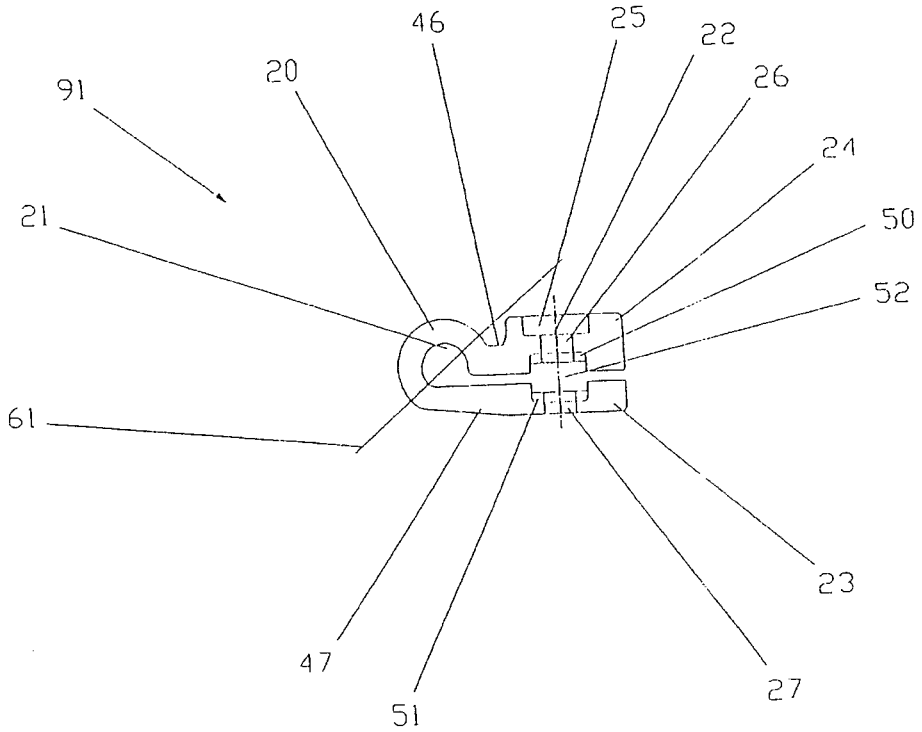
FIGS. 12A and 12B are side views of the main attachment strap 91 of present invention adjustable "L" side attachment strap 90 with and without dimensions.
Figure 12B:
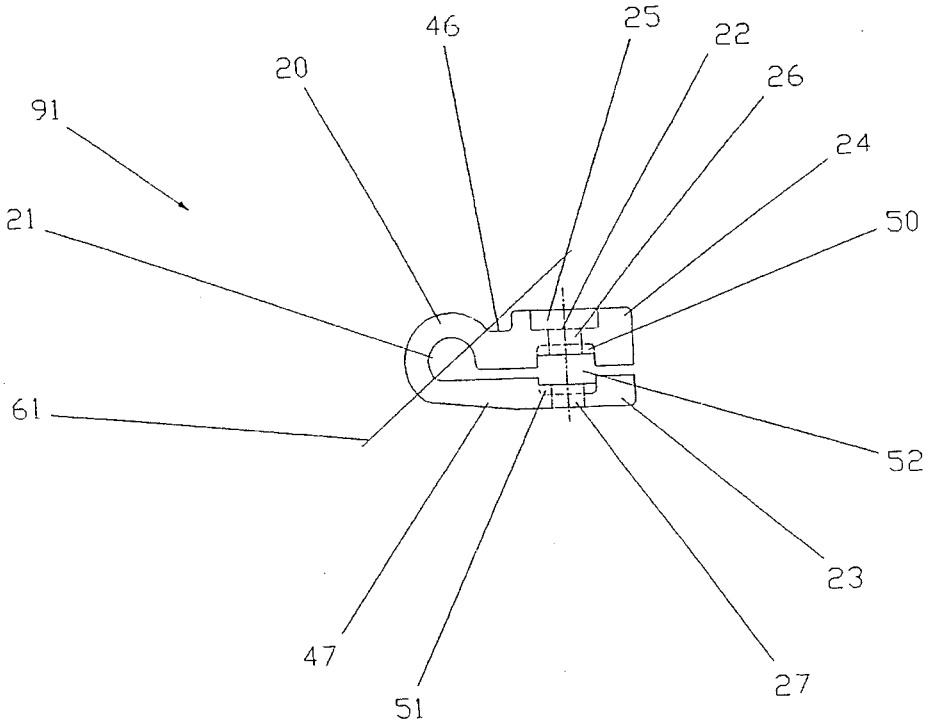
Figure 13:
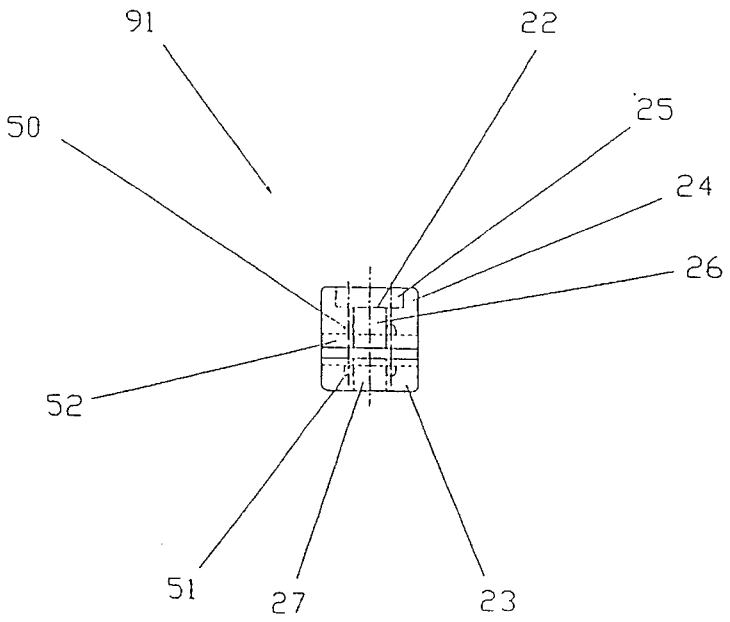
FIGS. 13 and 14 are front views of the main attachment strap 91 of present invention adjustable "L" side attachment strap 90 with and without dimensions.
Figure 14:
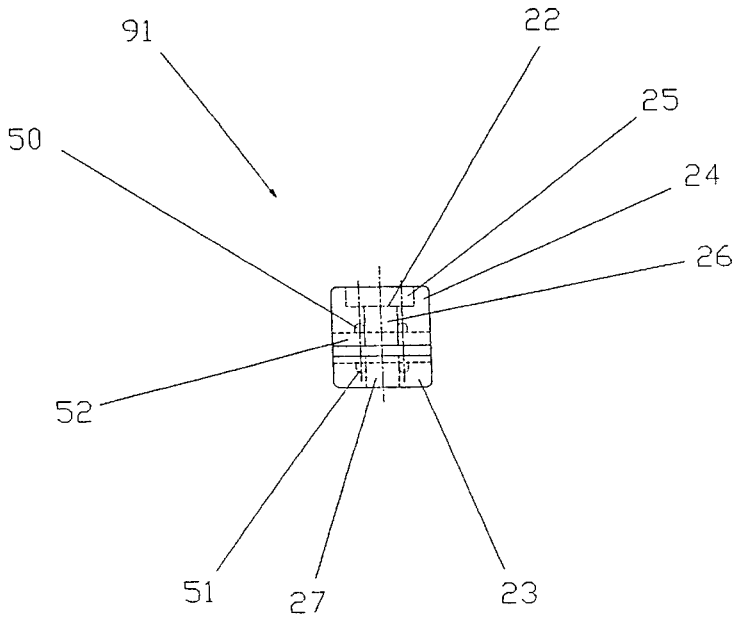
Figure 15:
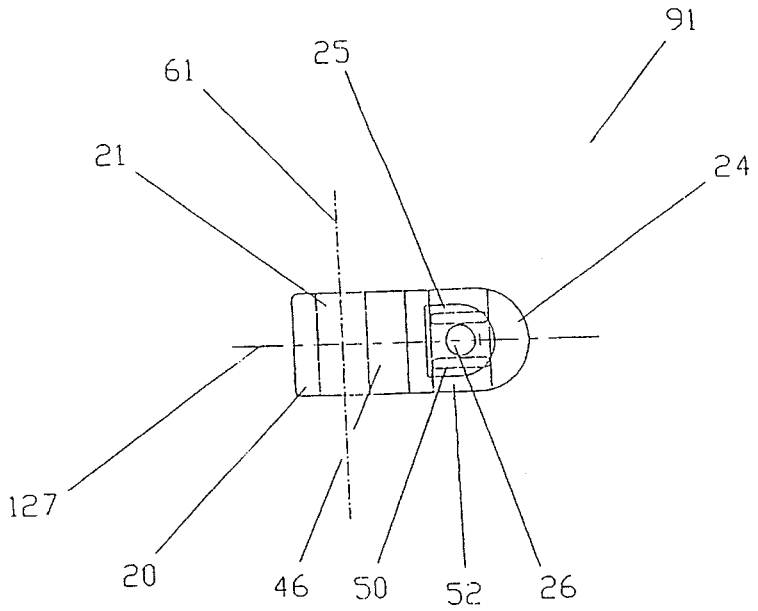
FIGS. 15 and 16 are plan views of the main attachment strap 91 of present invention adjustable "L" side attachment strap 90 with and without dimensions.
Figure 16:
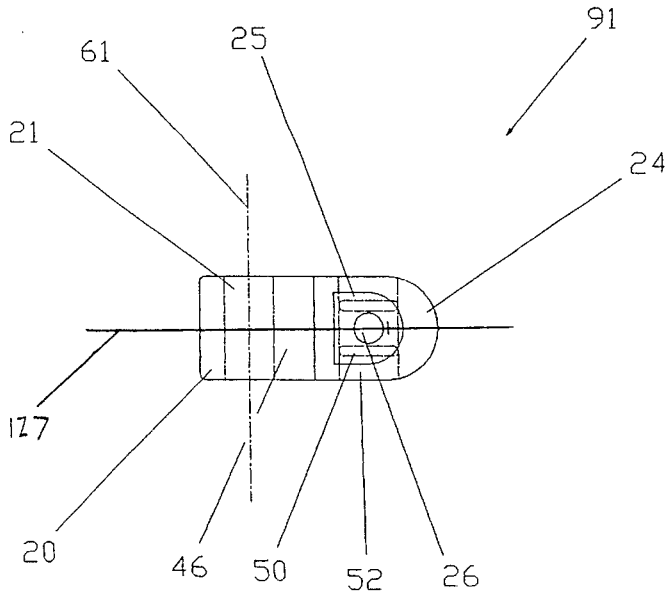
Figure 17:
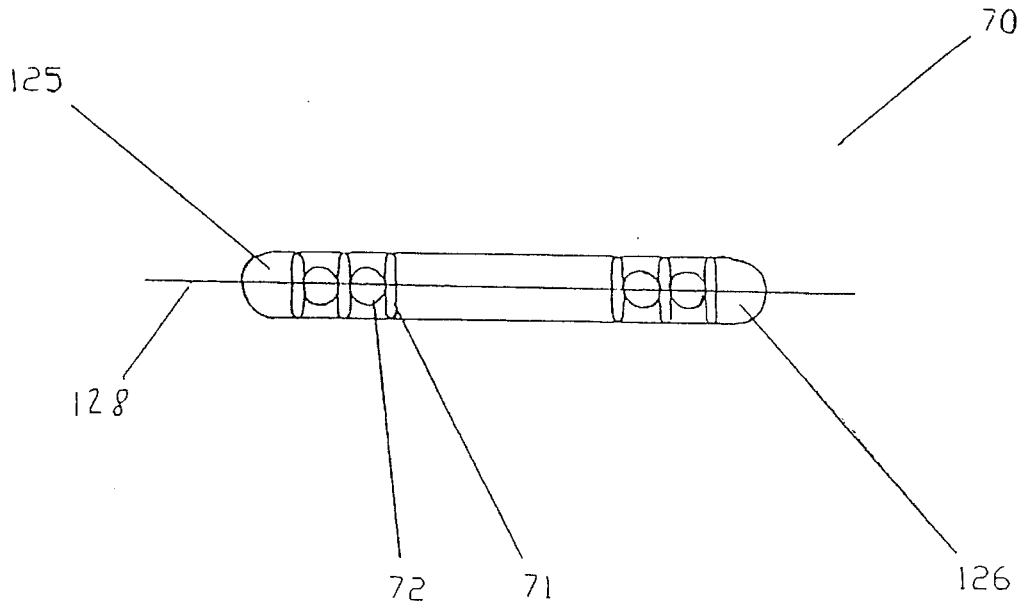
FIGS. 17 and 18 are plan views of the retention strap 70 of adjustable "L" side attachment strap 90 with and without dimensions.
Figure 18:
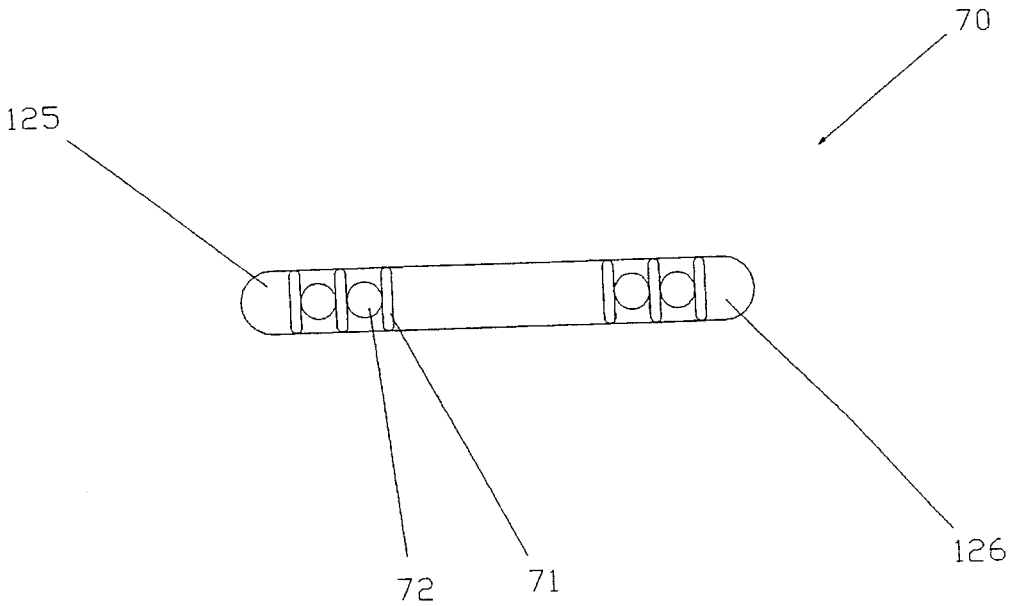

Referring now to FIGS. 12–16, main attachment strap 91 of adjustable "L" side attachment strap 90 according to the present invention is disclosed comprising loop section 20, loop aperture 21 with longitudinal axis 61 which runs longitudinally through the aperture and approximately through the center of the aperture, a first strap end portion 23 and a second strap end portion 24 (or head portion), a recess 25 for housing the head of fastener 36, the shoulder 22 of recess 25, centerline 127, an aperture 26 in strap end portion 24, an aperture 27 in strap end portion 23, a notched out region 52 which is formed by removing sections of both strap end portions 23 and 24 to accommodate retention strap 70, grooved portions 50 in strap end portion 24 to accommodate the teeth 71 of retention strap 70, grooved portions 51 in strap end 23 to accommodate the teeth 71 of retention strap 70, neck portion 46 improves the shock absorbing properties of the strap and tapered portion 47, of strap end portion 23, adds flexibility which results in greater shock absorbing properties. FIG. 12 depicts that loop portion 20, of main attachment strap 91, is formed by first strap end portion 23 looping into second strap end portion 24.

Referring to FIGS. 17–22, retention strap 70 of the adjustable "L" side attachment strap 90 according to the present invention is disclosed comprising gripping teeth 71, apertures 72, loop section 28, strap end portion 125, strap end portion 126, centerline 128 and loop aperture 29 with longitudinal axis 62 which runs longitudinally through the aperture and runs approximately through the center of the aperture. Loop aperture 29 is formed when retention strap 70 is looped around bar 17, of the rear section 15, of the guard 33. The ends of retention strap 70 can then be placed in the notch 52 in the main attachment strap 91.

Refer to FIG. 9 and note the elegance of the present invention adjustable "L" side attachment strap 90. Loop section 20 of main attachment strap 91 encircles bar 18 of the rear section 15 of the guard 33 and prevents the guard 33 from moving in an arc pattern 48 that is set up as a result of the guard being hinged at the top of the helmet 31 by front attachments 34. The improvement of the adjustable "L" side attachment strap 90 over the prior art side attachment straps 13 is that retention strap 70 is wrapped around bar 17 of the rear section 15 of guard 33 with the teeth 71 facing out. The ends of retention strap 70 are placed together and slid into notch 52 of main attachment strap 91, so that there is an angle between main attachment strap 91 and retention strap 70. Once retention strap 70 is adjusted and the ends are pulled through notch 52 to snugly encircle bar 17, of the rear section 15 of the guard 33, apertures 72 of retention strap 70 are aligned with apertures 26 and 27 of the main attachment strap 91 and teeth 71 of retention strap 70 mesh with grooves 50 and 51 of main attachment strap 91. Once all of the above is accomplished, one T-Nut and one screw 36 will secure both the main attachment strap 91 and the retention strap 70 to the helmet 31 in the existing hole that is provide by the manufacturer of the helmet 31. Retention strap 70 may be looped just around bar 16 of the rear section 15 of the guard 33 to restrict movement to a significant degree in the inclined vertical direction 49. Note: the T-Nut can be placed through a metal or plastic washer before the screw 36 is inserted. Retention strap 70 is long enough so that the equipment manager can loop it around bar 17 and adjust it where he wants it. Once retention strap 70 is in the proper position and it is secured to the helmet 31 with fastener 36, there may be some portion of the retention strap 70 extending through notch 52 and hanging out the other side of main attachment strap 91. This excess portion of retention strap 70 may be trimmed off by the equipment manager. When mounted on the helmet 31, these two straps, 91 and 70, become a unitary attachment means—the adjustable "L" side attachment strap 90.

By retention strap 70 encircling bar 17, bar 18 of the rear section 15 of the guard 33 is restricted from getting moved in the inclined vertical direction 49 through loop section 20 of main attachment strap 91. The improvement of this invention consists in simultaneously positively restricting movement in the inclined vertical direction—ie. friction plays a negligible role in preventing movement in the inclined vertical direction. Thus, solving and eliminating the above stated problems of the prior art side attachment straps 13. Referring to FIG. 9, note that each strap 91 and 70 of the present invention adjustable "L" side attachment strap 90 will be put in tension when the guard 33 encounters a downwardly angled frontal blow. By securing the sides of a faceguard 33 to a helmet 31 with the present invention adjustable "L" side attachment strap 90, the user of a helmet system 30 would have a faceguard 33 that is totally secured to his helmet 31 and not have to worry about bar 17 of the rear section 15 of the guard 33 moving down over the chin strap buckle or guard 33 rattling or moving around during play.

Retention strap 70 of the adjustable "L" side attachment strap 90 is the strap that gives the adjustable "L" side attachment strap 90 its variability in fit (or adjustment) in the vertical direction because retention strap 70 is long enough to be wrapped around bar 17 and encircle it so that the equipment manager can make it any length he wishes. The equipment manager then inserts the ends of retention strap 70 in notch 52 of main attachment strap 91, aligning the apertures of the retention strap 70 and the main attachment strap 91, which aligns teeth 71 of retention strap 70 with grooves 50 and 51 of main attachment strap 91, then fastens the two straps, 91 and 70, to the helmet using one T-Nut and one screw 36 in the existing aperture of the helmet 31. The adjustable "L" side attachment strap 90 can be used on any size helmet/faceguard combination.

FIG. 12 is a side view of the main attachment strap 91. FIG. 12 is the preferred embodiment of main attachment strap 91 of present invention adjustable "L" side attachment. The inner radius of loop aperture 21 can range from approximately 1.00 to 0.05 inches and the outer radius of loop aperture 21 can vary between approximately 1.15 and 0.15 inches respectively and the total length of the main attachment strap 91 of the adjustable "L" side attachment strap 90 can vary between approximately 0.50 and 4.0 inches. The preferred dimensions of the main attachment strap 91 of the present invention adjustable "L" side attachment strap 90 are as follows: total length of the main attachment strap 91, 1.50 inches; width of loop section 20, 0.625 inches; inner radius of loop aperture 21, 0.156 inches; outer radius of loop aperture 21, 0.312 inches; depth of recess 25, 0.125 inches; width of recess 25, 0.44 inches; diameter of aperture 26, 0.212 inches; diameter of aperture 27, 0.212 inches; height of loop section 20, 0.625 inches; thickness of strap end 24, 0.365 inches; thickness of strap end 23, 0.20 inches; width of notch 52, 0.380 inches; height of notch 52, 0.125 inches; depth of grooves 50 and 51, 0.0625 inches; width of grooves 50 and 51, 0.062 inches; length of grooves 50 and 51, 0.380 inches; depth of neck portion 46, 0.125 inches and angle of taper 47 is 6 degrees. Obviously, these dimensions can be varied in order that the main attachment strap 91 of the adjustable "L" side attachment strap 90 can fit faceguards 33 without standard dimensions or guards that are comprised of plastic bars. The dimensions can also be varied so that the main attachment strap 91 of the adjustable "L" side attachment strap can fit faceguards that have a "thick" coating around the bars such as the Schutt ArmorGuard faceguard.

Figure 19:
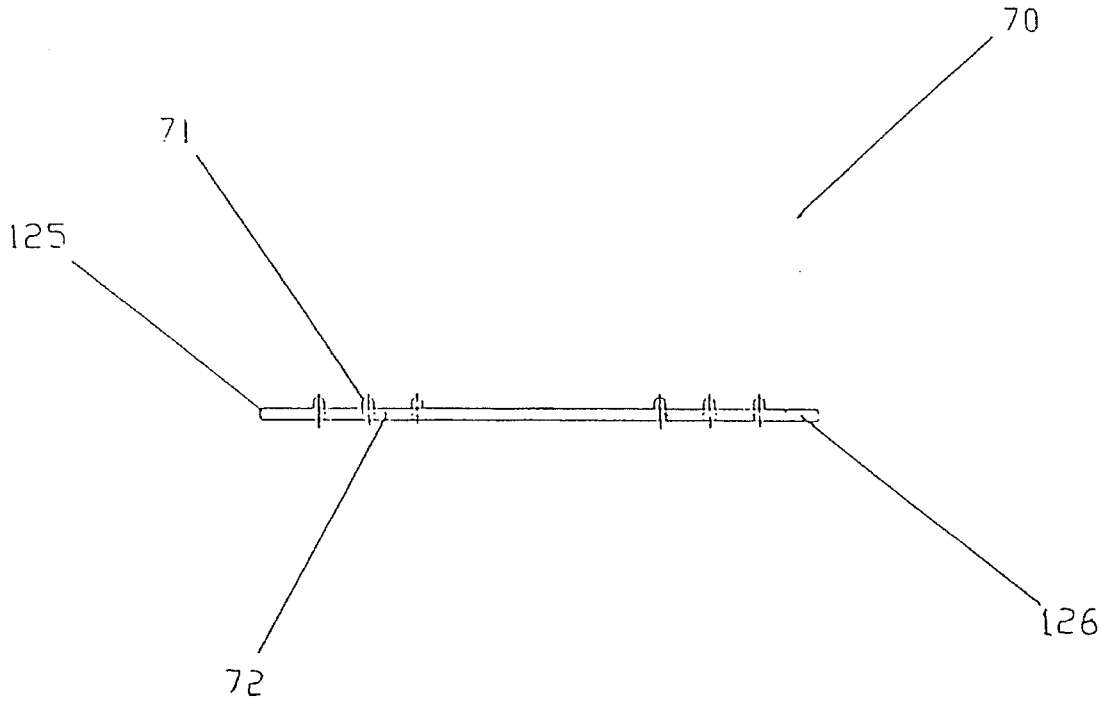
FIGS. 19 and 20 are side views of the retention strap 70 of adjustable "L" side attachment strap 90 with and without dimensions.
Figure 20:
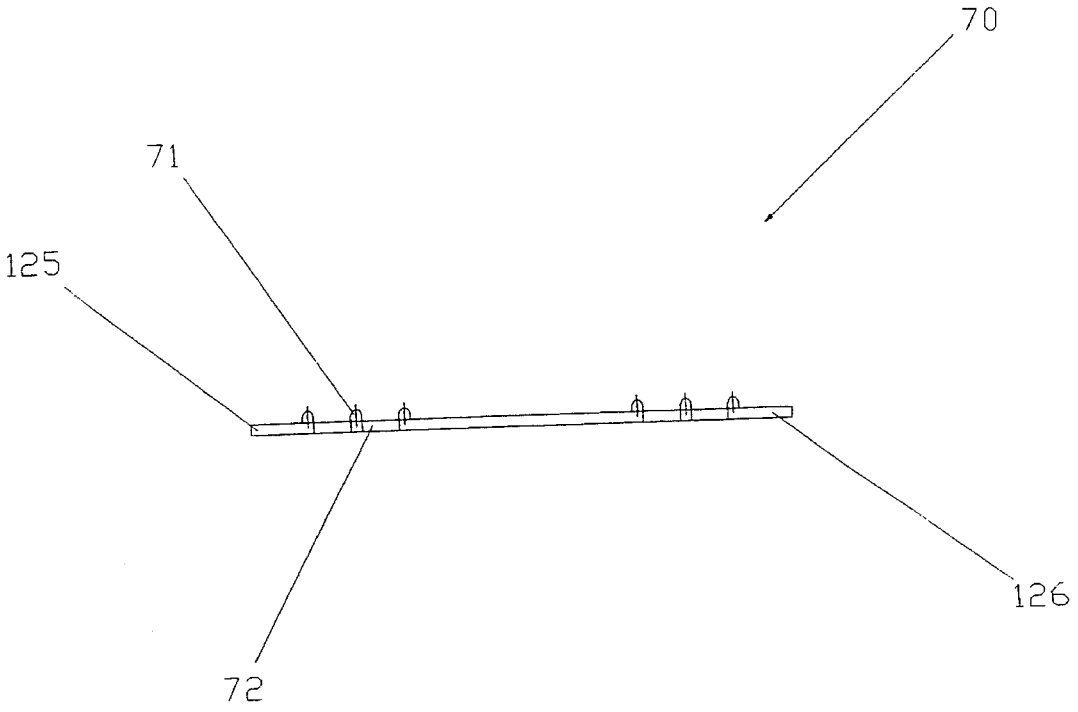
Figure 21:
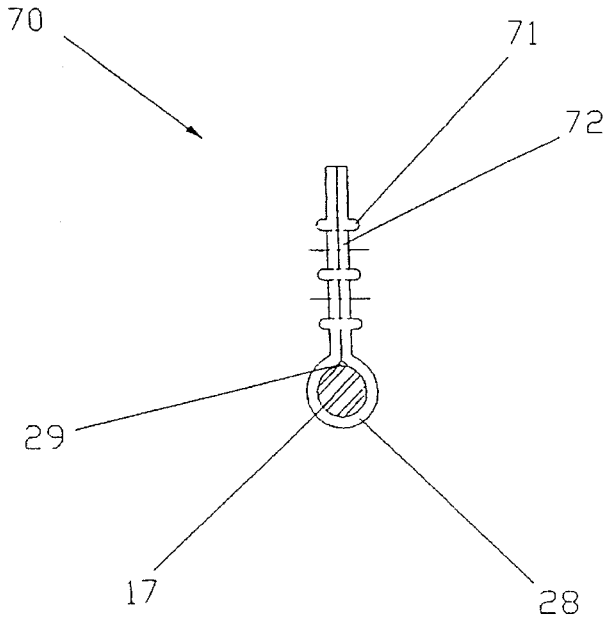
FIG. 21 is a front view of the retention strap 70 of adjustable "L" side attachment strap 90 encircling bar 17 of the rear section of the faceguard.
Figure 22:
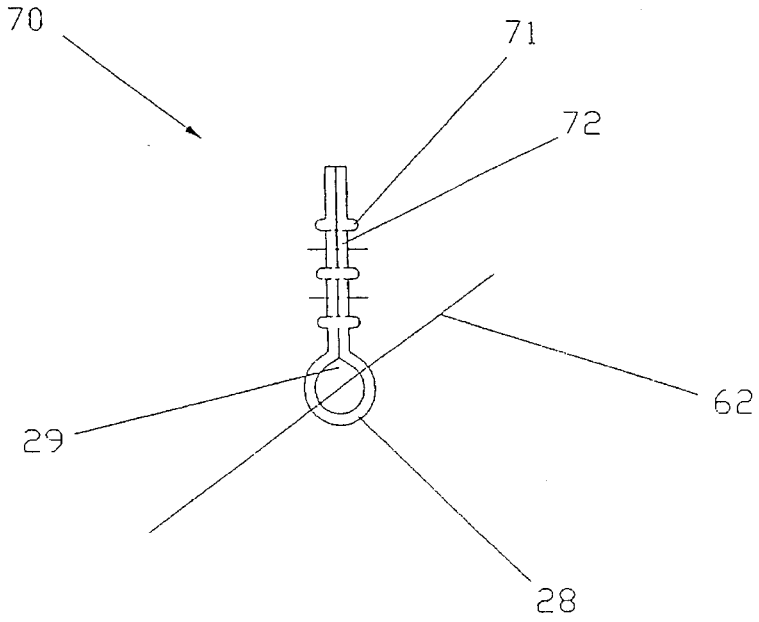
FIG. 22 is the same as FIG. 19A, minus bar 17 of the rear section of the faceguard.
Figure 23:
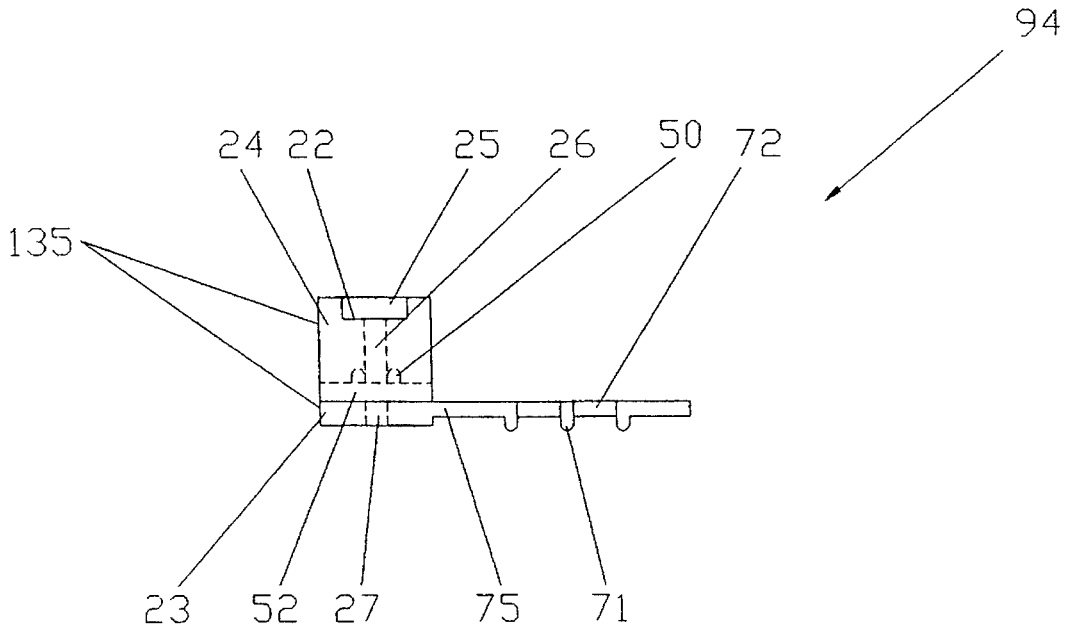
FIG. 23 is a front view of adjustable "L" side attachment strap with partially attached retention strap 94.

FIGS. 19 and 20 are a side views of the retention strap 70. FIGS. 19 and 20 are the preferred embodiment of retention strap 70 of present invention adjustable "L" side attachment strap 90. The length of the retention strap 70 of the adjustable "L" side attachment strap 90, can range from approximately, 0.50 to 6.0 inches; the width of the retention strap 70 can vary from approximately, 0.10 to 3.0 inches; the teeth 71 can vary in width from approximately, 0.015 to 0.50 inches; the teeth 71 can vary in depth from approximately, 0.15 to 0.50 inches and the diameter of the apertures can vary from approximately, 0.05 to 1.00 inches. FIG. 10B depicts the preferred embodiment of the adjustable "L" side attachment strap 90 encircling bars 17 and 18 of the rear section 15 of the guard 33. The preferred dimensions of the retention strap 70 of the adjustable "L" side attachment strap 91 are as follows: total length, 3.098 inches; width, 0.375 inches; thickness, 0.062 inches; diameter of apertures 72, 0.212 inches; height of teeth 71, 0.062 inches; width of teeth 71, 0.062 inches, length of teeth 71, 0.375 inches; distance between teeth 71 of strap end 126, 0.276 inches; distance between apertures 72 of strap end 126, 0.276 inches; distance between center of apertures 72 and center of teeth 71, 0.138 inches and distance between first aperture 72 in strap end 125 and first aperture 72 in strap end 126, 1.619 inches. The number of teeth 71 and apertures 72 as well as the relationship of the teeth 71 to the apertures 72, can vary depending on the desired fit that is trying to be achieved. Obviously, these dimensions can be varied in order that the retention strap 70 of adjustable "L" side attachment strap 90 can fit faceguards without standard dimensions or guards that are comprised of plastic bars. The dimensions can also be varied so that the retention strap 70 of the adjustable "L" side attachment strap 90 can fit faceguards that have a "thick" coating around the bars such as the Schutt ArmorGuard faceguard. FIG. 10B depicts the preferred embodiment of the adjustable "L" side attachment strap 90.

Figure 30:
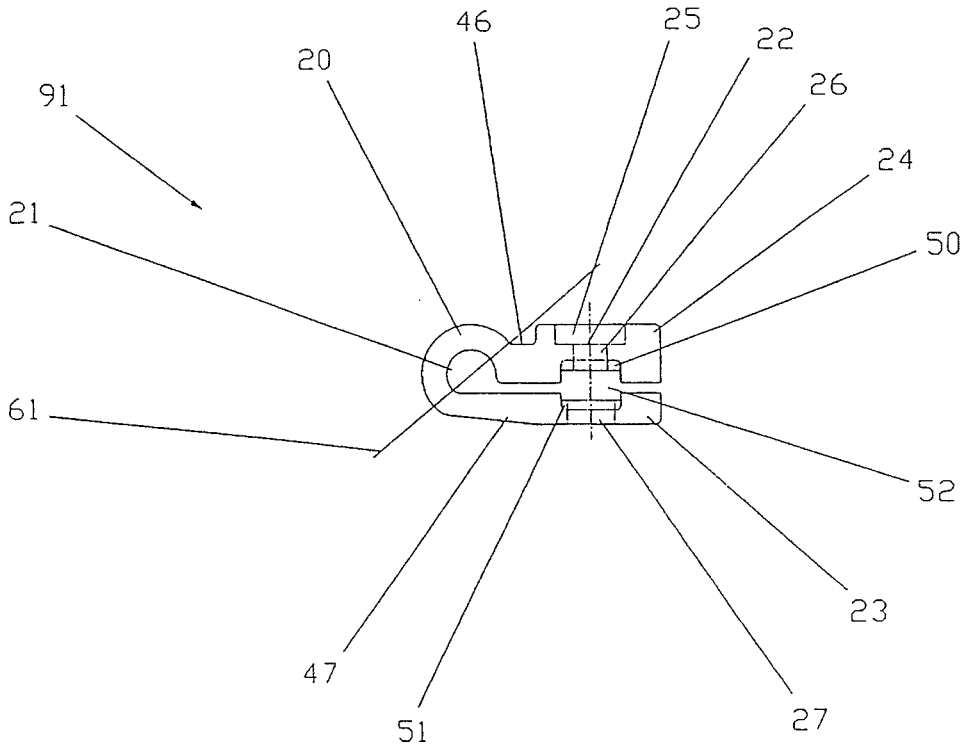
FIG. 30 is a side view of main attachment strap 91 of present invention adjustable "L" side attachment strap 90 where aperture 27 has a wider diameter than aperture 26.

Referring now to FIG. 30, this is a variation of main attachment strap 91 of present invention adjustable "L" side attachment strap 90 that has aperture 27 having a larger diameter than aperture 26.

Figure 31:
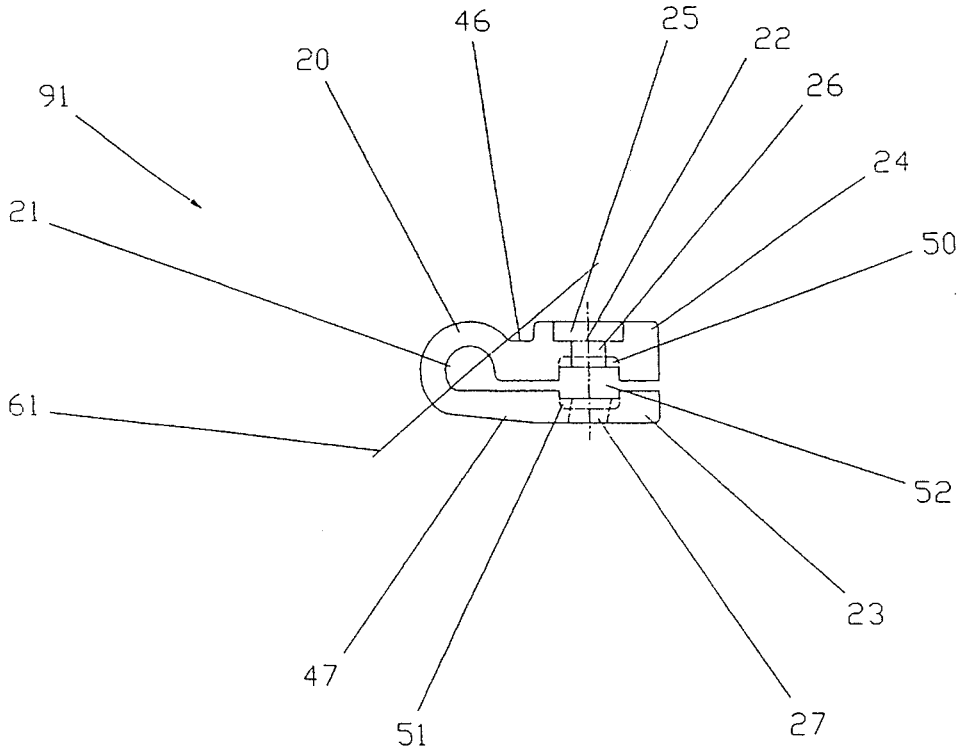
FIG. 31 is a side view of main attachment strap 91 of present invention adjustable "L" side attachment strap 90 where aperture 27 is at an angle compared to aperture 26.

Referring now to FIG. 31, this is a variation of the main attachment strap 91 of the present invention adjustable "L" side attachment strap 90 where the lower aperture 27 is at an angle compared to aperture 26. This angle can take into account the curvature of the helmet 31. Another variation is to have aperture 27 remain straight and then aperture 26 can be angled compared to aperture 27.

Figure 32:
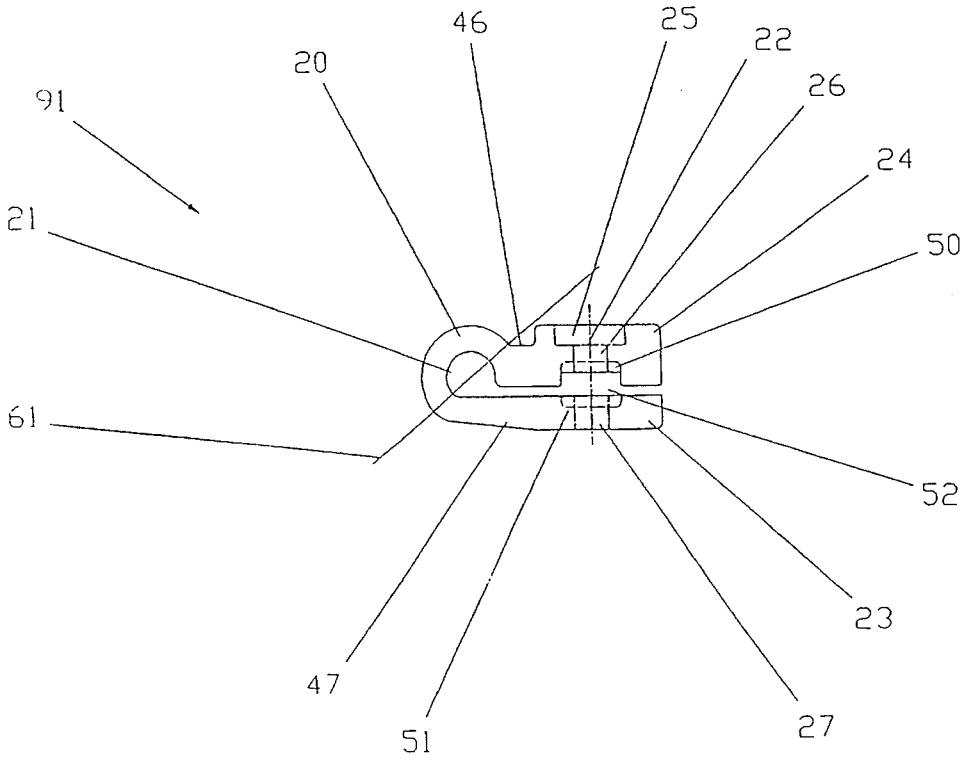
FIG. 32 is a side view of main attachment strap 91 of present invention adjustable "L" side attachment strap 90 where all of notch 52 is in strap end 24.

Referring now to FIG. 32, this is a variation of main attachment strap 91 of the present invention adjustable "L" side attachment strap 90 that does not have any of strap end 23 notched out to accommodate retention strap 70. This allows all of the notch 52 to be put in strap end 24 because it is usually thicker than strap end 23.

Figure 33:
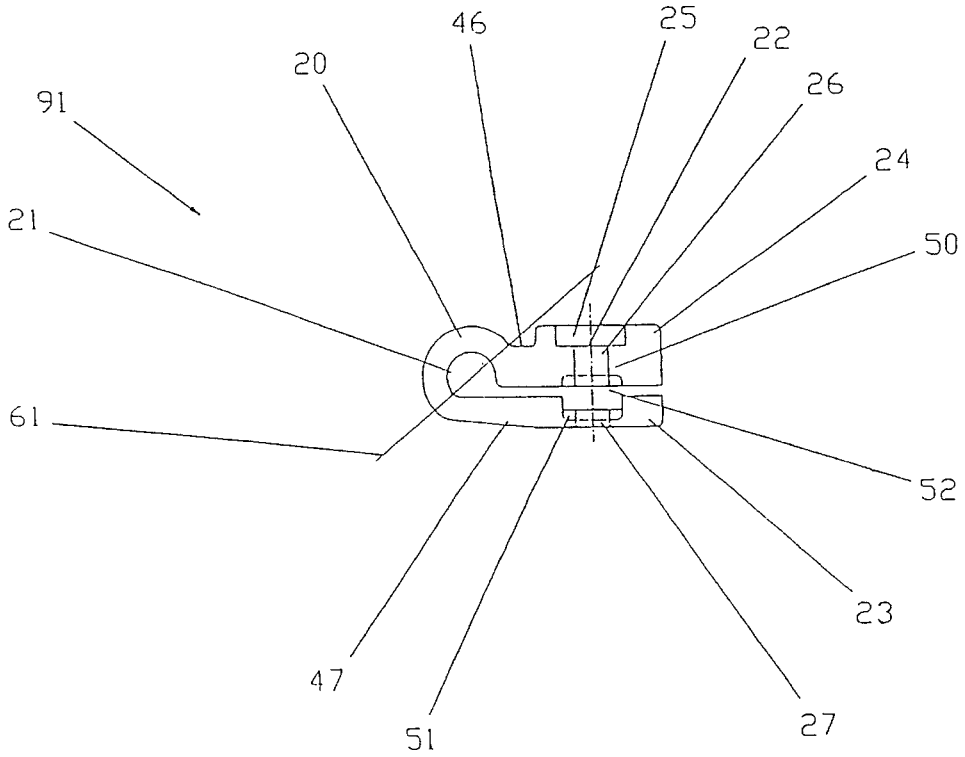
FIG. 33 is a side view of main attachment strap 91 of present invention adjustable "L" side attachment strap 90 where all of notch 52 is in strap end 23.

Referring now to FIG. 33, this is a variation of main attachment strap 91 of the present invention adjustable "L" side attachment strap 90 that does not have any of strap end 24 notched out to accommodate retention strap 70. This allows all of the notch 52 to be put in strap end 23.

Figure 34:
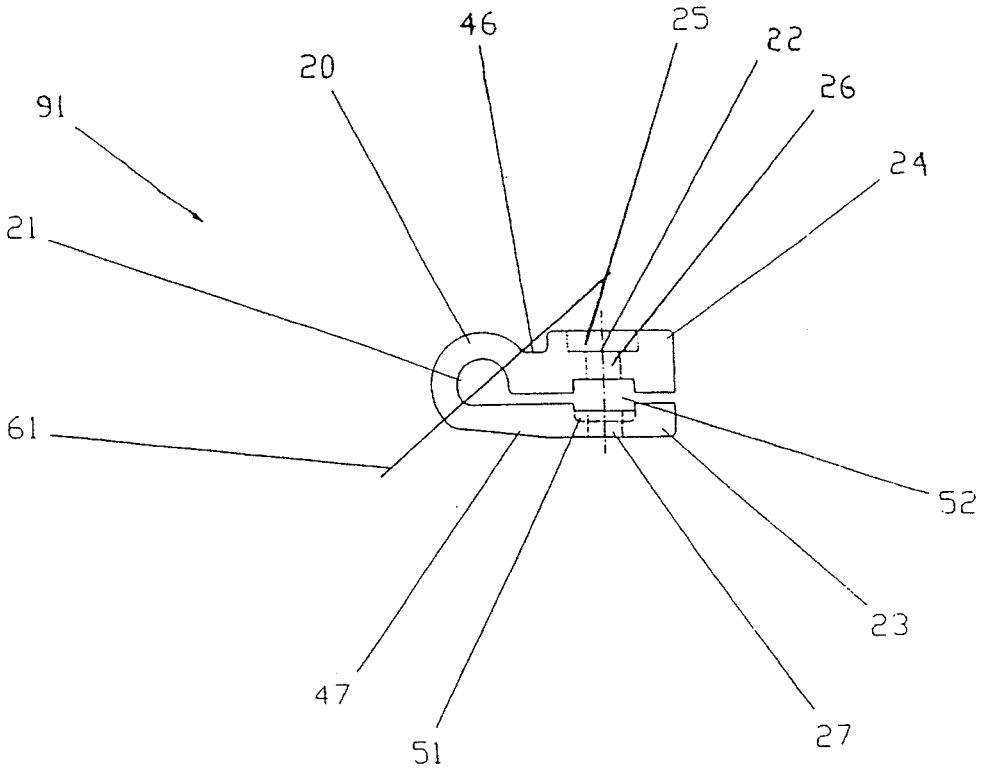
FIG. 34 is a side view of main attachment strap 91 of present invention adjustable "L" side attachment strap 90 where there are no grooves 50 is strap end 24.

Referring now to FIG. 34, this is a variation of main attachment strap 91 of the present invention adjustable "L" side attachment strap 90 where strap end 24 has no grooves 50 for the teeth 71 of retention strap 70 to fit into.

Figure 35:
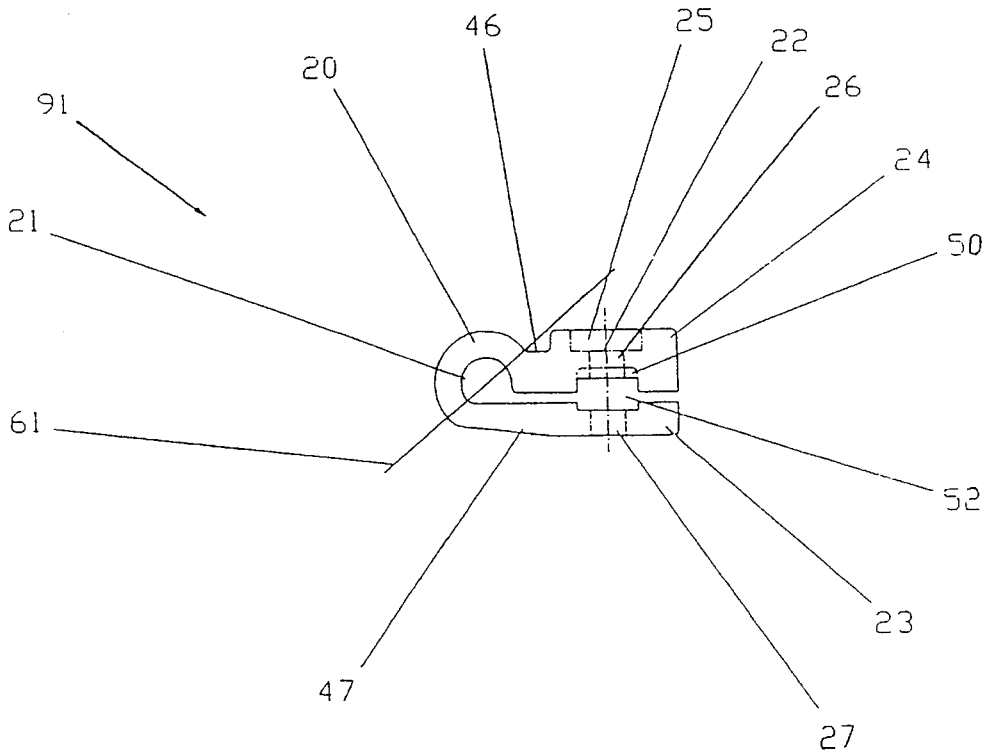
FIG. 35 is a side view of main attachment strap 91 of present invention adjustable "L" side attachment strap 90 where there are no grooves 51 in strap end 23.

Referring now to FIG. 35, this is a variation of main attachment strap 91 of the present invention adjustable "L" side attachment strap 90 where strap end 23 has no grooves 51 for the teeth 71 of retention strap 70 to fit into.

Figure 36:
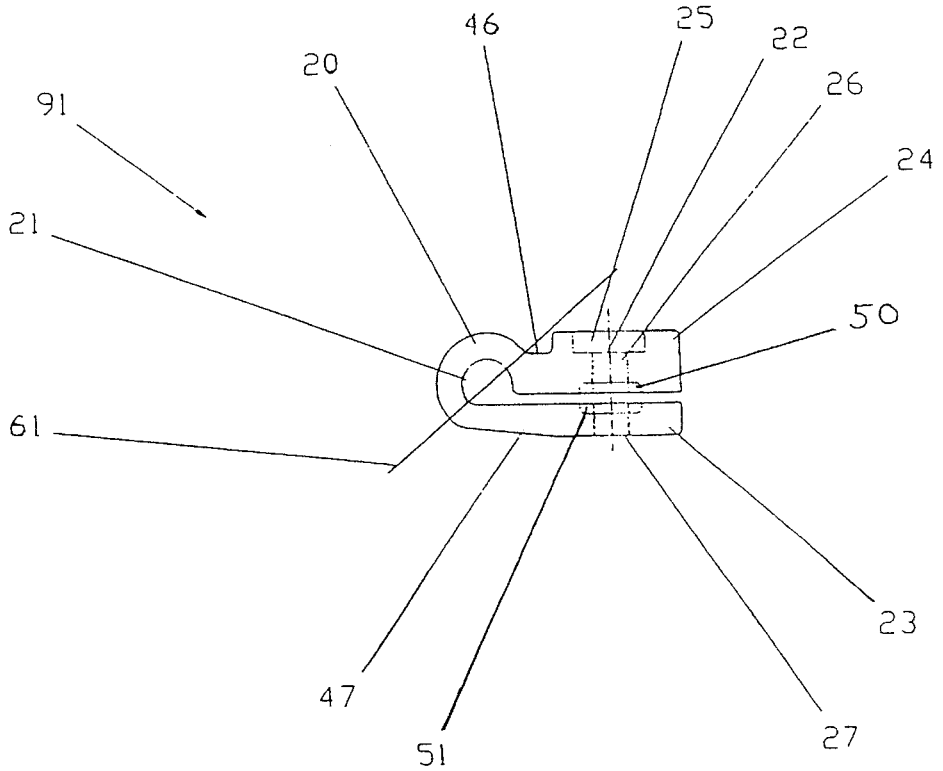
FIG. 36 is a side view of main attachment strap 91 of present invention adjustable "L" side attachment strap 90 where there is no notch 52.

Referring now to FIG. 36, this is a variation of main attachment strap 91 of present invention adjustable "L" side attachment strap 90 where there is no notch 52 for retention strap 70 to fit into. Both ends, 125 and 126, of retention strap 70 can be secured between strap ends 23 and 24 of main attachment strap 91 without a notch 52, or both ends of retention strap 70 can be secured on the outside of strap ends 23 and 24 of main attachment strap 91.

Figure 37:
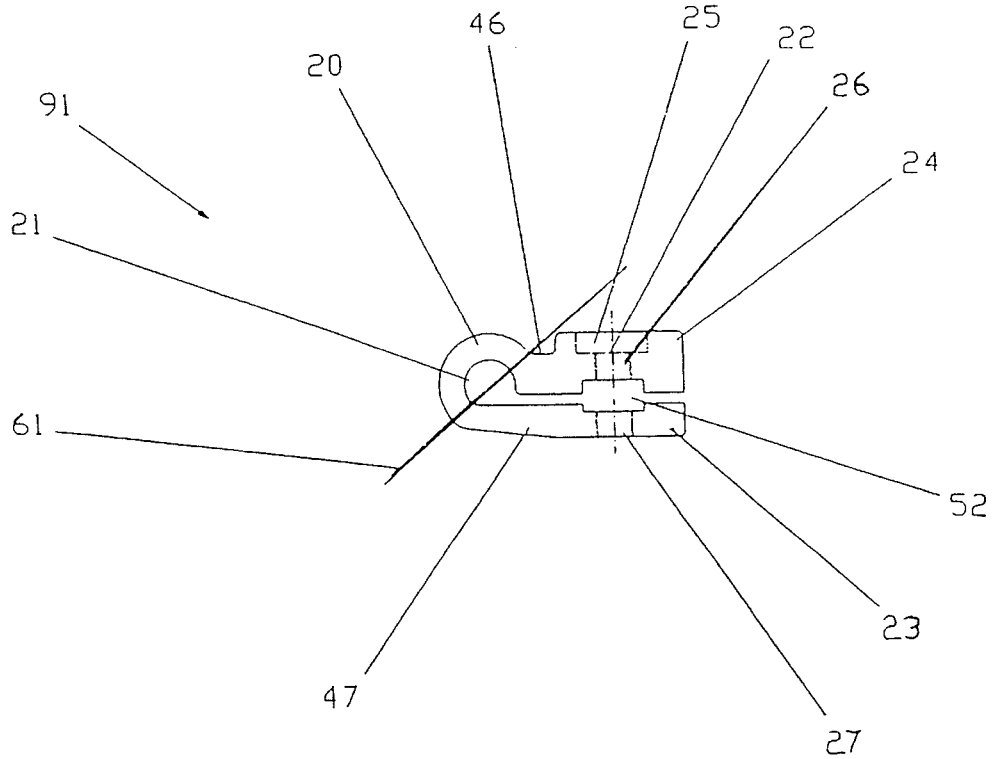
FIG. 37 is a side view of main attachment strap 91 of present invention adjustable "L" side attachment strap 90 where there are no grooves 50 or 51.

Referring now to FIG. 37, this is a variation of main attachment strap 91 of present invention adjustable "L" side attachment strap 90 that has no grooves 50 or 51 in either strap end portion 24 or 23 respectively.

Figure 38:
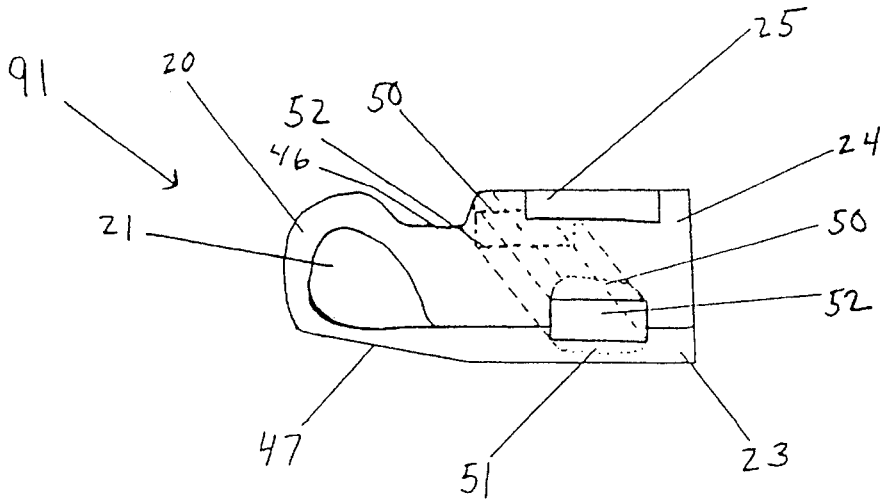
FIG. 38 is a side view of main attachment strap 91 of present invention adjustable "L" side attachment strap 90 where notch 52 extends through the main attachment strap 91 at an angle.

Referring now to FIG. 38, this is a variation of main attachment strap 91 of present invention adjustable "L" side attachment strap 90 where notch 52 extends through main attachment strap 91 at an angle. Grooves 50 and 51 also extend through main attachment strap 91 at an angle. This variation could accommodate faceguards 33 that do not have a 90 degree angle between bars 17 and 18 of the rear section 15 of the guard 33. This angled notch 52 can extend in either direction. For clarity, neither aperture 26 or 27 is depicted in FIG. 38.

Figure 39:
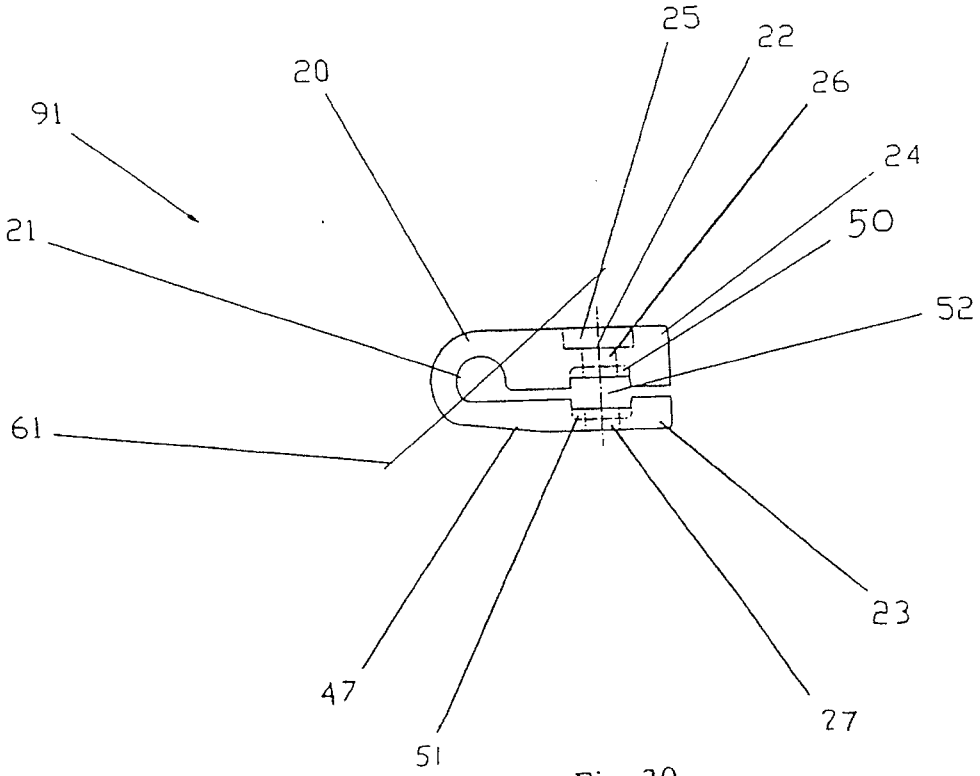
FIG. 39 is a side view of the main attachment strap 91 of present invention adjustable "L" side attachment strap 90 that has no neck portion 46.

Referring now to FIG. 39, this is a variation of main attachment strap 91 of present invention adjustable "L" side attachment strap 90 that has no neck portion 46.

Figure 40:
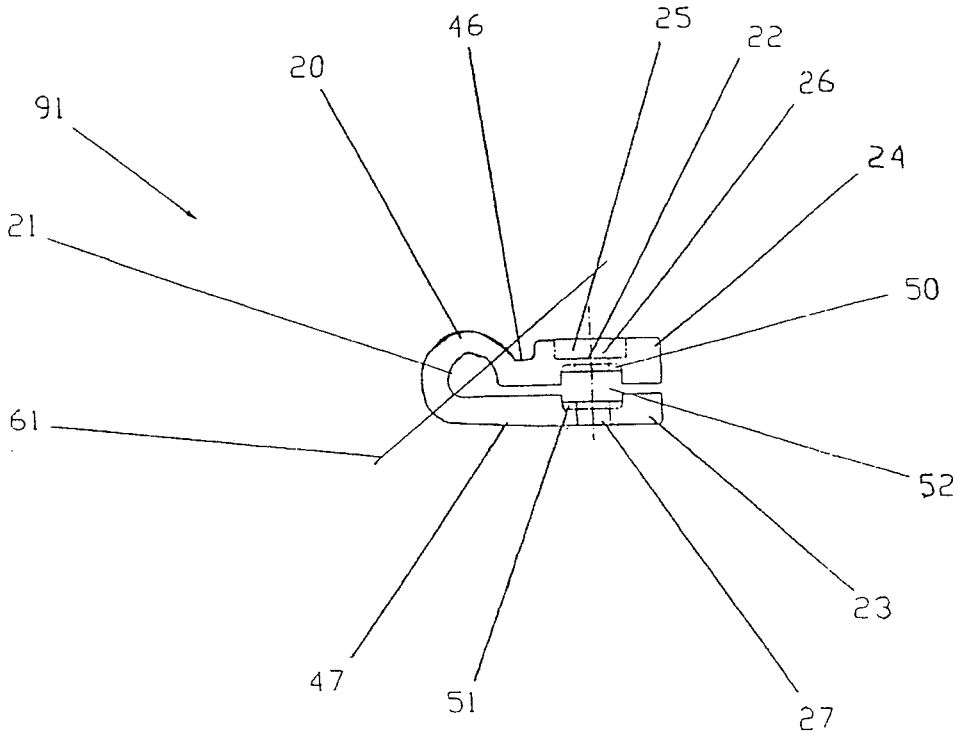
FIG. 40 is a side view of the main attachment strap 91 of present invention adjustable "L" side attachment strap 90 where the thickness of strap end 24 is less than the height of loop 20.

Referring now to FIG. 40, this is a variation of main attachment strap 91 of present invention adjustable "L" side attachment strap 90 that has the thickness of strap end 24 of main attachment strap 91 less than the height of loop section 20 of main attachment strap 91.

Figure 41:
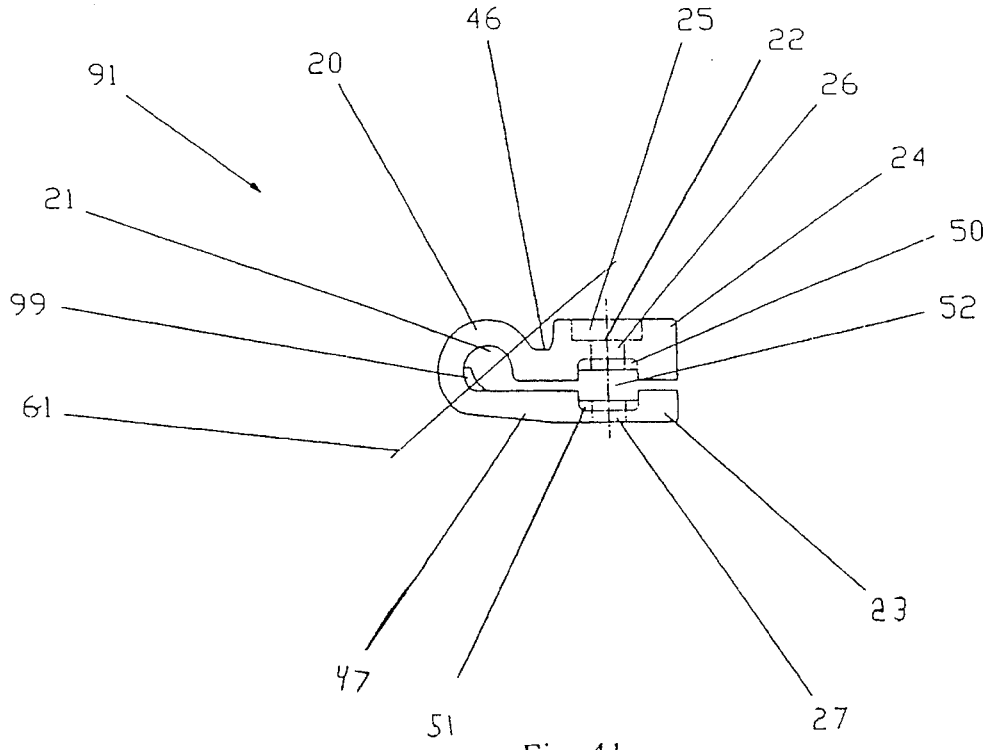
FIG. 41 is a side view of main attachment strap 91 of present invention adjustable "L" side attachment strap 90 where there is a raised angle 99 in loop section 20.

Referring now to FIG. 41, this is a variation of the main attachment strap 91 of present invention adjustable "L" side attachment strap 90 that has a raised angle 99 in loop section 20. This raised angle 99 will provide an extra retention mechanism to keep bar 18 from being moved through loop 20. This same type of raised angle can be incorporated into retention strap 70 to provide an extra retention mechanism to keep bar 17 from being moved through loop 28 that is formed by looping retention strap 70 around bar 17.

Figure 42:
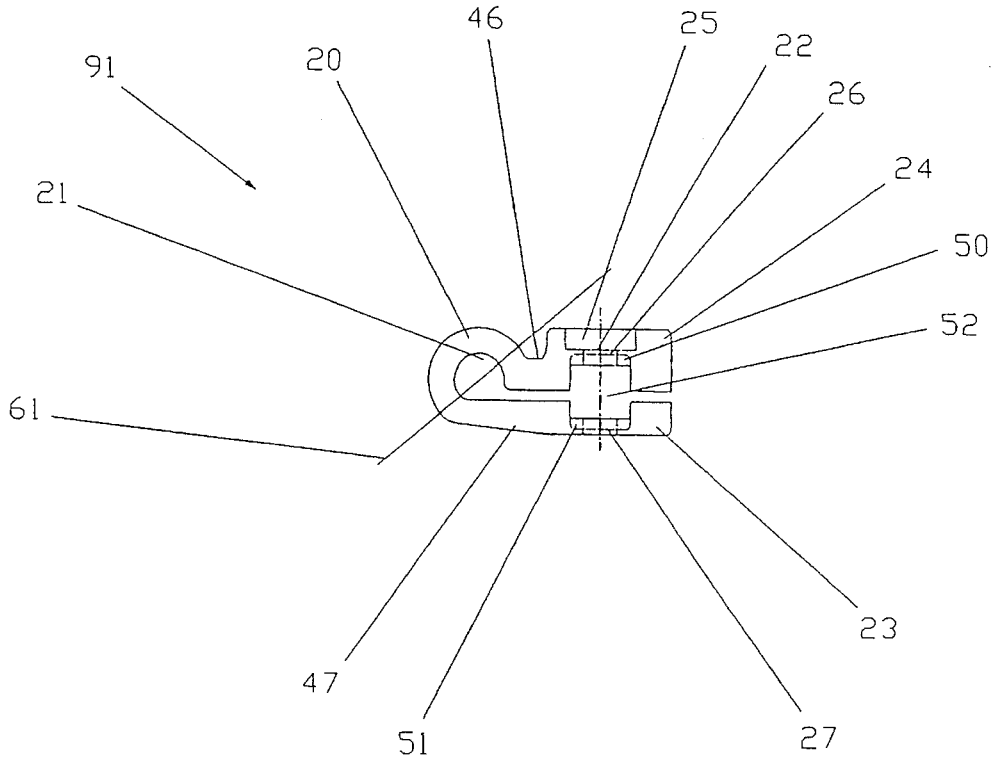
FIG. 42 is a side view of main attachment strap 91 of present invention adjustable "L" side attachment strap 90 where notch 52 is enlarged.

Referring now to FIG. 42, this is a variation of main attachment strap 91 of present invention adjustable "L" side attachment strap 90 where notch 52, of main attachment strap 91, is enlarged. This allows for another retention strap 70 to encircle bar 16 of the rear section 15 of the faceguard 33 and be secured to the helmet 31 in notch 52 along with the other retention strap 70 that encircles bar 17 of the guard 33.

Figure 43:
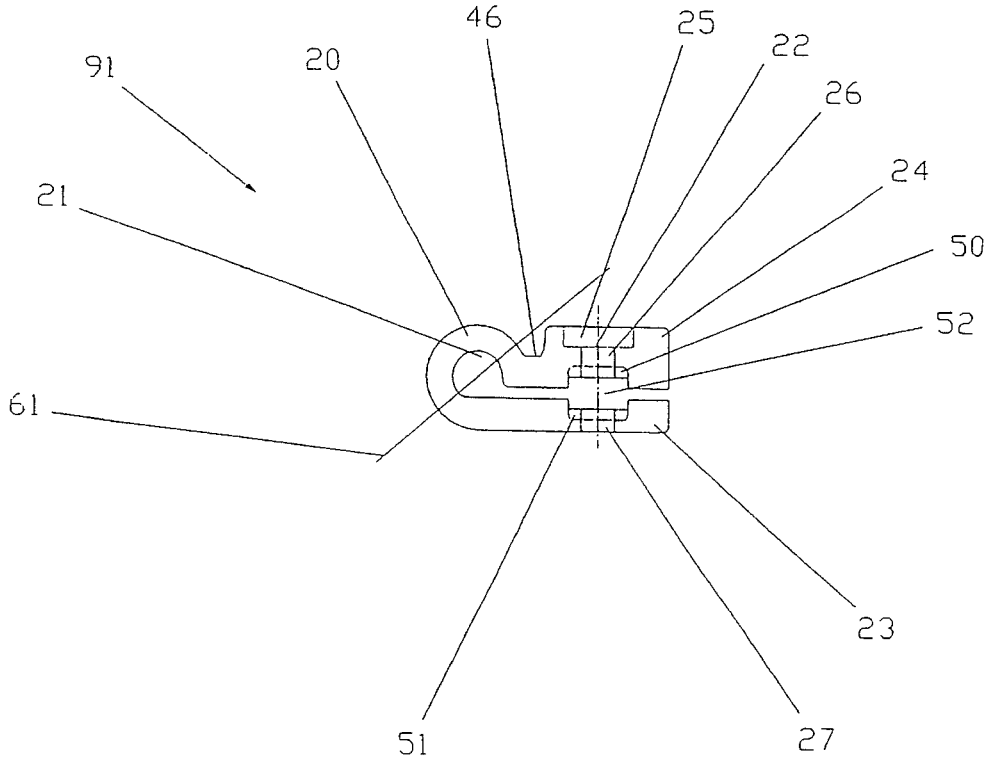
FIG. 43 is a side view of main attachment strap 91 of present invention adjustable "L" side attachment strap 90 where strap end section 23 has no tapered portion 47.

Referring now to FIG. 43, this is a variation of main attachment strap 91 of present invention adjustable "L" side attachment strap 90 where strap end portion 23 of main attachment strap 91 has no tapered portion 47.

Figure 44:
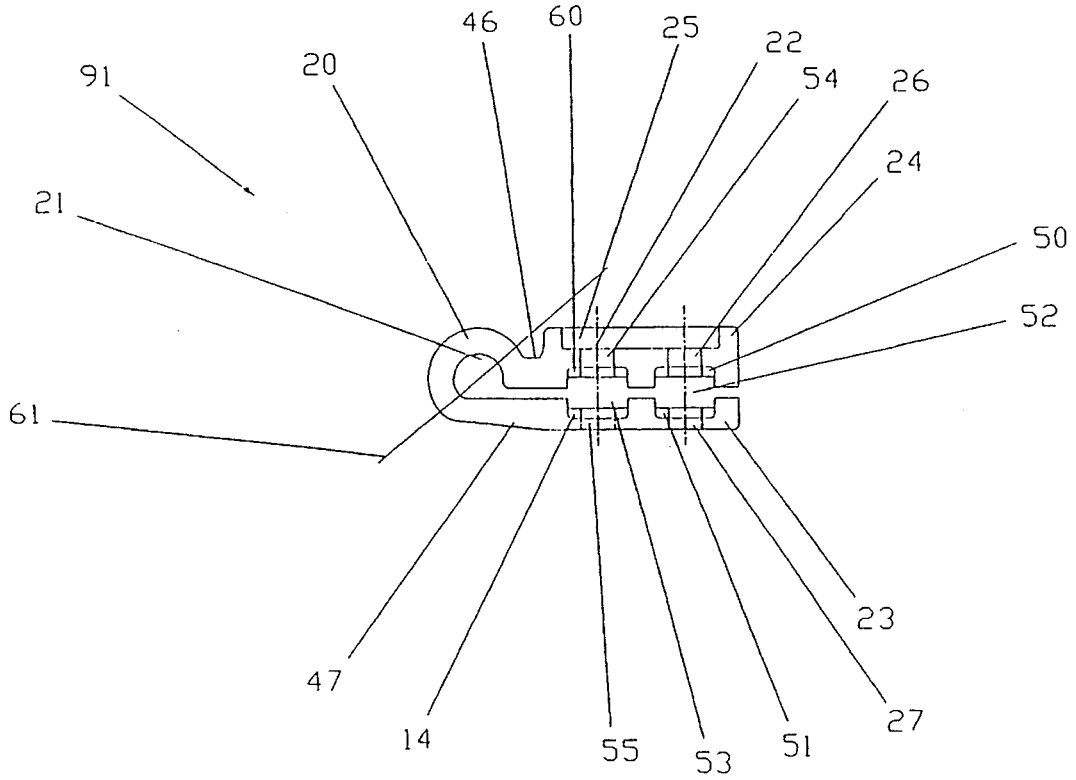
FIG. 44 is a side view of main attachment strap 91 of present invention adjustable "L" side attachment strap 90 that has two notches and two sets of apertures.

Referring now to FIG. 44, this is a variation of main attachment strap 91 of present invention adjustable "L" side attachment strap 90 where main attachment strap 91 has two sets of apertures: 26, 27 and 54, 55. Apertures 26 and 54 are in strap end portion 24 while apertures 27 and 55 are in strap end portion 23. Since there are two sets of apertures, there can be two notches 52 and 53. Groove 60 is in strap end portion 26 above notch 53 and groove 14 is in strap end portion 23 below notch 53. By adding a second set of apertures, 54 and 55, the equipment manager can better position the faceguard 33 to the players liking.

Figure 45:
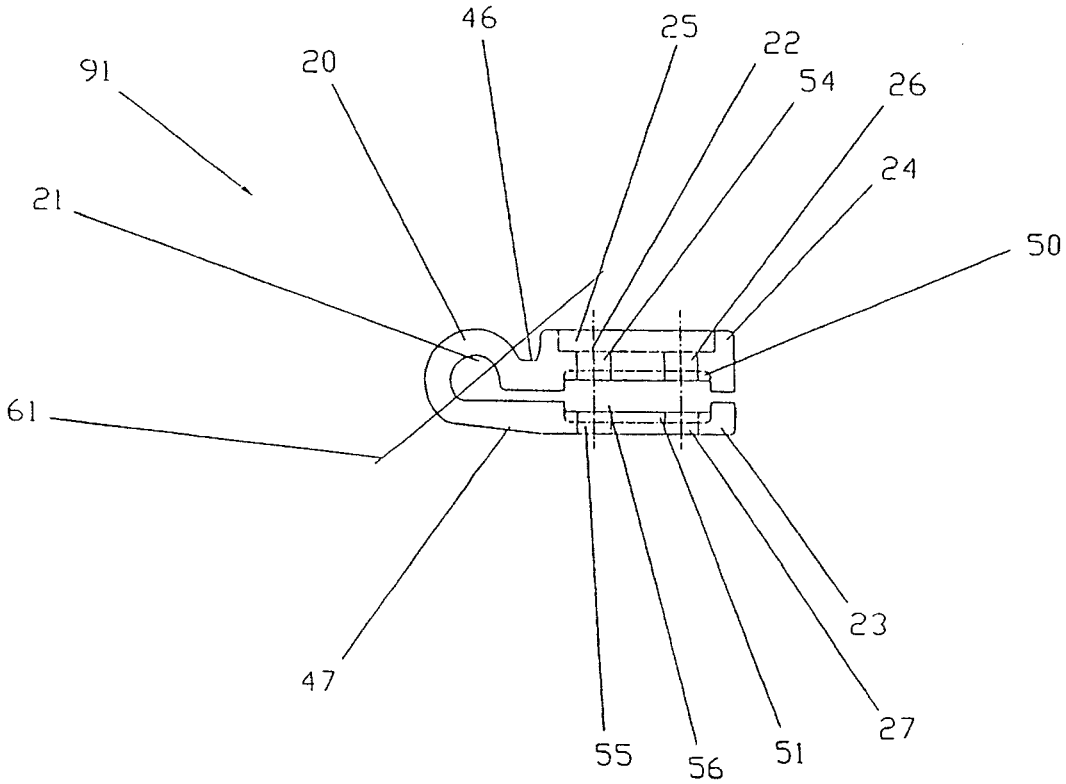
FIG. 45 is a side view of main attachment strap 91 of present invention adjustable "L" side attachment strap 90 that has two sets of apertures and only one large notch.

Referring now to FIG. 45, this is a variation of main attachment strap 91 of present invention adjustable "L" side attachment strap 90 where main attachment strap 91 has two sets of apertures: 26, 27 and 54, 55, but only has one large notch 56.

Figure 46:
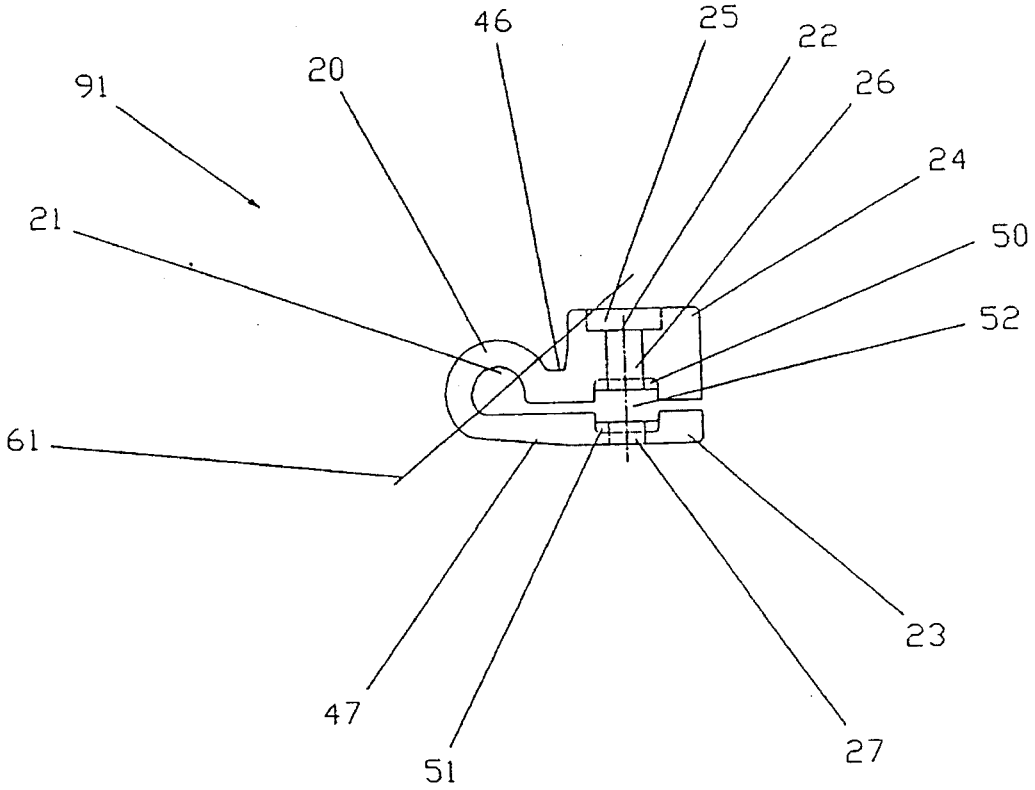
FIG. 46 is a side view of main attachment strap 91 of present invention adjustable "L" side attachment strap 90 where the thickness of the head portion, of strap end 24, is greater in height than loop 20.

Referring now to FIG. 46, this is a variation of main attachment strap 91 of present invention adjustable "L" side attachment strap 90 where the head portion 24 that comprises recess 25 for fastener 36, has increased thickness to provide added strength to the main attachment strap 91. The increased thickness of the head portion 24 makes it higher than loop section 20.

Figure 101:
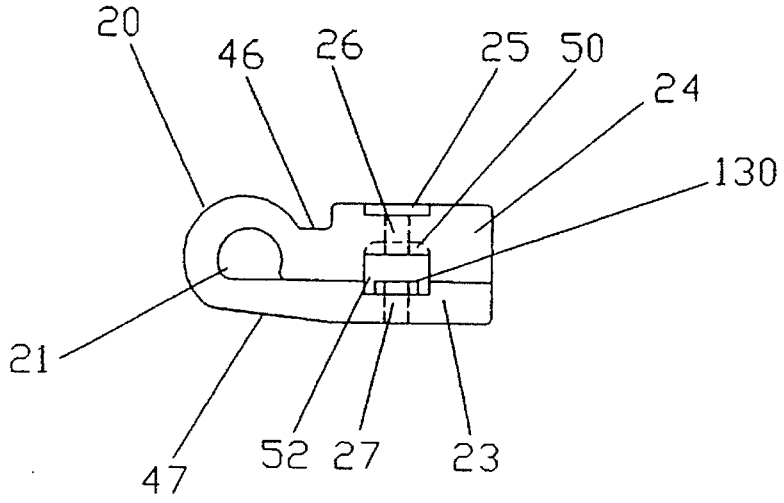
FIG. 101 is a side view of main attachment strap 91 of present invention adjustable "L" side attachment strap 90 that has cylinder 130. Cylinder 130 allows aperture 72 of the retention strap 70 to "snap" onto cylinder 130 of the main attachment strap 91.

Referring now to FIG. 101A, this is a variation of main attachment strap 91 of present invention adjustable "L" side attachment strap 90 that has cylinder 130 added to strap end portion 23, so that the diameter of aperture 27 is equal to the inner diameter of cylinder 130. With the addition of cylinder 130, grooves 51 can be eliminated because the cylinder 130 will keep the retention strap 70 held in place. The variation of retention strap 70 depicted in FIG. 51B, could be used in conjunction with this variation of the main attachment strap 91. The addition of cylinder 130 makes it easier to secure the adjustable "L" side attachment strap 90 to the helmet, because strap end 125 of retention strap 70, FIG. 51B, could "snap" onto this variation of the main attachment strap 91 and both pieces could be put around bar 18 of the rear section 15 of guard 33 as one unit. The outer diameter of cylinder 130 would have approximately the same diameter of aperture 72 of retention strap 70.

Figure 47:
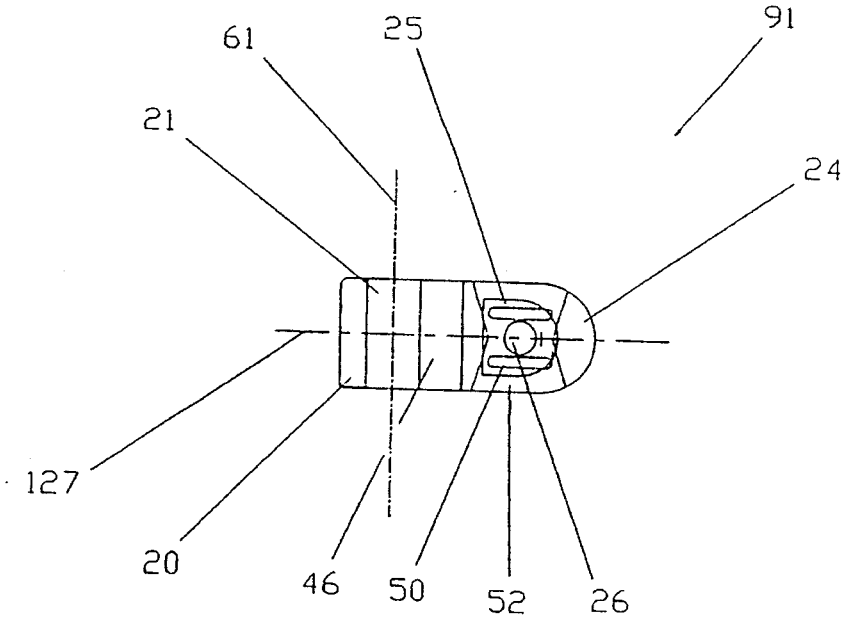
FIG. 47 is a plan view of the main attachment strap 91 of present invention adjustable "L" side attachment strap 90 where the openings of notch 52 are angled out.

Referring now to FIG. 47, this is a variation of the main attachment strap 91 of present invention adjustable "L" side attachment strap 90 where the openings of notch 52, of main attachment strap 91, are angled out. These angled openings allow retention strap 70 to encircle bar 17 of rear section 15 of guard 33 and fit into notch 52 of main attachment strap 91 of faceguards 33 that do not have a 90 degree angle between bars 17 and 18. Regardless of the angle between bars 17 and 18 of the rear section 15 of the guard 33, the angled openings would also allow retention strap 70 to pivot within notch 52 to better fit around bar 17.

Figure 48:
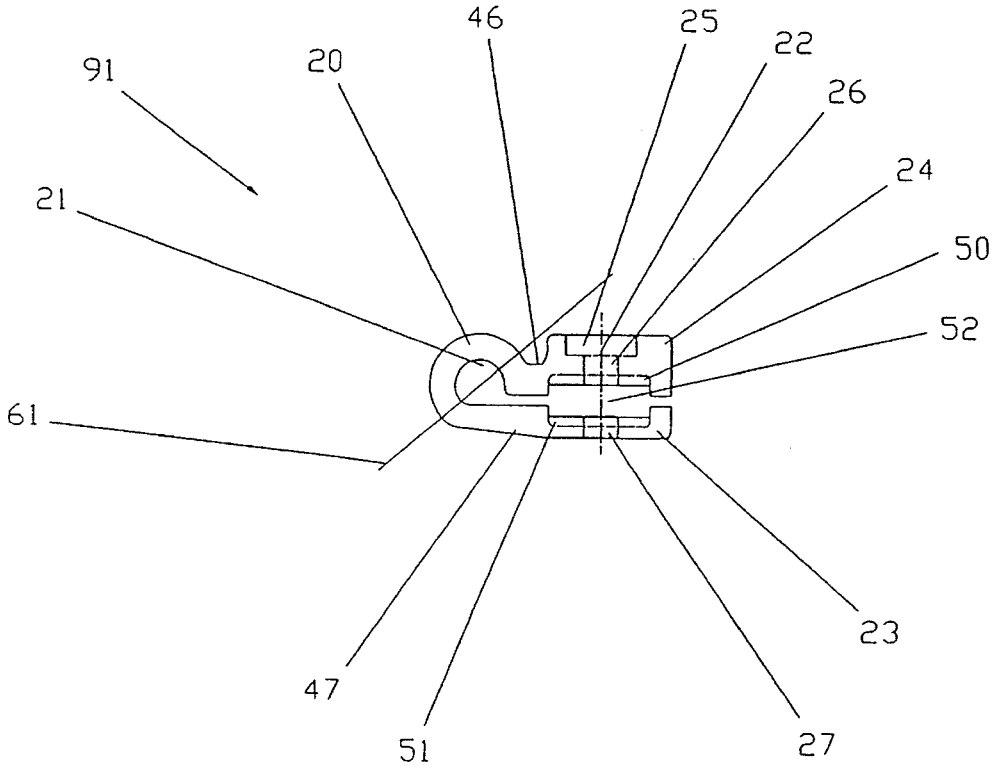
FIG. 48 is a side view of main attachment strap 91 of present invention adjustable "L" side attachment strap 90 where notch 52 is extra wide.

Referring now to FIG. 48, this is a variation of main attachment strap 91 of present invention adjustable "L" side attachment strap 90 where the notch 52 in main attachment strap 91 is extra wide. This extra wide notch 52 allows retention strap 70 to pivot within notch 52 which gives retention strap 70 the ability to move on bar 17 so it can better fit when the faceguard 33 flexes upon contact. This variation can also be used on faceguards that do not have a 90 degree angle between bars 17 and 18 of the rear section 15 of the guard 33.

Figure 49:
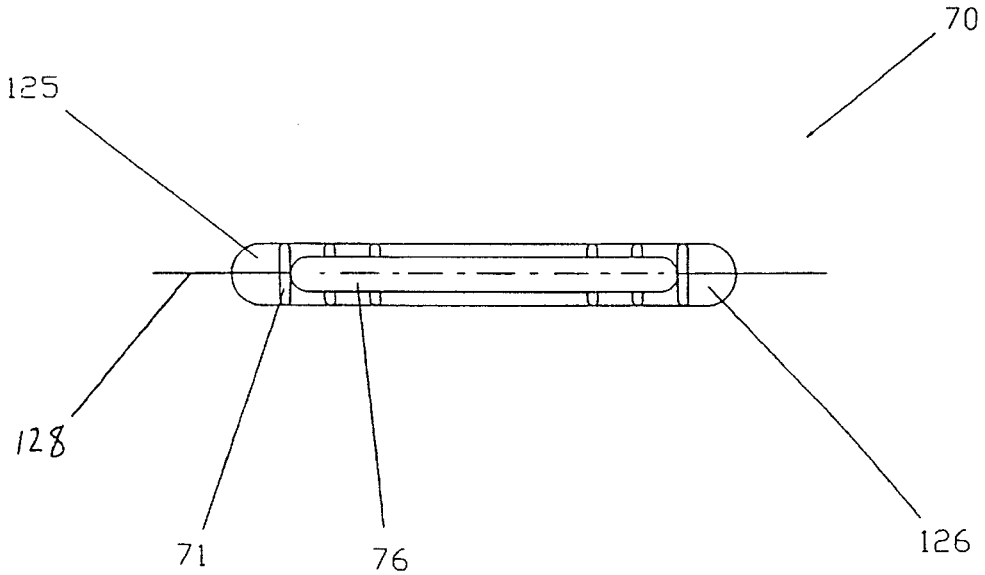
FIG. 49 is a plan view of retention strap 70 of present invention adjustable "L" side attachment strap 90 comprising one slot 76.

Referring now to FIG. 49, this is a variation of retention strap 70 of present invention adjustable "L" side attachment strap 90 where retention strap 70 has one slot 76 extending through retention strap 70. This slot would be used in place of the apertures 72 depicted in FIG. 16. When retention strap 70 is looped around bar 17, the slot 76 will overlap itself and screw 36 will be placed through aperture 26, then through slot 76 doubled over on itself and then into the T-Nut which will be in aperture 27. Thus, securing both the main attachment strap 91 and the retention strap 70 to the helmet.

Figure 50:
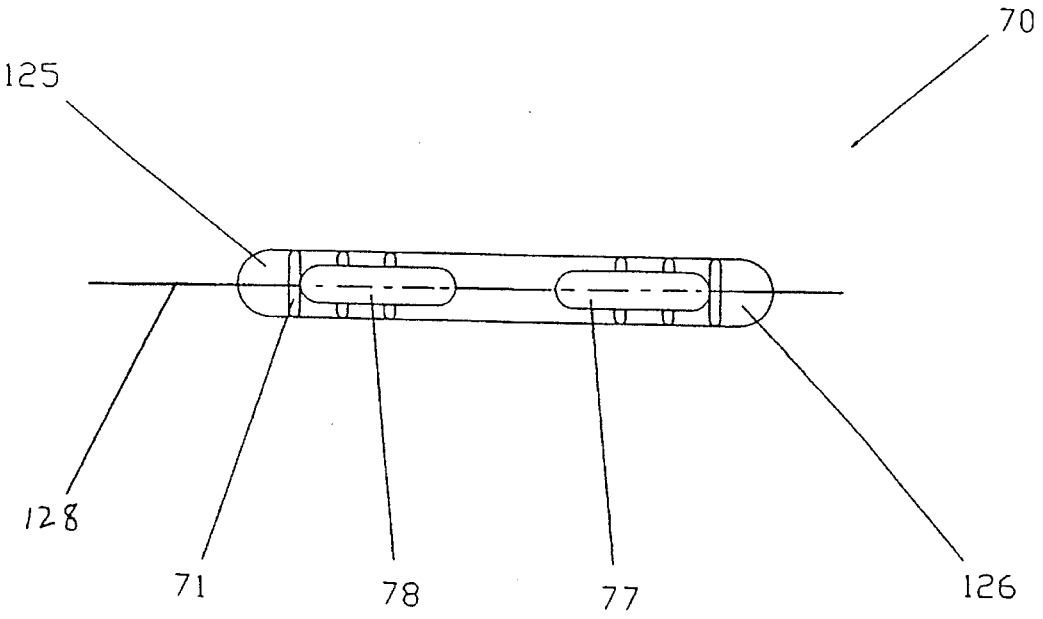
FIG. 50 is a plan view of retention strap 70 of present invention adjustable "L" side attachment strap 90 that has two slots 77 and 78.

Referring now to FIG. 50, this is a variation of retention strap 70 of present invention adjustable "L" side attachment strap 90 where retention strap 70 has two slots 77 and 78. When retention strap 70 is looped around bar 17, slots 77 and 78 will overlap so that screw 36 can be placed through aperture 26 and then through slots 77 and 78 and then into the T-Nut which is in aperture 27.

Figure 51:
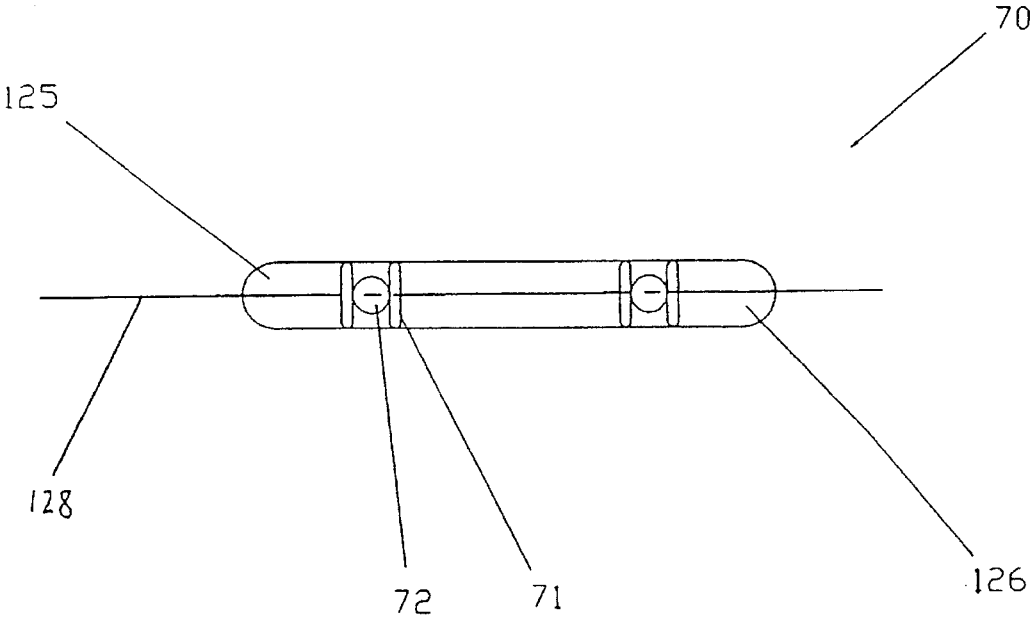
FIG. 51 is a plan view of retention strap 70 of present invention adjustable "L" side attachment strap 90 where there are only two apertures 72.

Referring now to FIG. 51, this is a variation of retention strap 70 of present invention adjustable "L" side attachment strap 90 where retention strap 70 only has two apertures 72. By retention strap 70 only having two apertures 72, there is not any way for the equipment manager to adjust the fit of retention strap 70 around bar 17 of the rear section 15 of the guard 33. Thus, there will be no excess portion of retention strap 70 extending out of notch 52 that would need to be trimmed off by the equipment manager.

Figure 52:
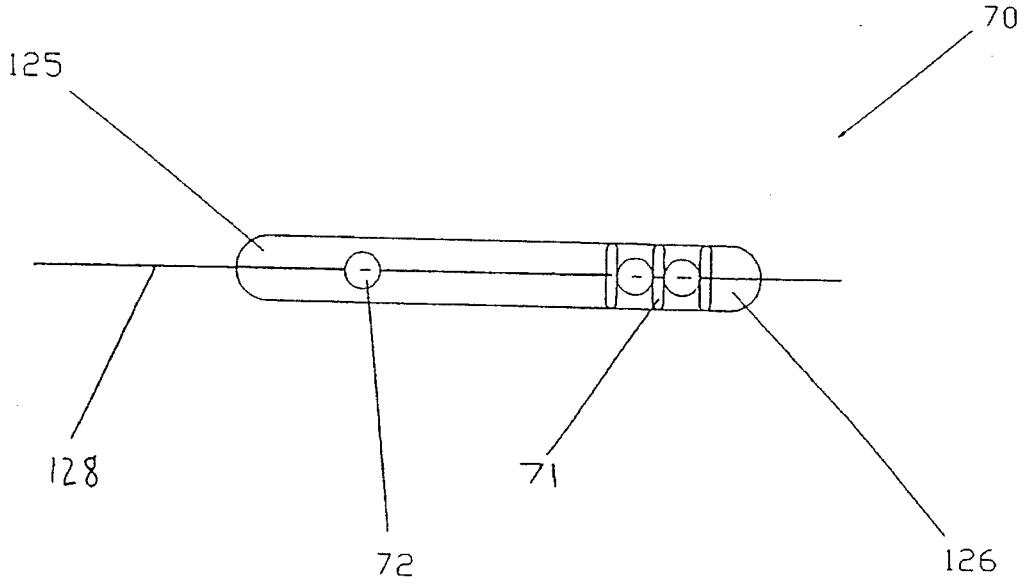
FIG. 52 is a plan view of retention strap 70 of adjustable "L" side attachment strap 90 where strap end 125 has only one aperture 72 and no teeth 71.

Referring now to FIG. 52, this is a variation of retention strap 70 of the present invention adjustable "L" side attachment strap 90 where strap end 125 of retention strap 70 has only 1 aperture 72, while strap end 126 has two apertures 72 and three teeth 71. This allows for only the fit of strap end 126 to be varied.

Figure 53:
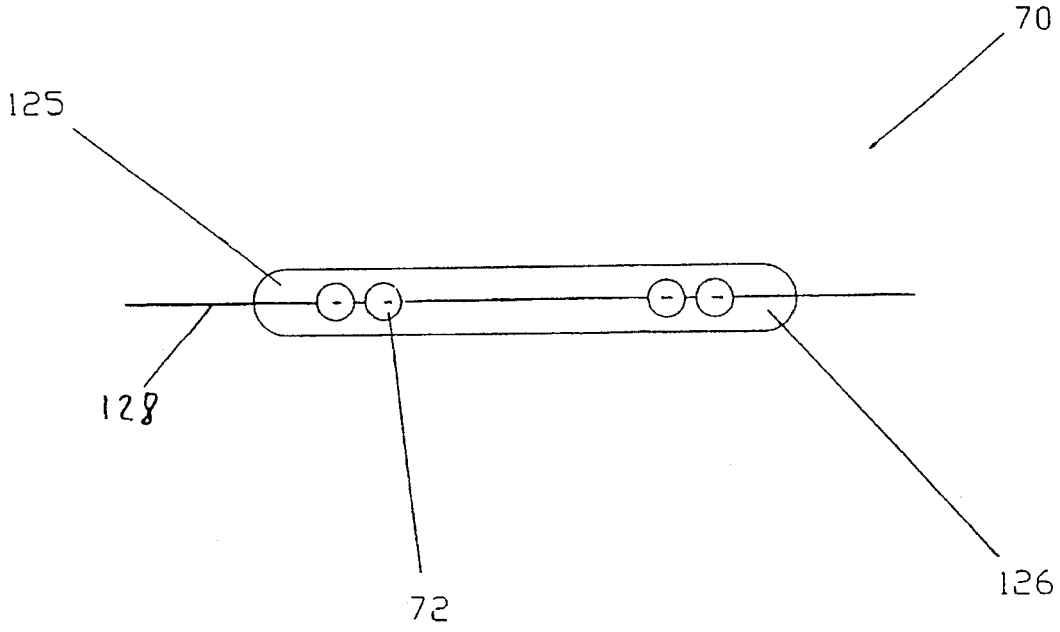
FIG. 53 is a plan view of retention strap 70 of present invention adjustable "L" side attachment strap 90 that has no teeth 71.

Referring now to FIG. 53, this is a variation of retention strap 70 of present invention adjustable "L" side attachment strap 90 where retention strap 70 has no teeth 71 to fit into grooves 50 and 51 of main attachment strap 91.

Figure 54:
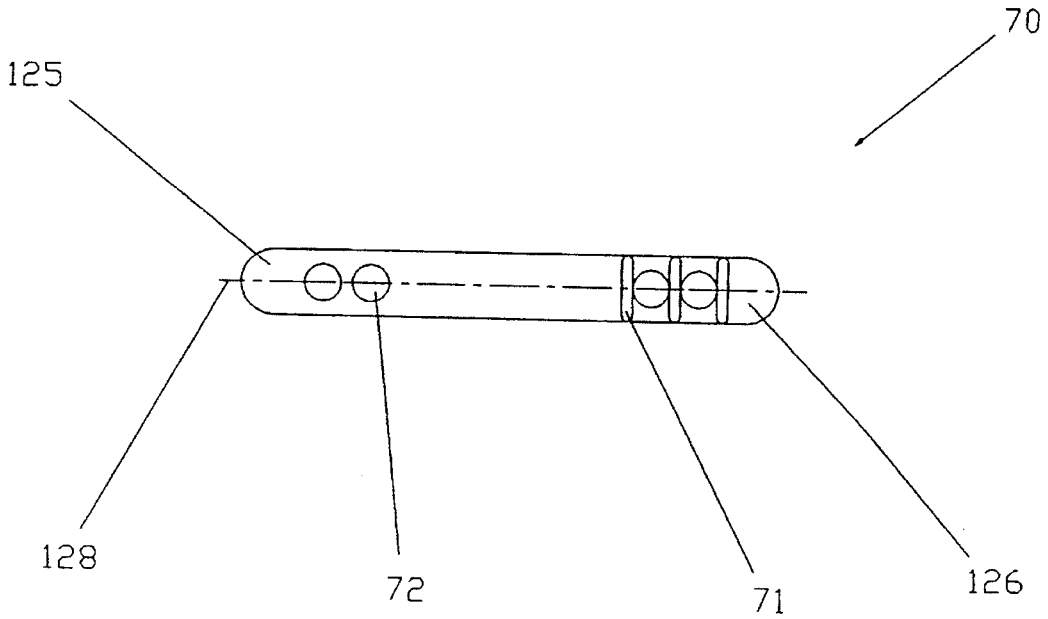
FIG. 54 is a plan view of retention strap 70 of present invention adjustable "L" side attachment strap 90 that has no teeth on strap end 125.

Referring now to FIG. 54, this is a variation of retention strap 70 of present invention adjustable "L" side attachment strap 90 where retention strap 70 has teeth 71 only at strap end 126. The advantage of this is that grooves 51 could be eliminated from strap end 23 of main attachment strap 91. This is advantageous because strap end 23 can be thinner than strap end 24, so if grooves 51 are eliminated from strap end 23, the strength of strap end 23 may be improved.

Figure 55:
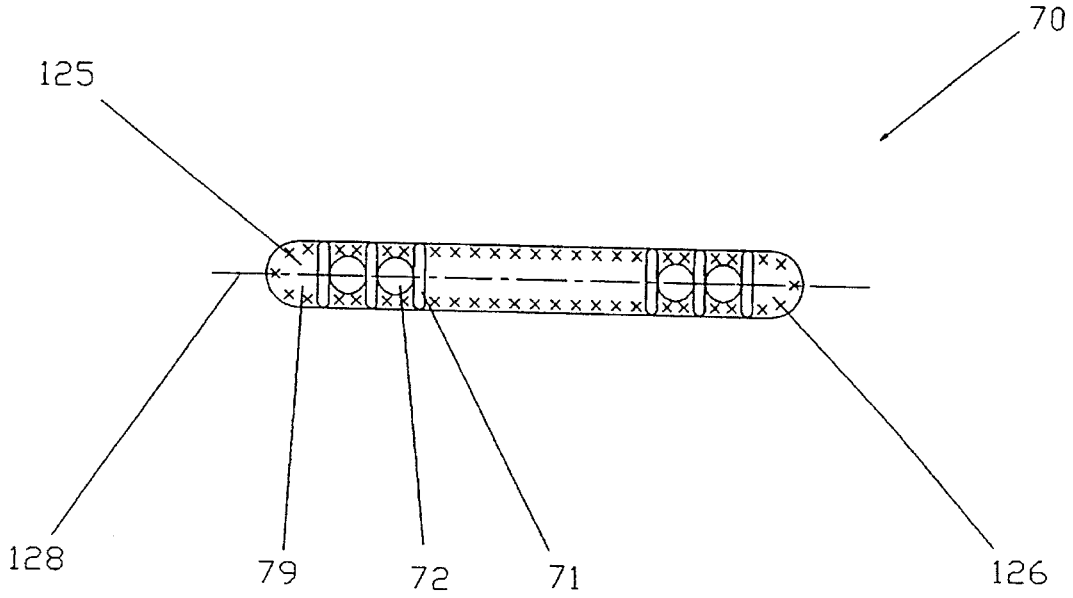
FIG. 55 is a plan view of retention strap 70 of present invention adjustable "L" side attachment strap 90 where retention strap 70 comprises a textured pattern 79.

Referring now to FIG. 55, this is a variation of retention strap 70 of present invention adjustable "L" side attachment strap 90 where retention strap 70 has a textured pattern 79. This textured pattern 79 can cover all of retention strap 70 or just parts of it. Textured pattern 79 can mesh with a corresponding textured pattern that would cover the inside of notch 52 of the main attachment strap 91 or the textured pattern 79 of retention strap 70 could simply "bite" into the smooth surface of notch 52.

Figure 56:
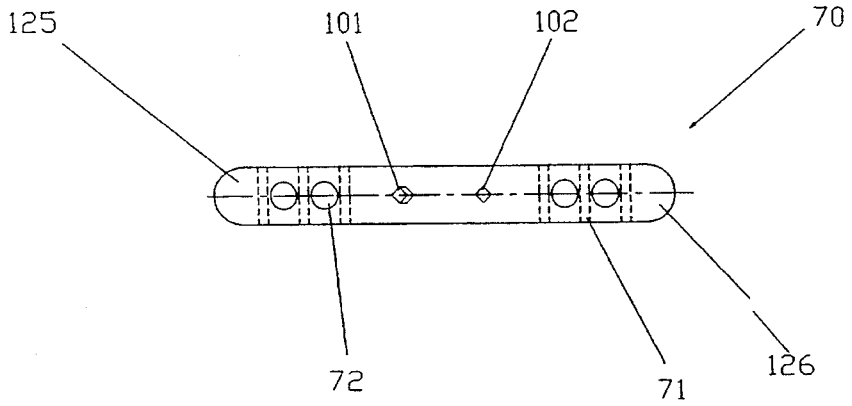
FIG. 56 is a bottom view of retention strap 70 of present invention adjustable "L" side attachment strap 90 that has pin 101 and a corresponding aperture 102 that pin 101 snaps into.
Figure 57:
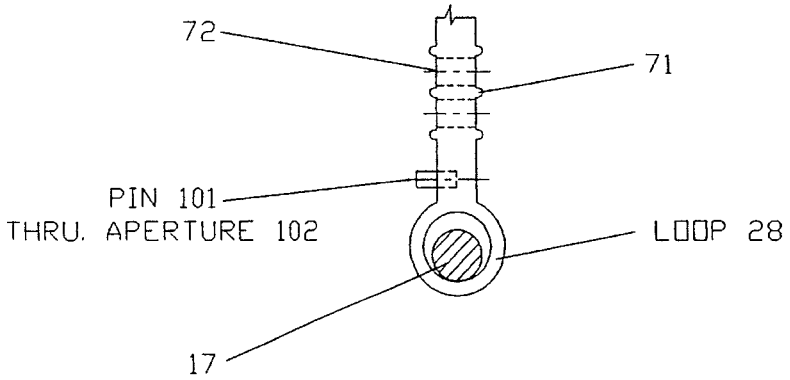
FIG. 57 depicts retention strap 70 of present invention adjustable "L" side attachment strap 90 looped around bar 17, utilizing pin 101.

Referring now to FIG. 56, this is a variation of retention strap 70 of present invention adjustable "L" side attachment strap 90 where retention strap 70 has a pin 101 and a corresponding aperture 102 that pin 101 snaps into. The preferred placement of pin 101 is on the bottom of retention strap 70. The purpose of pin 101 can be seen in FIG. 56. Pin 101 snaps into corresponding aperture 102 so that when retention strap 70 is looped around bar 17 of the rear section 15 of the guard 33, pin 101 can be snapped into the corresponding aperture 102 to insure that retention strap 70 snugly encircles bar 17 of rear section 15 of guard 33. Centerline 128 has been left off of FIG. 55 for clarity.

Figure 58:
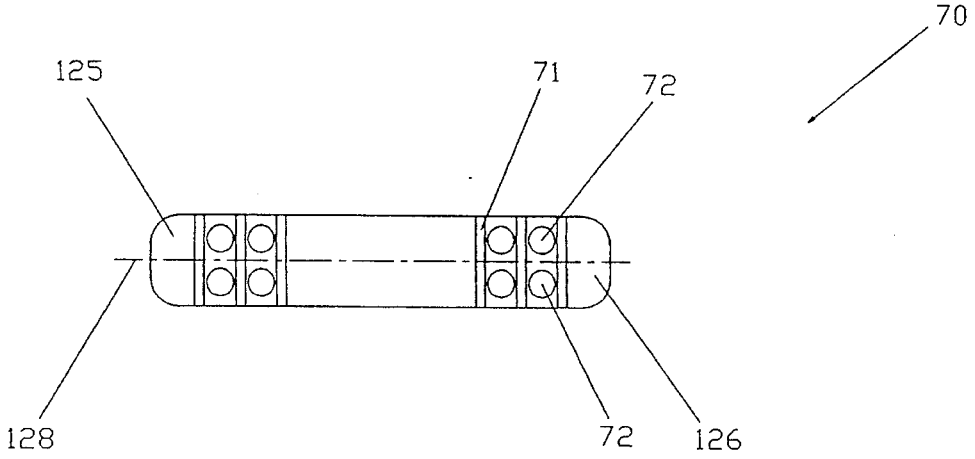
FIG. 58 is a plan view of retention strap 70 of present invention adjustable "L" side attachment strap 90 that has parallel sets of apertures 72.

Referring now to FIG. 58, this is a variation of retention strap 70 of present invention adjustable "L" side attachment strap 90 where retention strap 70 has parallel sets of apertures 72 so that two screws 36 could be used to secure main attachment strap 91 and retention strap 70 to the helmet 31. The variation of main attachment strap 91 depicted in FIG. 45, could be used in conjunction with the variation of retention strap 70 depicted in FIG. 58, because the variation of main attachment strap 91, in FIG. 45 has an extra wide notch 52.

Referring now to FIGS. 23–29, an adjustable "L" side attachment strap with partially attached retention strap 94 according to the present invention is disclosed comprising: two loop sections 20 and 28 (the loop portions can include any shape as long as it is capable of wrapping around a bar or plastic segment), two loop apertures 21 and 29 with longitudinal axes 61 and 62 respectively which run longitudinally through the apertures and run approximately through the center of the apertures, a first strap end portion 23, a second strap end portion 24 (or head portion) a third strap end portion 131, a recess 25 for housing the head of fastener 36, the shoulder 22 of recess 25, an aperture 26 in strap end 24, aperture 27 in strap end 23, notched out region 52 in strap end 24, grooved regions 51 in strap end 24, centerline 132 of primary body 135, partially attached retention strap 75, teeth 71 of partially attached retention strap 75, apertures 72 in partially attached retention strap 75 and centerline 133 of partially attached retention strap 75. Strap end section 23 of primary body 135 and partially attached retention strap 75 share a strap end section.

Figure 29:
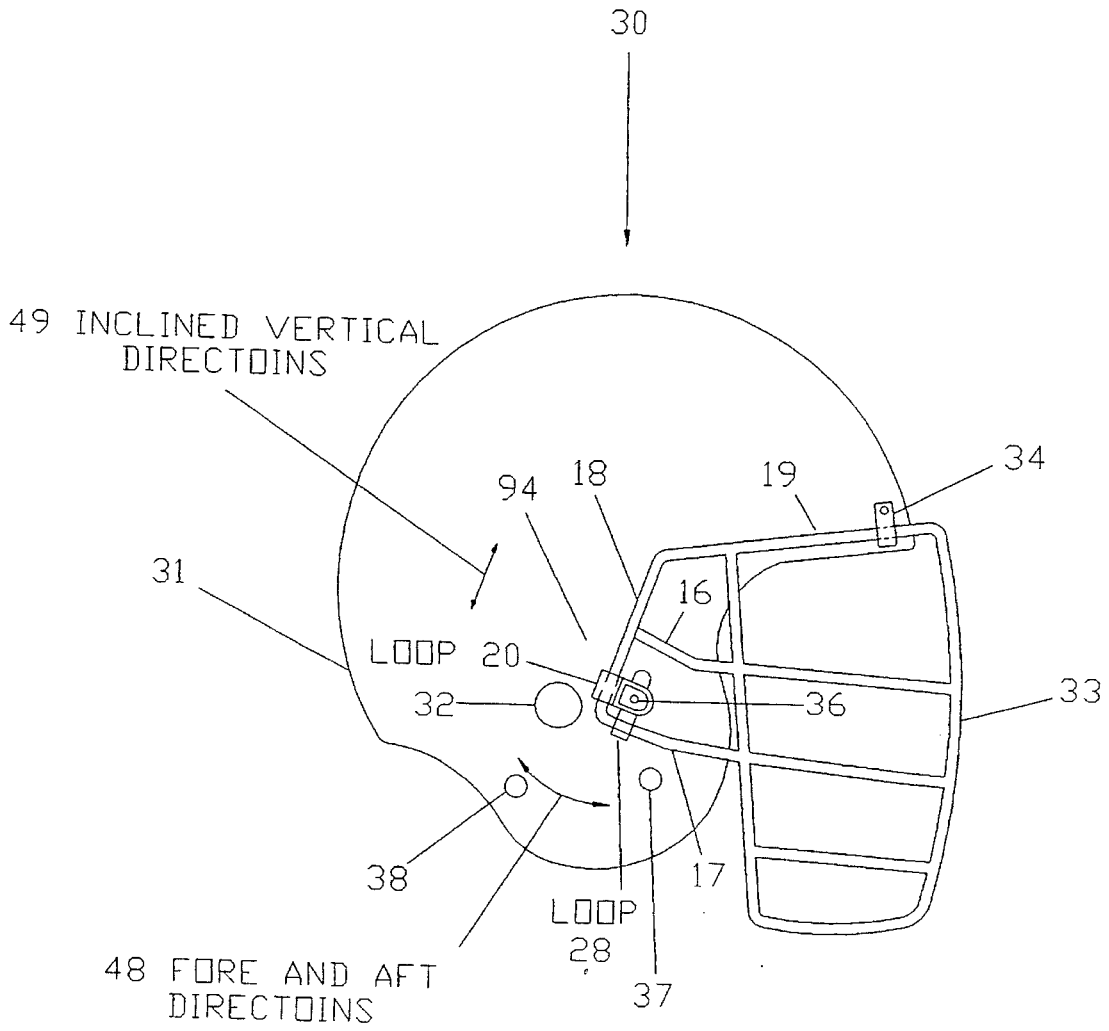
FIG. 29 is a perspective view showing the adjustable "L" side attachment strap with partially attached retention strap 94 mounted to a helmet, totally securing a single wire faceguard to a helmet.

Refer to FIG. 29 and note the elegance of the adjustable "L" side attachment strap with partially attached retention strap 94; loop 20 encircles bar 18 of the rear section 15 of guard 33 and prevents the guard from moving in the arc pattern 48 that is set up as a result of the guard 33 being hinged at the top of the helmet 31 by front attachments 34. The improvement of the adjustable "L" side attachment strap with partially attached retention strap 94 over the prior art side attachment straps 13 is that stemming off of strap end portion 23, at an angle, approximately 90 degrees, is partially attached retention strap 75. This angle can vary depending on what faceguard 33 the adjustable "L" side attachment strap with partially attached retention strap 94 is designed to fit. Partially attached retention strap 75 is then looped around bar 17 of the rear section 15 of guard 33. Retention strap 75 is long enough so that once it is looped around bar 17, the equipment manager can fit it in notch 52 and pull it until it snugly fits around bar 17. Once this has been accomplished, the apertures 72 in partially attached retention strap 75 are aligned with apertures 26 and 27 in strap end portion 24 and 23 respectively. Once the apertures, referred to above, are aligned, teeth 71 in partially attached retention strap 75 mesh with the grooves 50 in strap end portion 24. When all of this is accomplished, a single T-Nut and single screw 36 can secure the adjustable "L" side attachment strap with partially attached retention strap 94 to a helmet 31. When mounted on a helmet 31 these two straps become a unitary attachment means.

Loop 28, of adjustable "L" side attachment strap with partially attached retention strap 94, is formed by looping partially attached retention strap 75 around bar 17 of the rear section 15 of the guard 33. When loop 28, of adjustable "L" side attachment strap with partially attached retention strap 94 encircles bar 17 of the rear section 15 of faceguard 33, bar 18 of guard 33 is restricted from getting moved in the inclined vertical direction 49 through loop 20. The improvement of this invention consists in simultaneously positively restricting movement in the inclined vertical direction—ie. friction plays a negligible role in preventing movement in the inclined vertical direction. Thus, solving and eliminating the above stated problems of the prior art. Referring to FIG. 29, note that each loop of the present invention adjustable "L" side attachment strap with partially attached retention strap 94 will be put in tension when the guard 33 encounters a downwardly angled frontal blow.

By securing both sides of a faceguard 33 to a helmet 31 with the present invention adjustable "L" side attachment strap with partially attached retention strap 94, the user of a helmet system 30 would have a faceguard 33 that is totally secured to his helmet and not have to worry about bar 17 of the rear section 15 of the guard 33 moving down over the chin strap buckle or guard 33 rattling or moving around during play.

Figure 24:
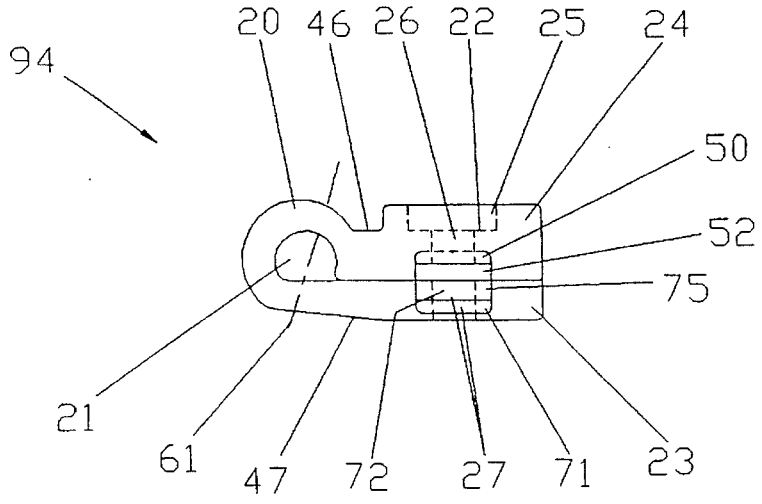
FIG. 24 is a side view of adjustable "L" side attachment strap with partially attached retention strap 94.
Figure 25:
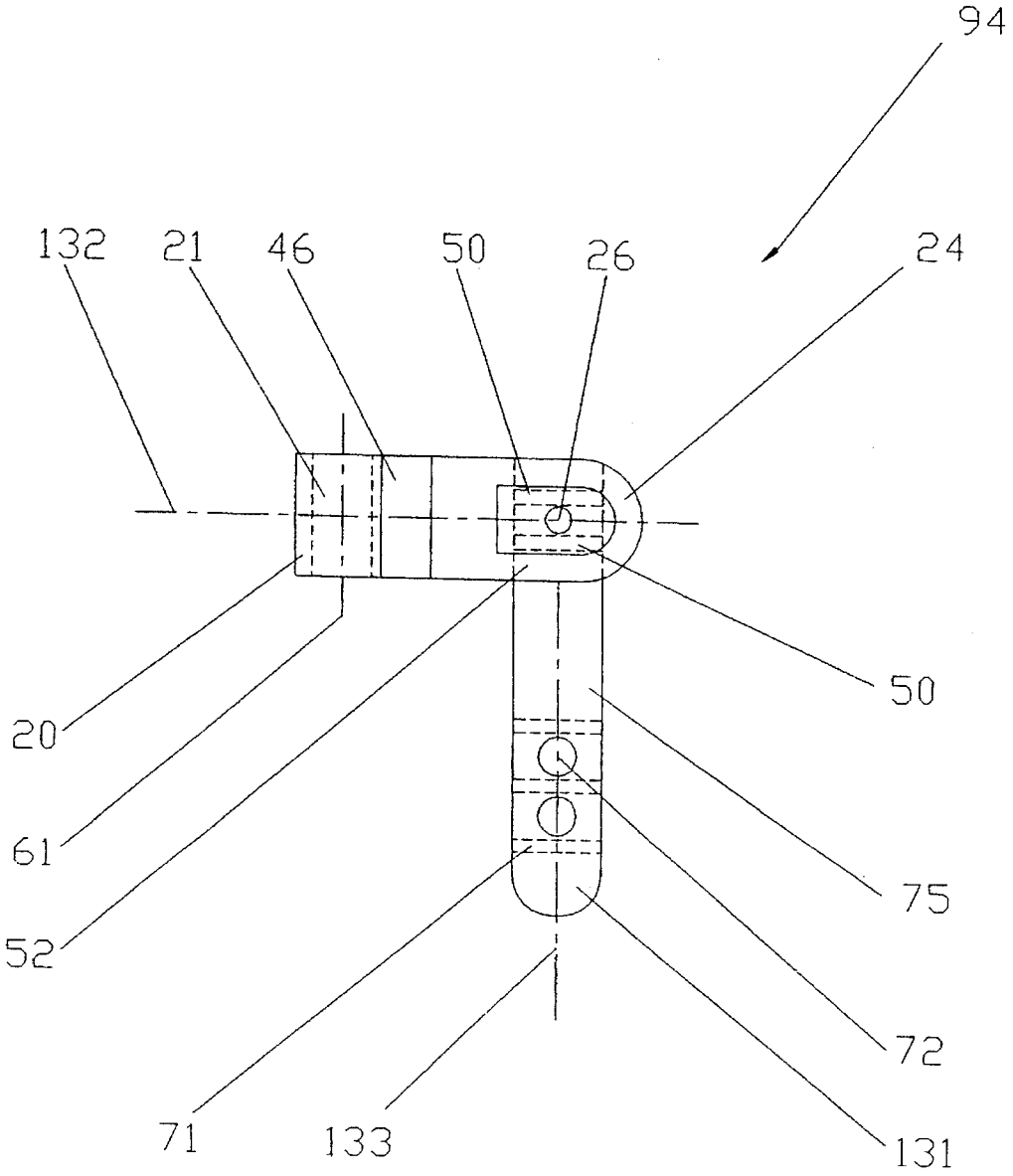
FIG. 25 is a plan view of adjustable "L" side attachment strap with partially attached retention strap 94.
Figure 26:
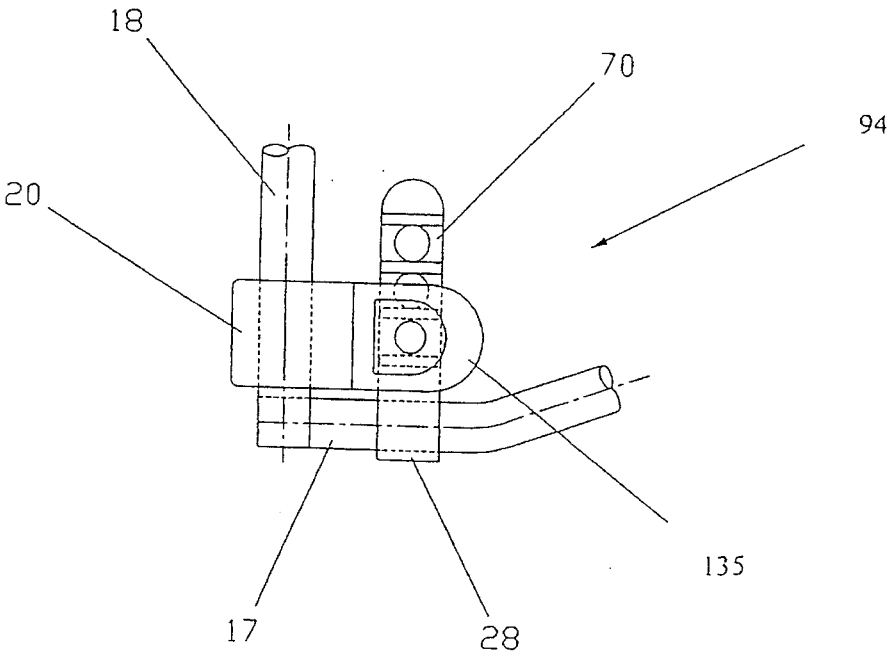
FIG. 26 is a side view of adjustable "L" side attachment strap with partially attached retention strap 94 encircling bars 17 and 18 of the rear section of the faceguard.
Figure 27:
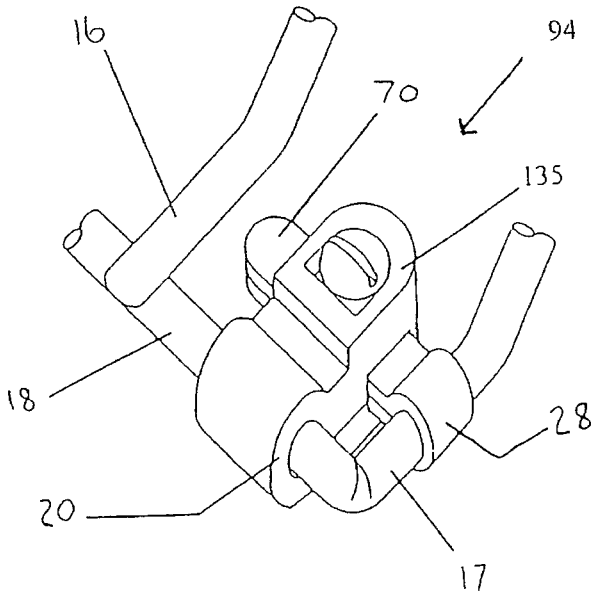
FIG. 27 is an isometric view of adjustable "L" side attachment strap with partially attached retention strap 94 encircling bars 17 and 18 of the rear section of the guard.
Figure 28:
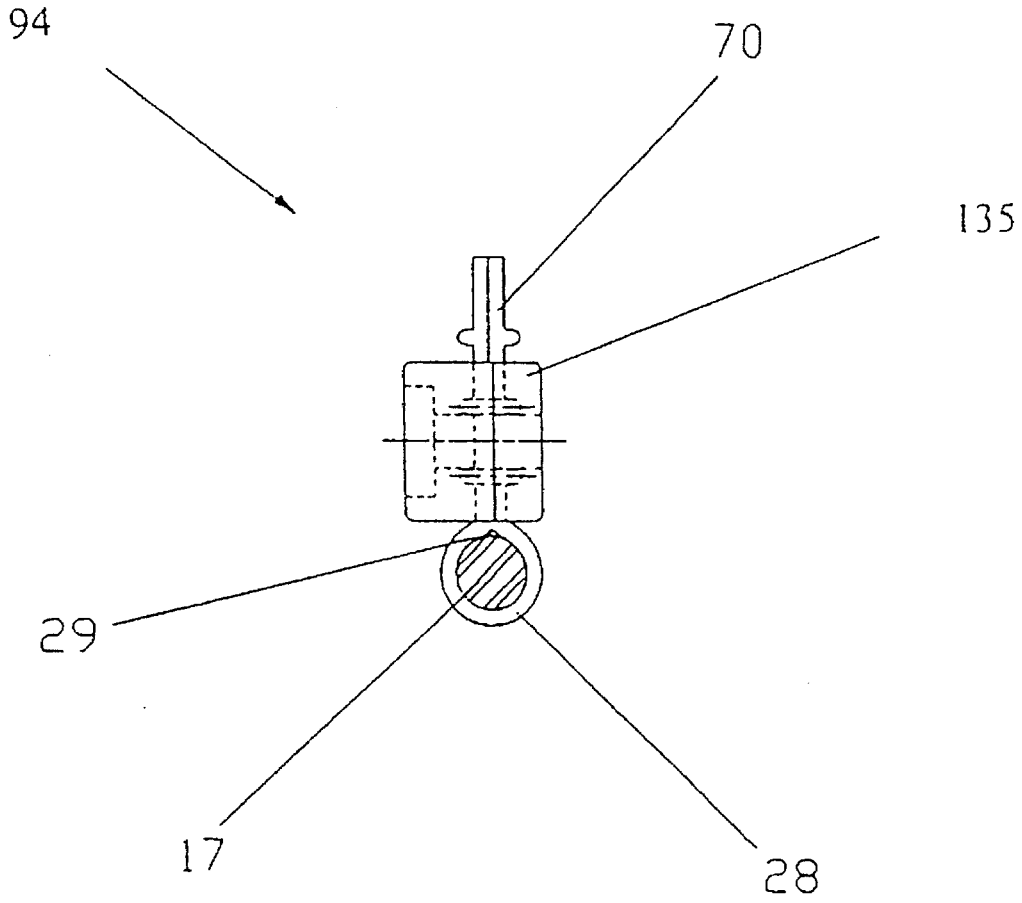
FIG. 28 is a front view of adjustable "L" side attachment strap with partially attached retention strap 94 encircling bar 17 of the rear section of the guard.

FIG. 24 is a side view of the present invention adjustable "L" side attachment strap with partially attached retention strap 94. The inner radius of loop aperture 21 can range from approximately 1.00 to 0.05 inches and the outer radius of loop aperture 21 can vary between approximately 1.15 and 0.15 inches respectively, the total length of the primary body 135 can vary between approximately 0.50 and 4.0 inches, the length of partially attached retention 75 can range from approximately, 0.20 to 6.0 inches; the width of partially attached retention strap 75 can vary from approximately, 0.10 to 3.0 inches; the teeth 71 can vary in width from approximately, 0.015 to 0.50 inches; the teeth 71 can vary in depth from approximately, 0.15 to 0.50 inches and the diameter of the apertures 72 can vary from approximately, 0.10 to 1.00 inches. The suggested dimensions of the adjustable "L" side attachment strap with partially attached retention strap 75 are as follows: total length of primary body 135, 1.50 inches; width of loop section 20, 0.625 inches; inner radius of loop aperture 21, 0.156 inches; outer radius of loop aperture 21, 0.312 inches; depth of recess 25, 0.125 inches; width of recess 25, 0.44 inches; diameter of aperture 26, 0.212 inches; diameter of aperture 27, 0.212 inches; height of loop section 20, 0.625 inches; thickness of strap end 24, 0.365 inches; thickness of strap end 23, 0.20 inches; width of notch 52, 0.380 inches; height of notch 52 0.060 inches; depth of grooves 50, 0.062 inches; length of grooves 50, 0.380 inches; depth of neck portion 46, 0.125 inches, angle of taper 47 is 6 degrees, total length of partially attached retention strap 75, 3.0 inches; width of partially attached retention strap 75, 0.375 inches; thickness of partially attached retention strap 75 0.062 inches; diameter of apertures 72, 0.212 inches; height of teeth 71, 0.062 inches; width of teeth 71, 0.062 inches; length of teeth 71, 0.375 inches; distance between teeth 71 of strap end 131, 0.276 inches; distance between apertures 72 of strap end 131, 0.276 inches and distance between center of apertures 72 and center of teeth 71 of strap end 131, 0.138 inches. The number of teeth 71 and apertures 72 as well as the relationship of the teeth 71 to the apertures 72, can vary depending on the desired fit that is trying to be achieved. Obviously, these dimensions can be varied in order that the adjustable "L" side attachment strap with partially attached retention strap 94 can fit faceguards without standard dimensions of guards that are comprised of plastic bars. The dimensions can also be varied so that the adjustable "L" side attachment strap with partially attached retention strap 94 can fit faceguards that have a "thick" coating around the bars of the faceguard such as the Schutt ArmorGuard faceguard.

Figure 59:
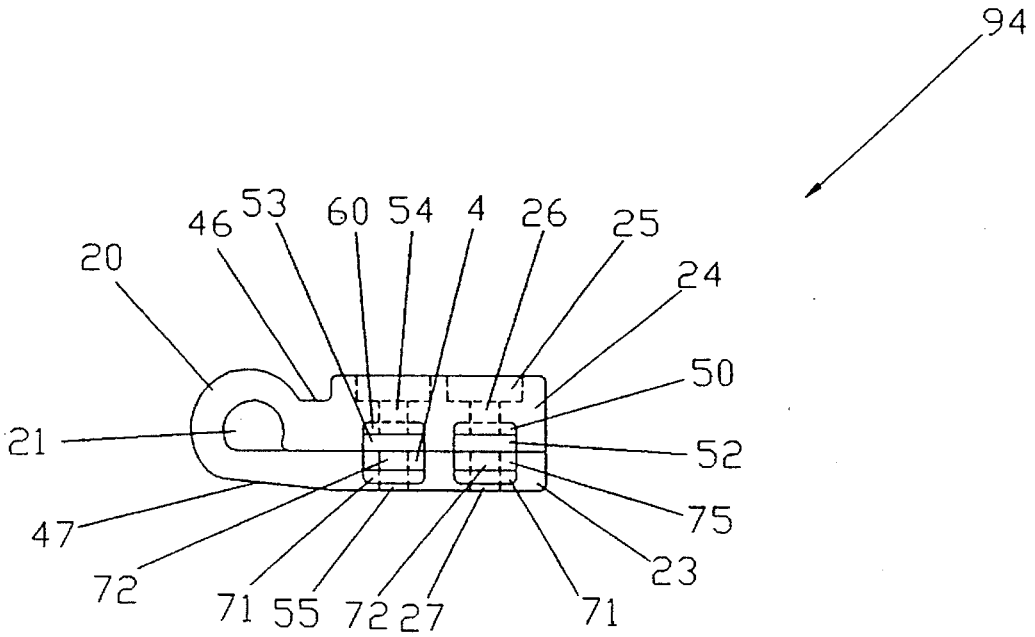
FIG. 59 is a side view of present invention adjustable "L" side attachment strap with partially attached retention strap 94 that has two sets of apertures, two partially attached retention straps and two notches.

Referring now to FIG. 59, this is a variation of present invention adjustable "L" side attachment strap with partially attached retention strap 94 that has two sets of apertures: 26, 27 and 54, 55. Apertures 26 and 54 are in strap end portion 24 while apertures 27 and 55 for the T-Nut are in strap end portion 23. Since there are two sets of apertures there can be two notches 52 and 53, two partially attached retention straps 75 and 4, two sets of grooves 50 and 60 in strap end 24 for teeth 71 of partially attached retention straps 75 and 4. Each retention strap 75 and 4 has teeth 71, apertures 72, where grooves 50 and 60 in strap end 24 will accommodate the teeth 71 of retention strap 75 and 4 respectively. By adding a second set of apertures 54 and 55, the equipment manager can better position the faceguard 33 to the players' liking.

Figure 60:
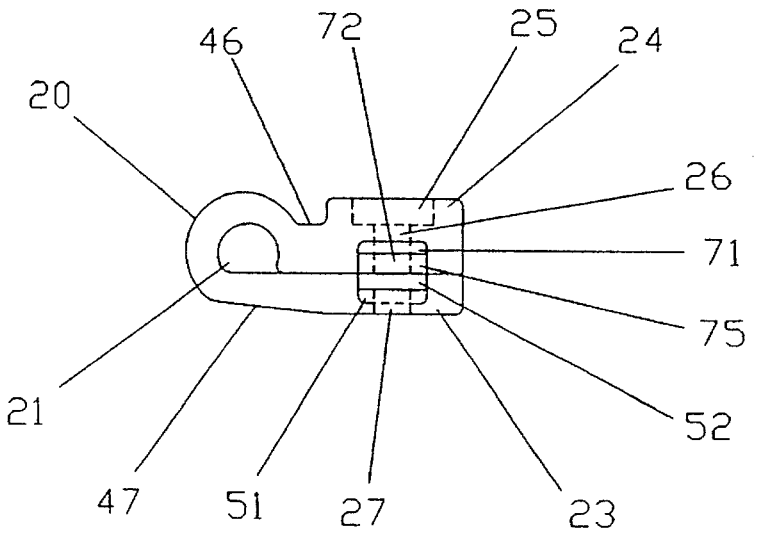
FIG. 60 is a side view of adjustable "L" side attachment strap with partially attached retention strap 94 that has partially attached retention strap 75 stemming off of strap end portion 24.

Referring now to FIG. 60, this is a variation of present invention adjustable "L" side attachment strap with partially attached retention strap 94 that has partially attached retention strap 75 stemming off of strap end portion 24. Strap end portion 23 now comprises notch 52 that partially attached retention strap 75 would fit into. Strap end portion 23 would now have grooves 51 for the teeth 71 of partially attached retention strap 75 to fit into.

Figure 61:
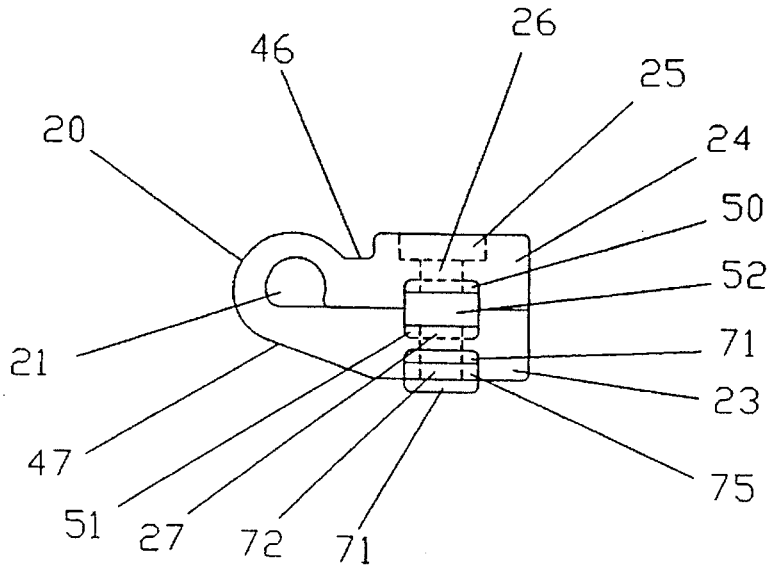
FIG. 61 is a side view of adjustable "L" side attachment strap with partially attached retention strap 94 that has partially attached retention strap 75 stemming off of the lower part of strap end 23.

Referring now to FIG. 61, this is a variation of the present invention adjustable "L" side attachment strap with partially attached retention strap 94 that has partially attached retention strap 75 extending from the lower part of strap end 23 so that notch 52 may be in both strap ends 23 and 24. There are teeth 71 on both sides of partially attached retention strap 75; therefore, notch 52 will have grooves 50 in strap end 24 and grooves 51 in strap end portion 23 for teeth 71 to fit in.

Figure 62:
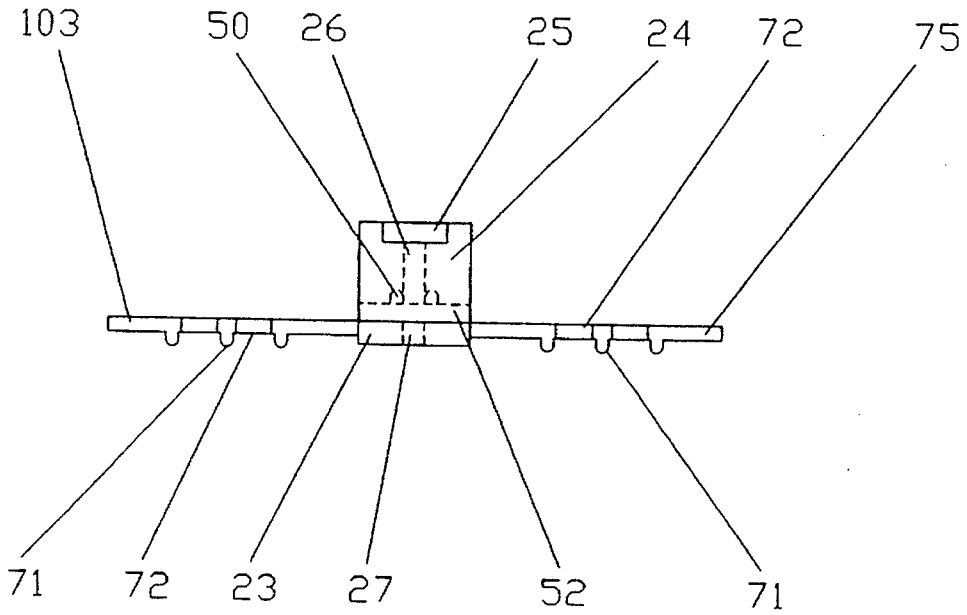
FIG. 62 is a front view of adjustable "L" side attachment strap with partially attached retention strap 94 that has a partially attached retention strap stemming off of both sides of strap end 23.

Referring now to FIG. 62, this is a variation of present invention adjustable "L" side attachment strap with partially attached retention strap 94 that has partially attached retention strap 75 and partially attached retention strap 103 stemming off the sides of strap end 23. Having a partially attached retention strap, 75 and 103, on each side, makes this variation symmetric, allowing for one piece to be used on either side of the helmet. The equipment manager could simply cut the partially attached retention strap off that was not being used to encircle bar 17 of rear section 15 of guard 33.

Figure 63:
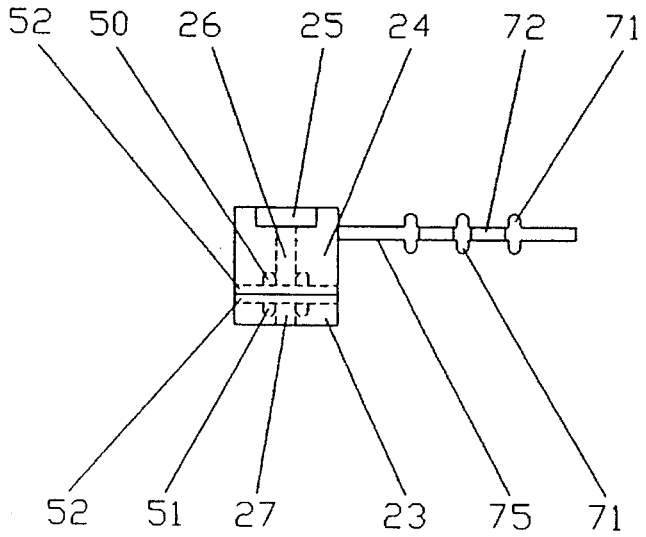
FIG. 63 is a front view of adjustable "L" side attachment strap with partially attached retention strap 94 that has partially attached retention strap 75 stemming from strap end 24.

Referring now to FIG. 63, this is a variation of the present invention adjustable "L" side attachment strap with partially attached retention strap 94 that has partially attached retention strap 75 extending from strap end 24 such that notch 52 may be in both strap ends 23 and 24. There are teeth 71 on both sides of partially attached retention strap 75; therefore, notch 52 will have grooves 50 in strap end 24 and grooves 51 in strap end 23 for teeth 71 to fit in.

Figure 64:
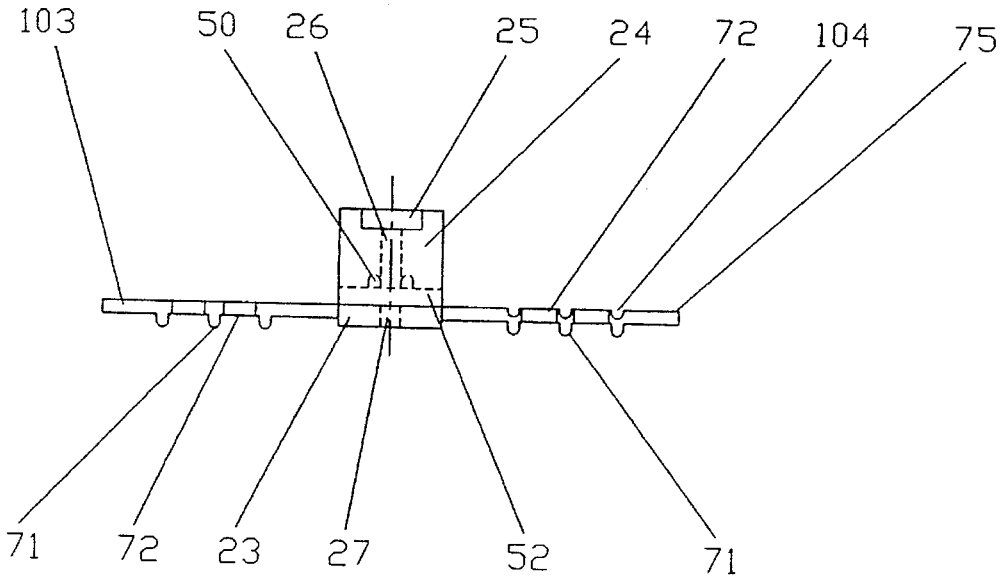
FIG. 64 is a front view of adjustable "L" side attachment strap with partially attached retention strap 94 that has a partially attached retention strap stemming off of both sides of strap end 23 such that both retention straps may encircle bars, of the faceguard, and fit in notch 52.

Referring now to FIG. 64, this is a variation of the present invention adjustable "L" side attachment strap with partially attached retention strap 94 that has partially attached retention strap 75 and partially attached retention strap 103 stemming off of each side of strap end 23, there is also a large notch 52 that will allow partially attached retention strap 75 to encircle bar 17 and partially attached retention strap 103 to encircle bar 16 of rear section 15 of guard 33, or vice versa. Partially attached retention strap 75 has grooves 104 in it to accommodate teeth 71 of partially attached retention strap 103. Therefore, partially attached retention strap 103 must encircle either bar 16 or 17 then be placed in notch 52, partially attached retention strap 75 will encircle the bar, 16 or 17, that partially attached retention strap 103 does not encircle. Partially attached retention strap 75 will then be placed in notch 52 on top of partially attached retention strap 103 so that strap 103's teeth 71 will fit into grooves 104 in partially attached retention strap 75 and teeth 71 of partially attached retention strap 75 will fit into grooves 50 in strap end portion 24.

Figure 65:
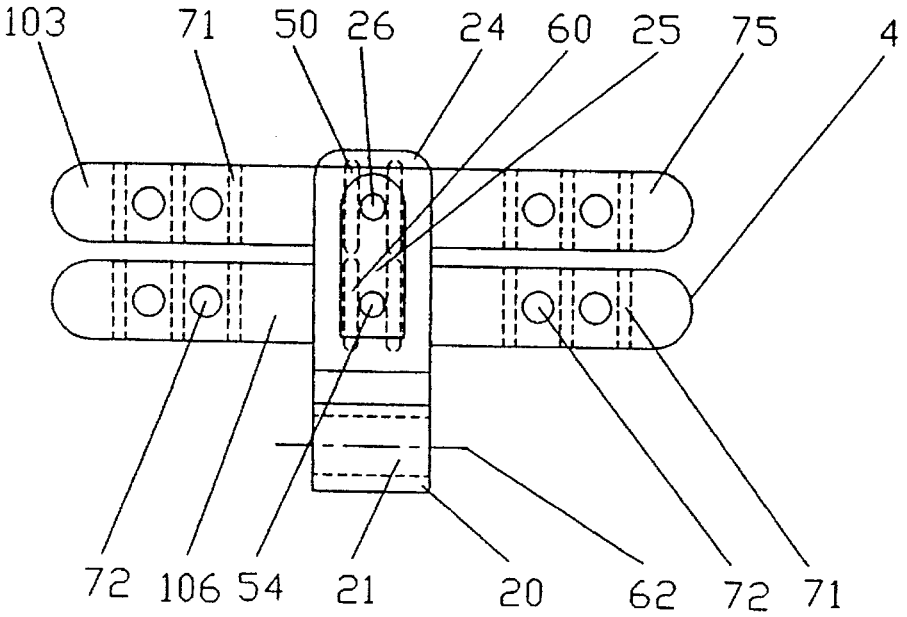
FIG. 65 is a plan view of adjustable "L" side attachment strap with partially attached retention strap 94 that has two sets of apertures, and two partially attached retention straps stemming off of each side of strap end 23.

Referring now to FIG. 65 this is a variation of present invention adjustable "L" side attachment strap with partially attached retention strap 94 that has two sets of apertures 26, 27 and 54, 55. Therefore, for the piece to be symmetric, so it could be used on either side of the helmet, there must be four partially attached retention straps: 75, 4, 103 and 106. Each partially attached retention strap has teeth 71 and apertures 72. Apertures 26 and 27 can be used to secure this variation to the helmet 31, or apertures 54 and 55 can be used, or both sets of apertures, 26, 27 and 54, 55, can be used to secure this variation to the helmet 31. If all four apertures were used, another hole could possibly have to be drilled into the helmet.

Figure 66:
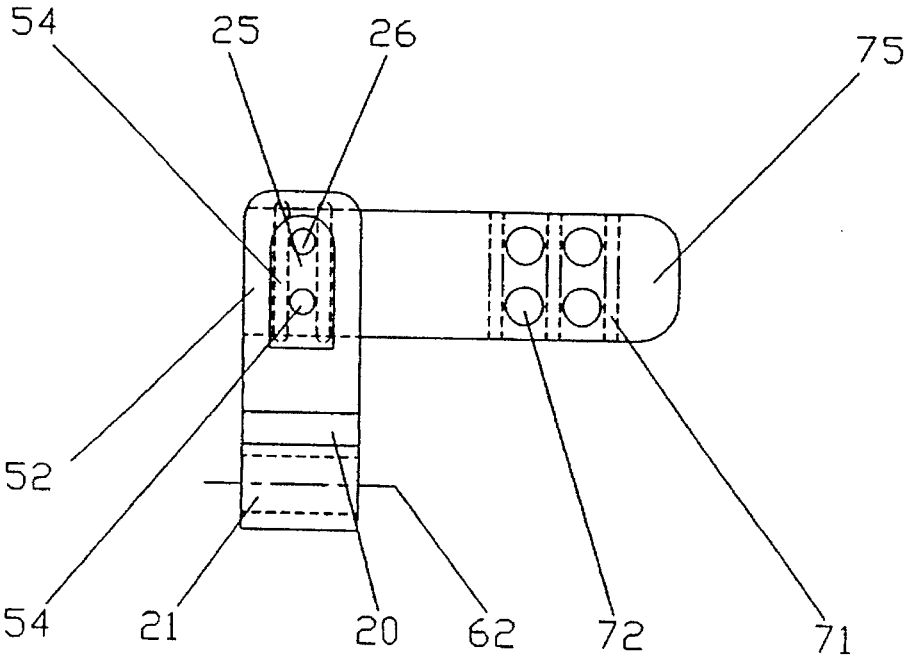
FIG. 66 is a plan view of adjustable "L" side attachment strap with partially attached retention strap 94 where partially attached retention strap 75 is wide enough to accommodate sets of parallel apertures.

Referring now to FIG. 66, this is a variation of the present invention adjustable "L" side attachment strap with partially attached retention strap 94 where partially attached retention strap 75 is wide enough to accommodate sets of parallel apertures 72 so that two screws 36 could be used to secure adjustable "L" side attachment strap with partially attached retention strap 94 to the helmet 31 through apertures 26, 27 and 72 and through 54, 55 and 72. This variation of the adjustable "L" side attachment strap with partially attached retention strap 94 can be better secured to the helmet using two screws 36 rather than just one screw 36. Notch 52 would have to be wider, like notch 56 in FIG. 45, to accommodate the wider partially attached retention strap 75 that has sets of parallel apertures 72.

Figure 67:
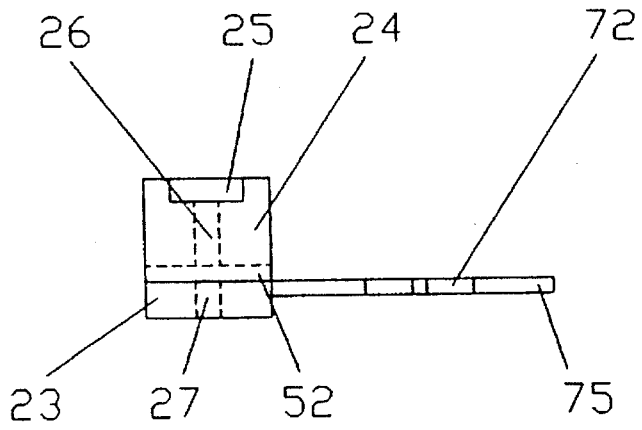
FIG. 67 is a front view of adjustable "L" side attachment strap with partially attached retention strap 94 where partially attached retention strap 75 has no teeth.

Referring now to FIG. 67, this is a variation of present invention adjustable "L" side attachment strap with partially attached retention strap 94 where partially attached retention strap 75 has no teeth 71 and strap end portion 24 has no grooves 50.

Figure 68:
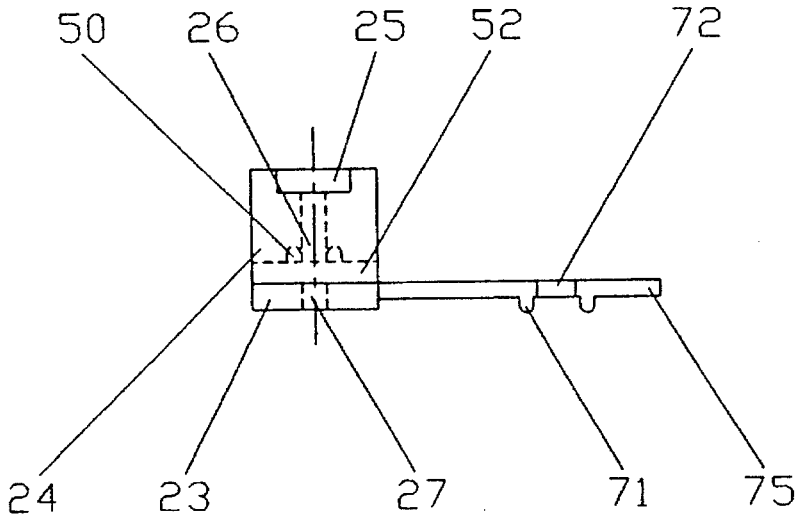
FIG. 68 is a front view of adjustable "L" side attachment strap with partially attached retention strap 94 where partially attached retention strap 75 has only one aperture and two teeth.

Referring now to FIG. 68, this is a variation of the present invention adjustable "L" side attachment strap with partially attached retention strap 94 where partially attached retention strap 75 only has one aperture 72 and two teeth 71. By partially attached retention strap 75 only having one aperture 72, the equipment manager has no control over how big or how small loop 28 is that is created by looping partially attached retention strap 75 around bar 17.

Referring now to FIGS. 72–75, an "L" side attachment strap with fully attached retention strap 35 according to the present invention is disclosed comprising two loop sections 20 and 28 (the loop portions can include any shape as long as it is capable of wrapping around a bar or plastic segment), two loop apertures 21 and 29 with longitudinal axes 61 and 62 which run longitudinally through the apertures and run approximately through the center of the apertures, a first strap end portion 23, a second strap end portion 24 (or head portion), a recess 25 for housing the head of the fastener 36, the shoulder of the recess 22, an aperture 26 in strap end 24 and a slightly larger angled aperture 27 in strap end 23.

Figure 74:
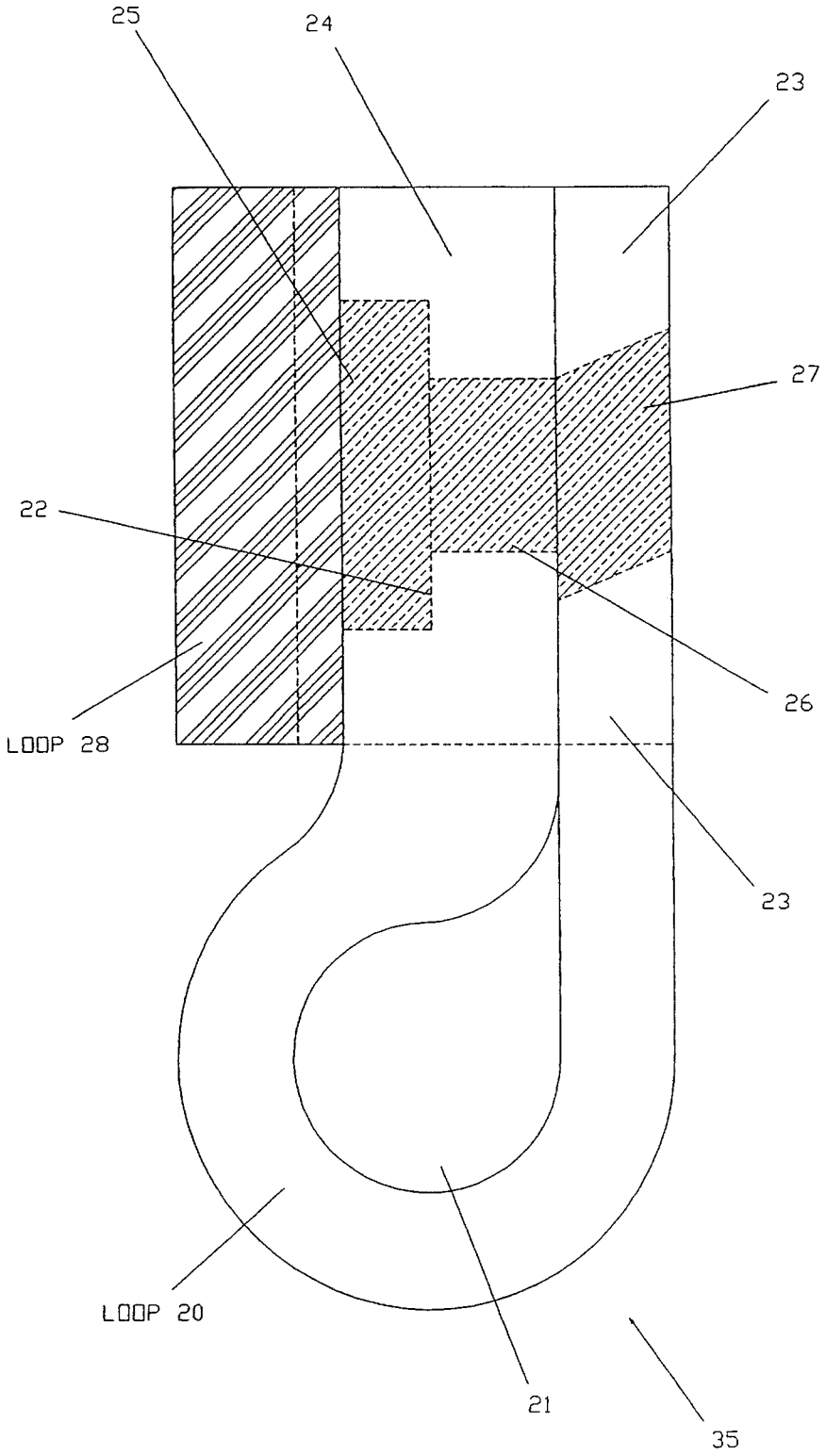
FIG. 74 is a sectional view of the present invention "L" side attachment strap with fully attached retention strap 35 taken at Section AA of FIG. 75.
Figure 75:
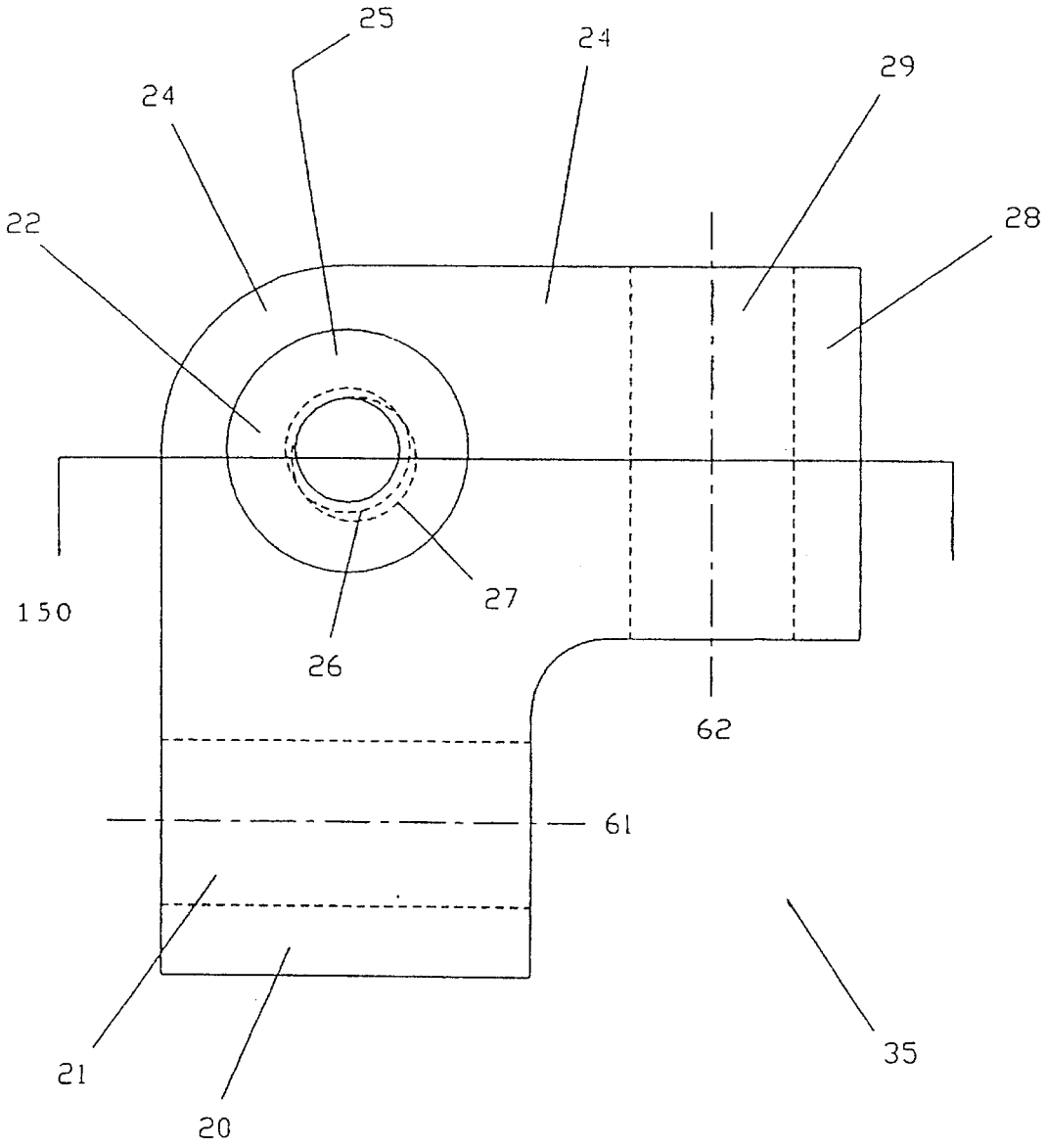
FIG. 75 is a plan view of the present invention "L" side attachment strap with fully attached retention strap 35.

Referring to FIG. 75, a plan view of the "L" side attachment strap with fully attached retention strap 35, it is evident that the preferred design is that it is symmetric. FIG. 74 shows that each loop section 20 and 28 is formed by the lower strap end portion 23 looping into the second strap end portion 24.

Figure 71:
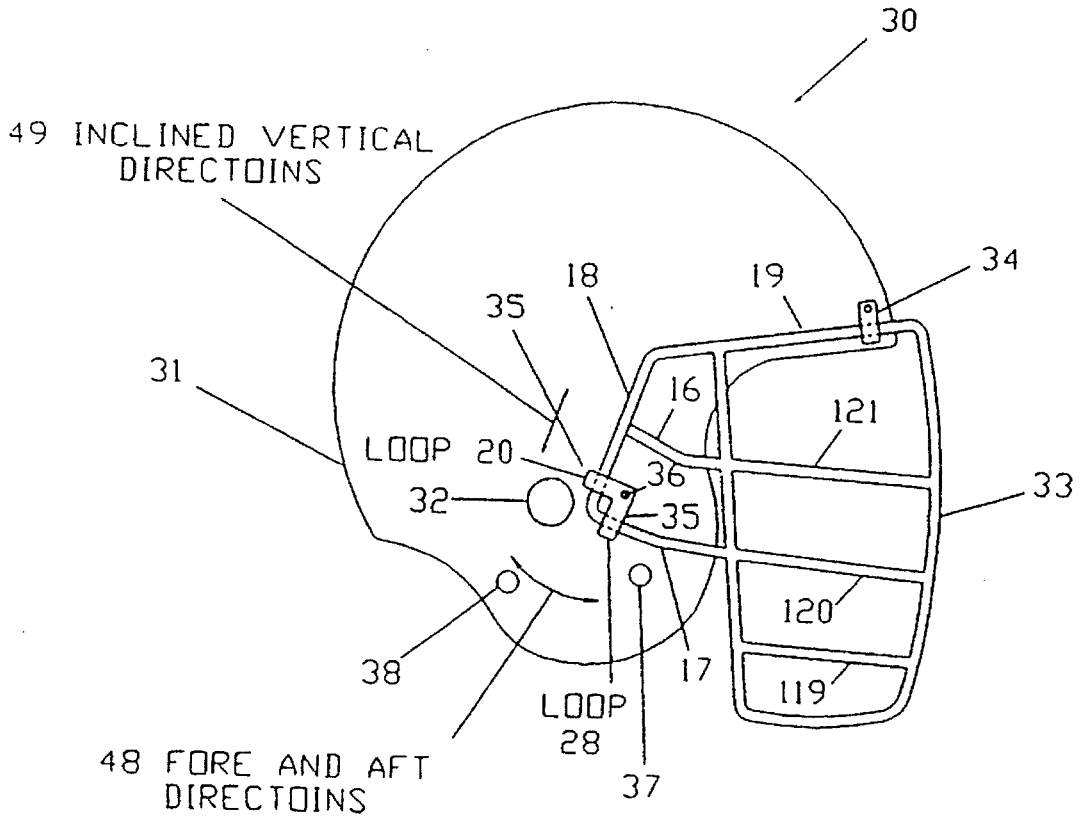
FIG. 71 is a perspective view showing the present invention "L" side attachment strap with fully attached retention strap 35 mounted to a helmet, totally securing a single wire faceguard to a helmet.
Figure 72:
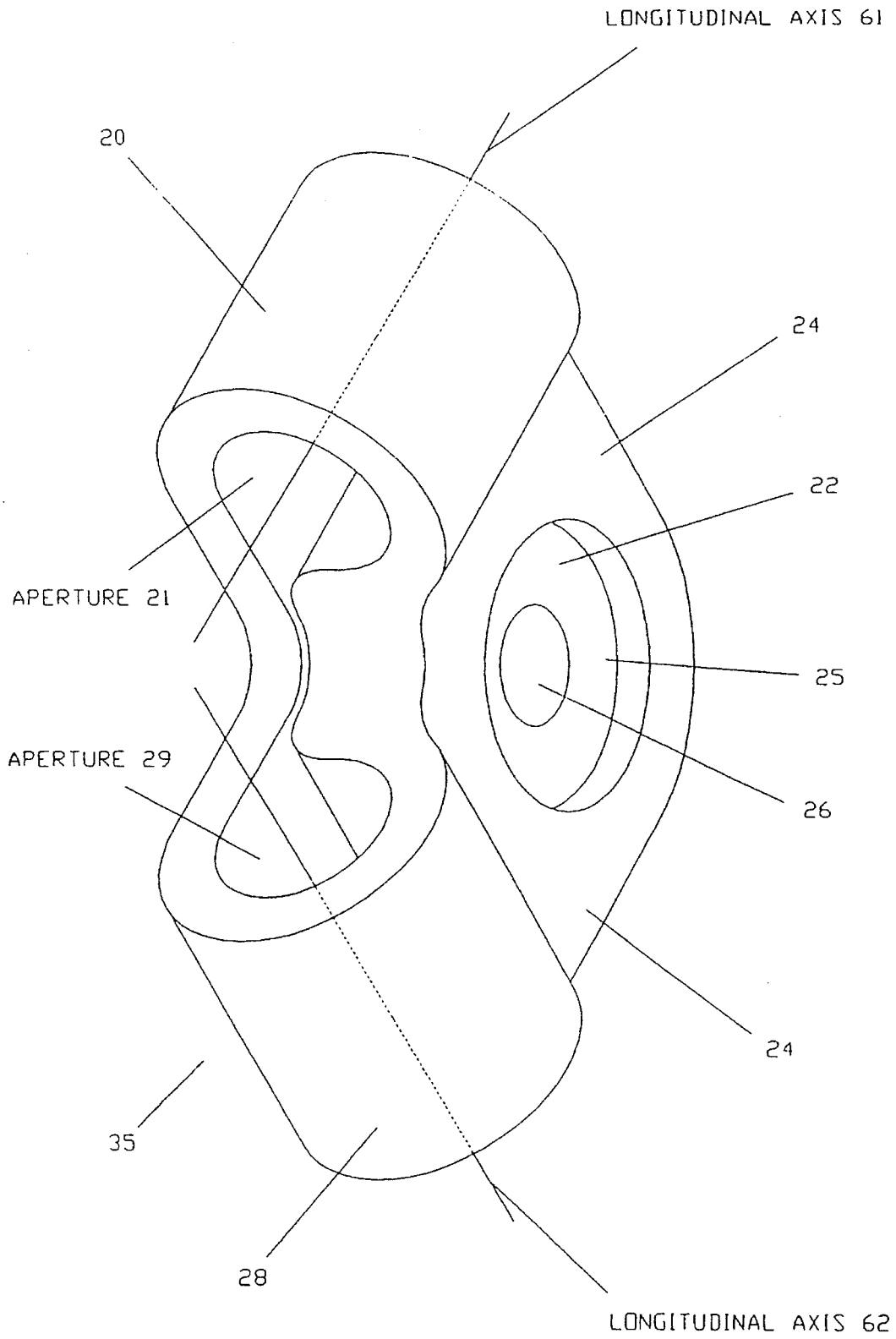
FIG. 72 is an isometric view of the present invention "L" side attachment strap with fully attached retention strap 35.
Figure 73:
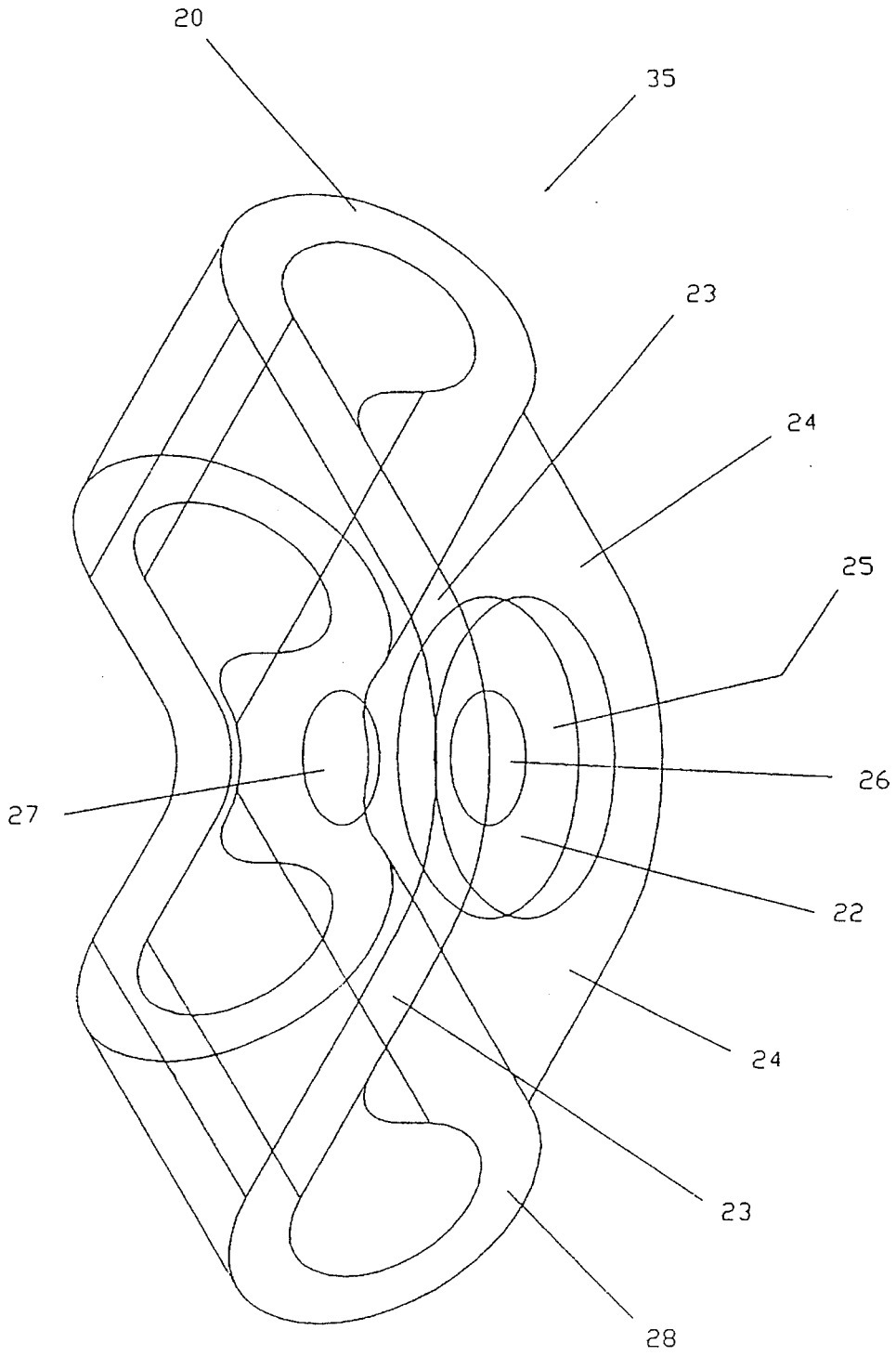
FIG. 73 is an isometric view of the present invention "L" side attachment strap with fully attached retention strap 35 showing its "hidden lines."

Refer to FIG. 71 and note the elegance of the "L" side attachment strap with fully attached retention strap 35. Loop section 20 of the "L" side attachment strap with fully attached retention strap 35 encircles bar 18 of the rear section 15 of guard 33 and prevents the guard 33 from moving to a significant degree in the arc pattern 48 that is set up as a result of the guard 33 being hinged at the top of the helmet by front attachments 34. The improvement of the "L" side attachment strap with fully attached retention strap 35 over the prior art side attachment straps 13, is that stemming off of the head section, at approximately a 90 degree angle, is loop section 28 that encircles bar 17 of the rear section 15 of the guard 33. By loop 28 encircling bar 17, bar 18 of the rear section 15 of the guard 33 is restricted from getting moved to a significant degree in the inclined vertical direction 49 through loop 20. The improvement of this invention consists in simultaneously positively restricting movement in the inclined vertical direction—ie. friction plays a negligible role in preventing movement in the inclined vertical direction. Thus, solving and eliminating the problems of the prior art side attachment straps 13. Referring to FIG. 71, note that each loop of the present invention "L" side attachment strap with fully attached retention strap 35 will be put in tension when the guard 33 encounters a downwardly angled frontal blow. By securing the sides of a faceguard 33 to a helmet 31 with the present invention "L" side attachment strap with fully attached retention strap 35, the user of a helmet system 30 would have a faceguard 33 that is totally secured to his helmet and not have to worry about bar 17 of the rear section 15 of the guard 33 moving down over the chin strap buckle or the guard 33 rattling or moving around during play.

For all types of guards 33 that the leading manufacturer produces, the rear section 15 will take one of two forms; bar 16 will bend and join added bar 122 in the main grid of the faceguard 33 as in the double wire guard in FIG. 6, or bar 16 will not bend and join the existing bar 121 in the main grid of the guard 33 as shown in the single wire guard in FIG. 5. Note that bar 16 of the rear section 15 of the guard 33 leaves bar 18 at a particular angle, B, for the single wire guard 33 and at a different angle, A, for the double wire guard 33. Notice, that bar 122 is not present in the single wire guard 33, only the double wire guard 33. However, the angle between bars 17 and 18 of the rear section 15 of the guard 33 remains constant at approximately 90 degrees for both the single wire and double wire guard.

The "L" side attachment strap with fully attached retention strap 35 can be symmetrical; that is, it has the same dimensions in the horizontal direction, loop 20, and the vertical direction, loop 28. The fact that the present invention "L" side attachment strap with fully attached retention strap 35 is symmetric permits one design of the present invention "L" side attachment strap with fully attached retentions strap 35 to fit on either side of at least all of the faceguards 33 produced by the leading manufacturers; a universal design that solves the problems of the prior art side attachment straps.

FIG. 74 is a cross-section of FIG. 75 taken at line AA. The inner radius of the loop apertures can range from approximately 1.00 to 0.05 inches and the outer radius of the loop apertures can vary between approximately 1.15 and 0.15 inches respectively and the total length L of the "L" side attachment strap with fully attached retention strap 35 can vary between approximately 0.50 and 3.0 inches. The suggested dimensions of the present invention "L" side attachment strap with fully attached retention strap 35 are as follows: total length in each direction, 1.25 inches; width of loops 20 and 28, 0.63 inches; inner radius of loop apertures 21 and 29, 0.15 inches; outer radius of apertures 21 and 29, 0.28 inches; depth of recess 25, 0.10 inches; width of recess 25, 0.42 inches; width of aperture 26, 0.18 inches; width of aperture 27, 0.23 inches; angle of aperture 27 is 65.6 degrees; height of loops 20 and 28, 0.56 inches; thickness of strap end 24 is 0.24 inches and thickness of strap end 23 is 0.13 inches. Obviously, these dimensions can be varied in order that the "L" side attachment strap with fully attached retention strap 35 can fit faceguards 33 without standard dimensions,guards that are comprised of flattened plastic bars or bars with a "thick" coating such as the Schutt ArmorGuard faceguard.

Referring again to FIG. 74, recess 25 houses the head of a screw 36 that extends through aperture 26 into a T-Nut in aperture 27, that originates inside the helmet. Aperture 27 may not be angled to take into account the curvature of the helmet, aperture 27 may also be of the same diameter as aperture 26.

Figure 76:
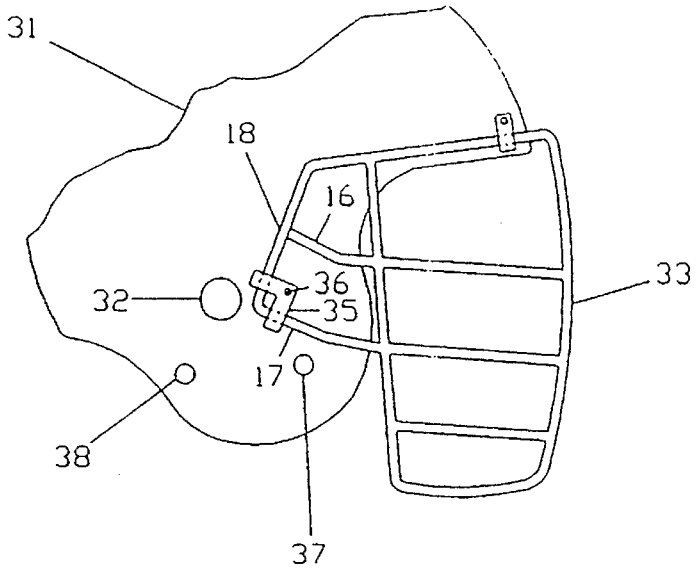
FIG. 76 is a fragmentary perspective view showing the present invention "L" side attachment strap with fully attached retention strap 35 securing a single wire guard to a helmet. Note: A double wire faceguard is secured to the helmet by the present invention "L" side attachment strap with fully attached retention strap 35 in the same manner as the single wire faceguard.

FIG. 76 is a fragmentary perspective view showing the improved "L" side attachment strap with fully attached retention strap 35 securing a single wire guard 33 to a helmet 31. The improved "L" side attachment strap with fully attached retention strap 35 would fit the same way on the double wire guard 33.

Figure 77:
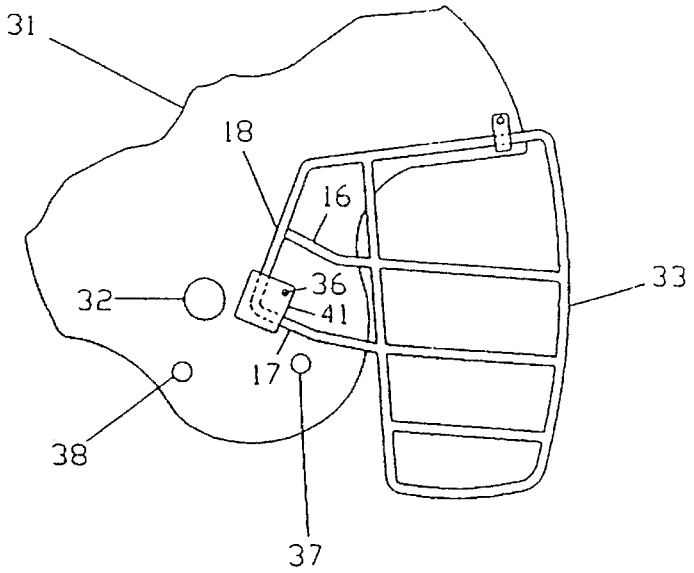
FIG. 77 depicts a variation of the present invention "L" side attachment strap with fully attached retention strap 35. This solid variation will achieve the same results, except that it will cost more to manufacture.

Referring now to FIG. 77, this is a variation 41 of present invention "L" side attachment strap with fully attached retention strap 35 where the area between loop section 20 and loop section 28 is filled with material. This solid variation 41 achieves the same result as the present invention "L" side attachment strap with fully attached retention strap 35 shown in FIG. 76 except that it would cost more to manufacture because it requires more material. This solid variation 41 would fit the same way on a double wire guard 33.

Figure 78:
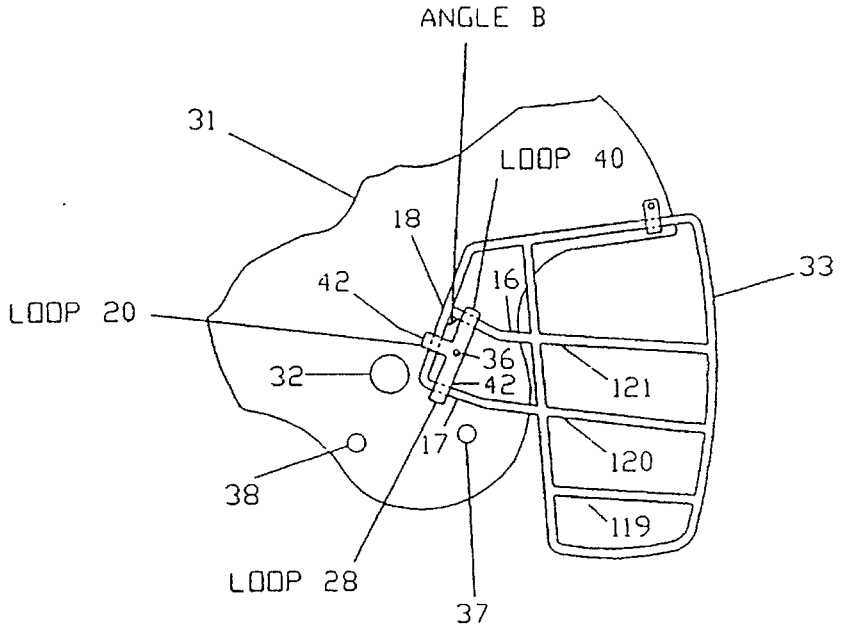
FIG. 78 is a side view of the "T" side attachment strap securing a single wire guard to a helmet.
Figure 79:
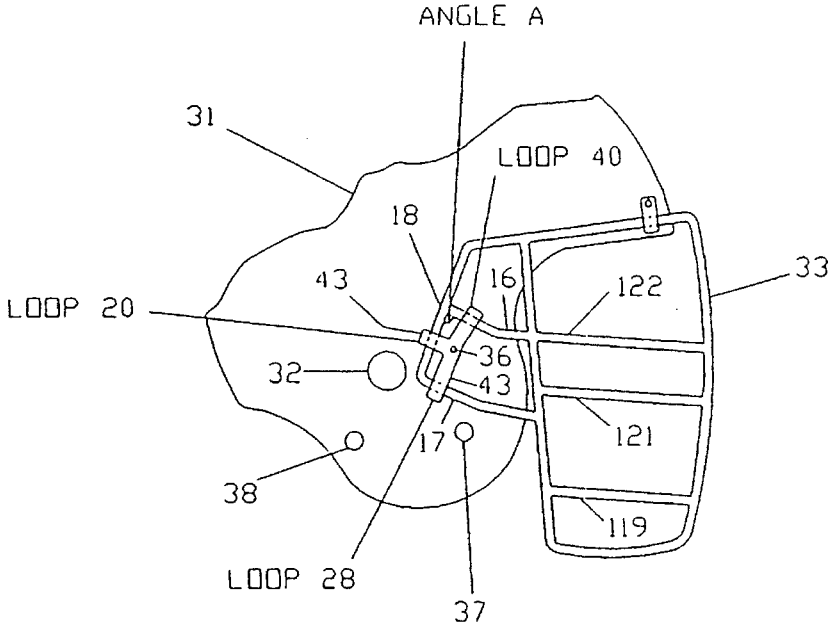
FIG. 79 is a side view of the "T" side attachment strap securing a double wire guard to a helmet.

FIGS. 78 and 79 disclose "T" variations 42 and 43 respectively of the "L" side attachment strap with partially attached retention strap 35, that would once again achieve the same results as the present invention "L" side attachment strap with fully attached retention strap 35, that is restricting bar 18 of the rear section 15 of the guard 33 from getting moved through the loop of the prior art side attachment straps, except that it is once again not as economical because different "T" variations, 42 and 43 in FIGS. 78 and 79 respectively, would have to be manufactured for the single and double wire guards 33 due to the different angles, B and A, of the single and double wire guards 33. FIG. 78 depicts the "T" variation 42 of the "L" side attachment strap with fully attached retention strap 35 securing a single wire guard to a helmet 31, while FIG. 79 depicts a "T" variation 43 of "L" side attachment strap with fully attached retention strap 35 securing a double wire guard to a helmet 31. In both cases, it is loop 40 that encircles bar 16 of the rear section 15 of guard 33.

Figure 80:
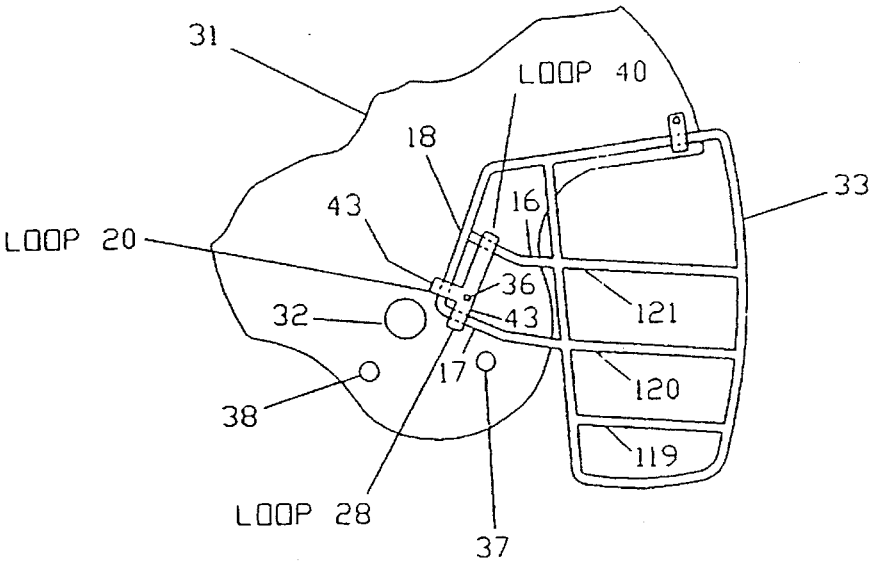
FIG. 80 is a variation of the present invention "L" side attachment strap with fully attached retention strap 35 that does not have loops that are equal in length.

FIG. 80 discloses a "T" variation 42 of the "L" side attachment strap with fully attached retention strap 35, where loop 20 of the "T" variation 42 that restricts movement in the arc pattern 48, is positioned as close to bar 16 of the rear section 15 of guard 33 as possible causing the "T" shape to be non-symmetric. FIG. 80 depicts the non-symmetric "T" variation 42 securing a single wire guard 33 to a helmet 31. This could also be designed to fit a double wire guard 33 to accommodate the different angles A and B. Once again, this version would be more expensive to manufacture.

Figure 81:
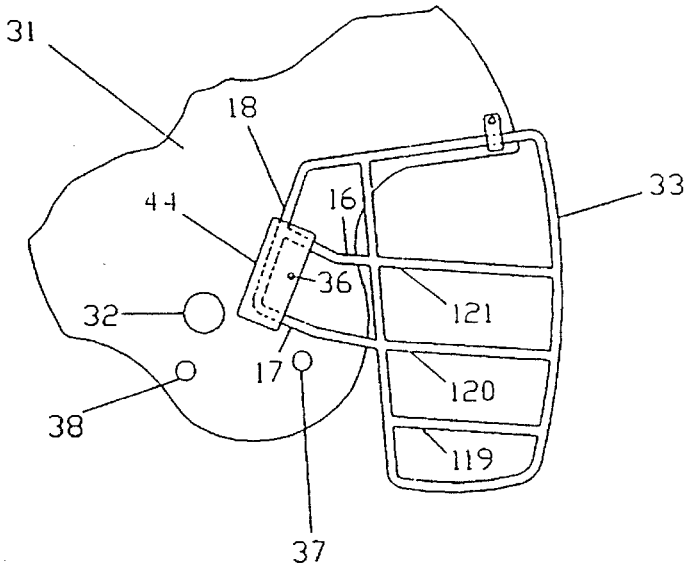
FIG. 81 is a solid variation of the "T" side attachment strap that encircles both horizontal bars of the rear portion of the guard.

FIG. 81 discloses a "T" variation of the "L" side attachment strap with fully attached retention strap 35 where the area between loops 20, 28 and 40 is filled with material. FIG. 81 discloses variation 44 securing a single wire faceguard 33 to a helmet 31. This could also be designed to fit a double wire faceguard 33 to accommodate the different angles A and B. This would achieve the desired results of stopping bar 18 of the rear section 15 of guard 33 from moving to a significant degree in the vertical direction 49, but would be un-economical to produce because it requires extra material to manufacture.

Figure 82:
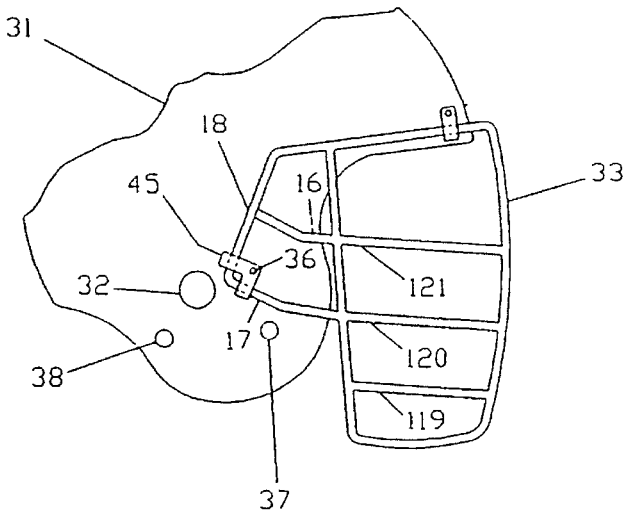
FIG. 82 is a variation of present invention "L" side attachment strap with fully attached retention strap 35 where the loops are not of equal length.

FIG. 82 discloses a variation 45 of the present invention "L" side attachment strap with fully attached retention strap 35 that is not symmetric. That is, loop 20 that encircles bar 18 of the rear section 15 of guard 33 is located as close to bar 17 as possible causing loop 20 to be a different length than loop 28. This would be a slightly more mechanically sound version of the preferred design of the present invention "L" side attachment strap with fully attached retention strap 35; however, a right and left hand version would have to be manufactured.

Figure 83:
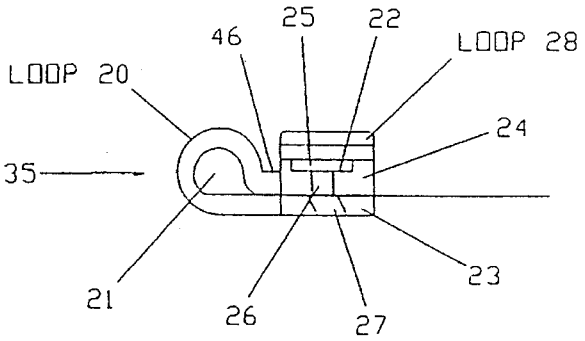
FIG. 83 is a sectional view of the present invention "L" side attachment strap with fully attached retention strap 35 that has neck portion 46.

FIG. 83 discloses a variation of the present invention "L" side attachment strap with fully attached retention strap 35 that has a neck portion 46 that would improve the shock absorbing properties of the strap. The neck portion 46 gives the present invention "L" side attachment strap with fully attached retention strap 35 improved stretching capabilities.

Figure 84:
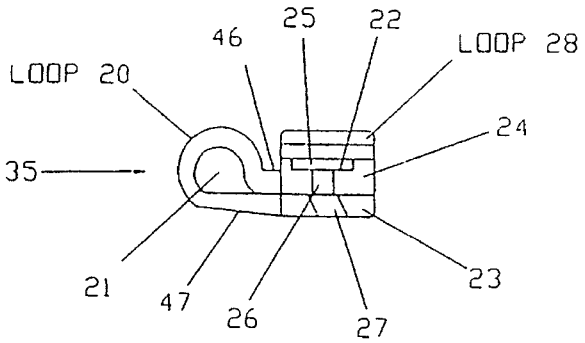
FIG. 84 is a sectional view of the present invention "L" side attachment strap with fully attached retention strap 35 that has both a neck portion 46 and a tapered portion 47.

FIG. 84 discloses a variation of the present invention "L" side attachment strap with fully attached retention strap 35 that has a tapered portion 47 along with neck portion 46 to provide added strap flexibility which allows for greater shock absorbing capabilities. Aperture 27 can not be at an angle compared to aperture 26. Aperture 27 can be the same diameter as aperture 26.

Figure 85:
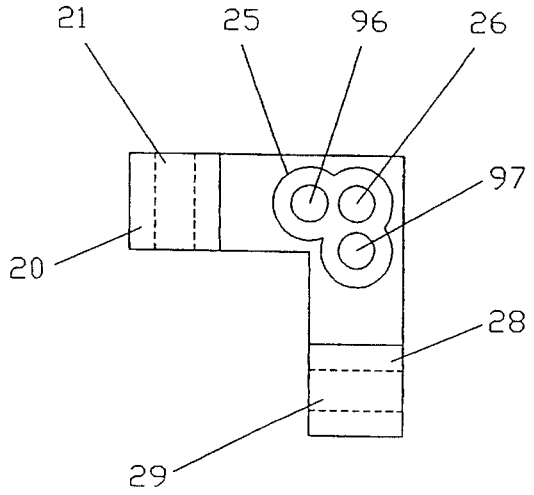
FIG. 85 is a variation of the present invention "L" side attachment strap with fully attached retention strap 35 that has three apertures in each strap end section.
Figure 102:
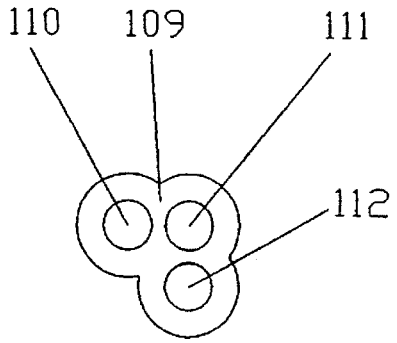
FIG. 102 is a retention washer that can be used in conjunction with the variation of "L" side attachment strap with fully attached retention strap 35 depicted in FIG. 86.

FIG. 85 discloses a variation of the present invention "L" side attachment strap with fully attached retention strap 35 that has three apertures 26, 96 and 97 in strap end portion 24, where each aperture referred to above has a corresponding aperture in strap end 23. Aperture 96 is located in the strap end portion 24 comprising loop portion 20 and aperture 97 is located in the strap end portion 24 comprising loop portion 28. This piece is symmetric, that is, it can be used on either side of the helmet 31. The addition of apertures 96 and 97, give this variation of the "L" side attachment strap with fully attached retention strap 35 variability in fit. FIG. 102, discloses a retention washer 109 that could be placed in recess 25. The apertures 110, 111 and 112 in the washer 109 align with apertures 96, 26 and 97 of this variation of the present invention "L" side attachment strap with fully attached retention strap 35. The washer 109 would add strength to this variation and also act as a clamp to keep this variation tightly secured to the helmet.

Figure 86:
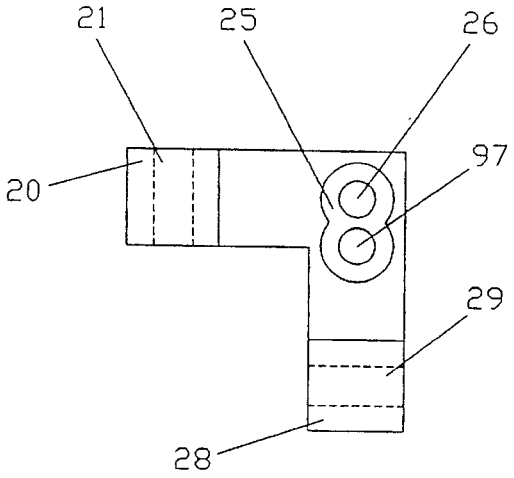
FIG. 86 and 87 disclose a variation of the present invention "L" side attachment strap with fully attached retention strap 35 that has two apertures in each strap end section.
Figure 87:
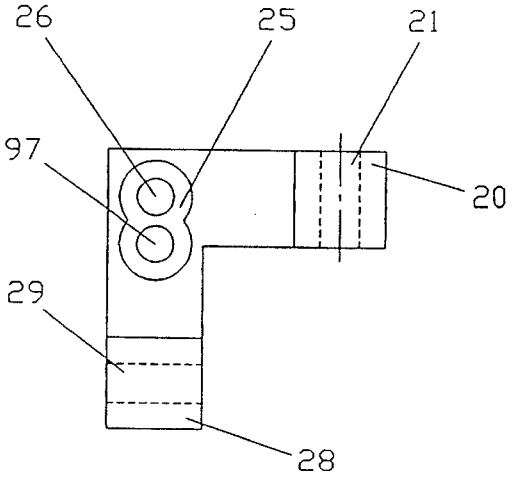

FIG. 86 and 87, disclose a variation of the present invention "L" side attachment strap with fully attached retention strap 35 that has two apertures 26 and 97 in strap end portion 24, where each aperture referred to above has a corresponding aperture in strap end 23. Aperture 97 is located below aperture 26 in the strap end portion 24 comprising loop portion 28. This variation is not symmetric, that is, the same piece could not be used on both sides of the helmet 31. A right hand version would be needed, FIG. 46, and a left hand version would also be needed, FIG. 87.

Figure 88A:
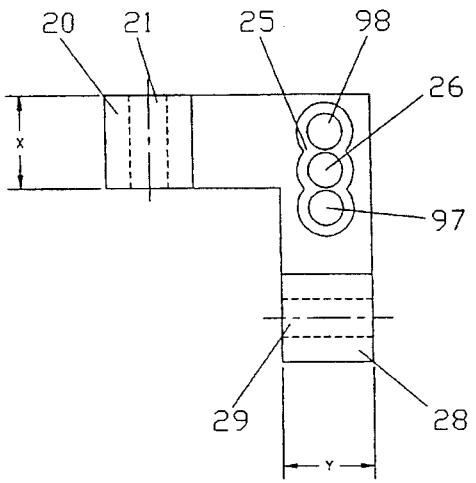
FIG. 88A and 88B disclose a variation of present invention "L" side attachment strap with fully attached retention strap 35 that has two apertures in each strap end section.
Figure 88B:
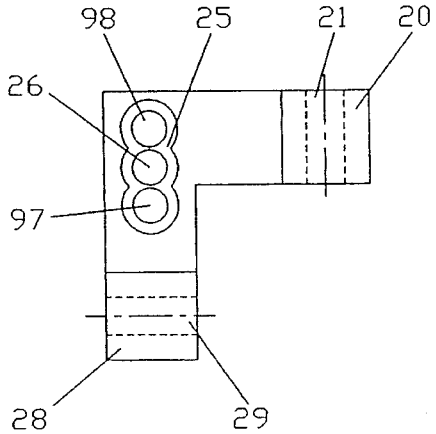

FIG. 88A and 88B, disclose a variation of the present invention "L" side attachment with fully attached retention strap 35 that has three apertures 26, 98 and 97 in strap end portion 24, where each aperture referred to above has a corresponding aperture in strap end 23. Note that the strap end portion 24 comprising loop portion 20 (x) can be wider that the strap end portion 24 comprising loop portion 28 (y). With this addition to the strap end portion 24 (x) comprising loop portion 20, aperture 98 is added above aperture 26 and aperture 97 is added below aperture 26. This variation is not symmetric, a right hand version FIG. 88A would be needed as well as a left hand version FIG. 88B.

Figure 89A:
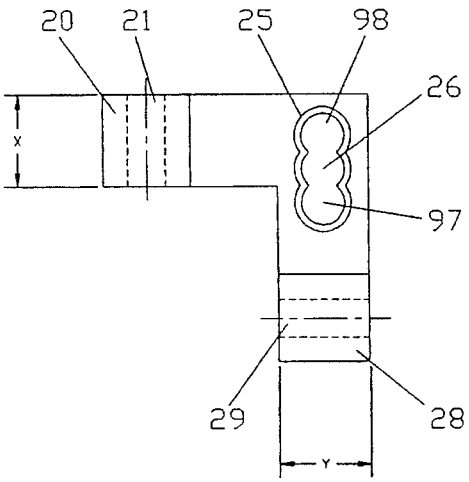
FIG. 89A and 89B disclose a variation of the present invention "L" side attachment strap with fully attached retention strap 35 that has a slot in each of the strap end sections.
Figure 89B:
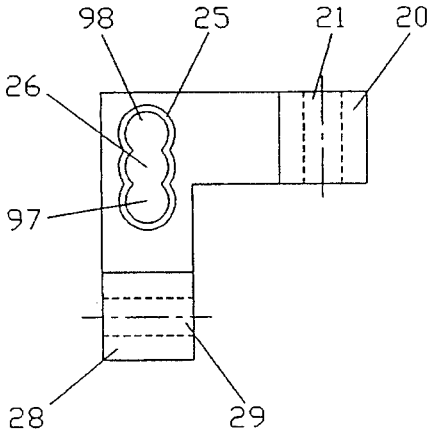

FIG. 89A and 89B disclose a variation of the present invention "L" side attachment strap with fully attached retention strap 35 that has three joined apertures 98, 26 and 97 in strap end portion 24. The strap end portion 24 comprising loop portion 20 (x) can be wider than the strap end portion 24 comprising loop portion 28 (y). With this addition to the strap end portion 24 (x) comprising loop portion 20, aperture 98 is added above aperture 26 and aperture 97 is added below aperture 26, where each aperture referred to above has a corresponding aperture in strap end 23. However, the top of aperture 26 is joined with the bottom of aperture 98 and the bottom of aperture 26 is joined with the top of aperture 97. This variation is not symmetric, a right hand version FIG. 89A is needed as well as a left hand version FIG. 89B.

Any of the apertures, in any of the embodiments or any of the variations presented, can be tapped such that the threads of the screw 36 can mesh with the tapped apertures. The apertures may also be undersized such that the screw 36 must self-tap. Another possibility is not to have any apertures extending throughout the entire piece, but rather have coned indentations where the apertures should be, so that the entire screw 36 must be self-tapped. This would provide a wider range of where to position the screw 36.

Figure 90:
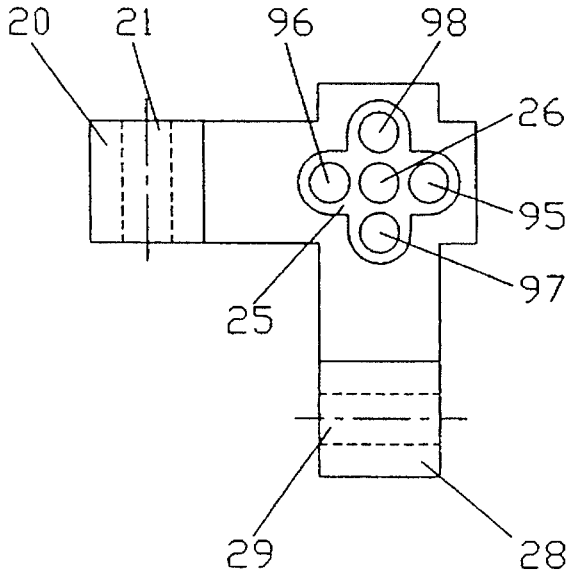
FIG. 90 discloses a variation of the present invention "L" side attachment strap with fully attached retention strap 35 that has five apertures in each strap end section.

FIG. 90 discloses a variation of the present invention "L" side attachment strap with fully attached retention strap 35 that has an extension added to the strap end portion 24 comprising loop portion 20 and an extension added to the strap end portion 24 comprising loop portion 28 to accommodate apertures 98 and 95. The strap end portion 24 comprising loop portion 20 has aperture 96 before aperture 26 and aperture 95 after it. The strap end portion 24 comprising loop portion 28 has aperture 97 below aperture 26 and aperture 98 above aperture 26. The apertures referred to above have corresponding apertures in strap end portion 23.

Figure 91:
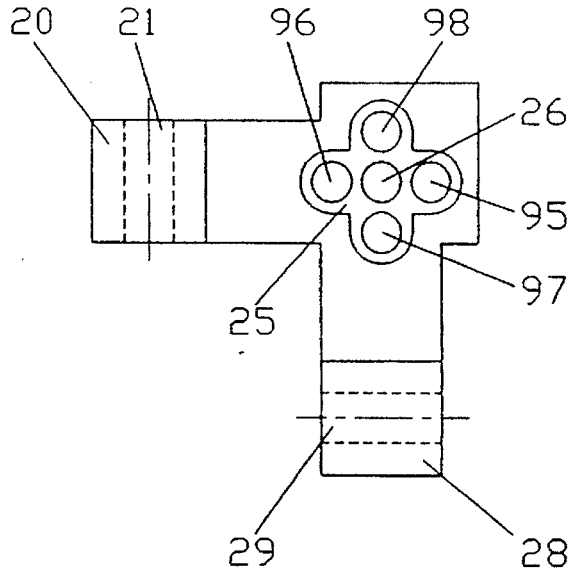
FIG. 91 discloses a variation of the present invention "L" side attachment strap with fully attached retention strap 35 that has five apertures in both of the strap end sections.

FIG. 91 discloses a variation of the present invention "L" side attachment strap with fully attached retention strap 35 that has an extension added to the strap end portion 24 comprising loop portion 20 and an extension added to the strap end portion 24 comprising loop portion 28. However, the area between the two extensions is filled with material. In the strap end portion 24 comprising loop 20, aperture 96 is before aperture 26, aperture 95 is after aperture 26. In the strap end portion 24 comprising loop portion 28, aperture 98 is above aperture 26 and aperture 97 is below aperture 26, where each aperture referred to above has a corresponding aperture in strap end 23. This variation is symmetric and can be used on either side of the helmet 31.

Figure 92A:
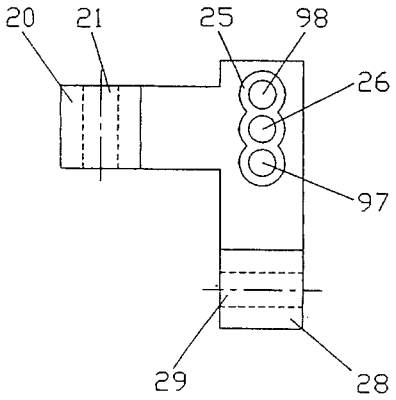
FIG. 92A and 92B disclose a variation of the present invention "L" side attachment strap with fully attached retention strap 35 that has three apertures in both strap end sections.
Figure 92B:
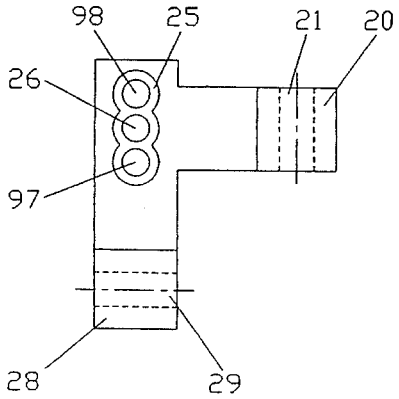

FIG. 92A and FIG. 92B disclose a variation of the present invention "L" side attachment strap with fully attached retention strap 35 where only the strap end portion 24 comprising loop 28 is extended. In strap end portion 24, aperture 98 is located above aperture 26 and aperture 97 is located below aperture 26, where each aperture referred to above has a corresponding aperture in strap end 23. This variation is not symmetrical. FIG. 92A discloses a right hand version while FIG. 92B discloses a left hand version.

Figure 93A:
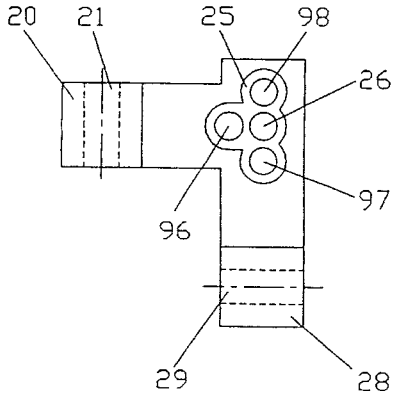
FIG. 93A and 93B discloses a variation of the present invention "L" side attachment strap with fully attached retention strap 35 that has four apertures in each strap end section.
Figure 93B:
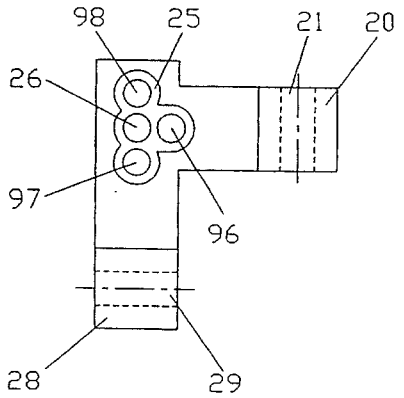

FIG. 93A and FIG. 93B disclose a variation of the present invention "L" side attachment strap with fully attached retention strap 35 where only the strap end portion 24 comprising loop portion 28 is extended. In the strap end portion comprising loop portion 20, aperture 96 is located before aperture 26. In the strap end portion comprising loop 28, aperture 98 is located above aperture 26 and aperture 97 is located below aperture 26, where each aperture referred to above has a corresponding aperture in strap end 23. This variation is not symmetric. FIG. 93A discloses the right hand version while FIG. 93B discloses the left hand version.

Figure 94A:
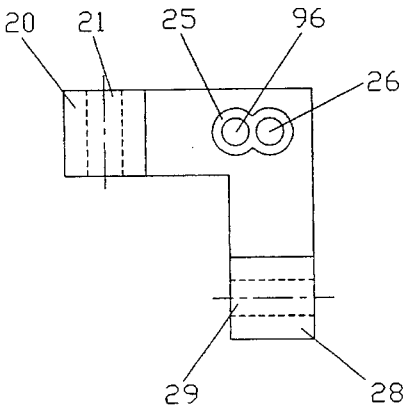
FIG. 94A and 94B disclose a variation of the present invention "L" side attachment strap with fully attached retention strap 35 that has two apertures in each strap end section.
Figure 94B:
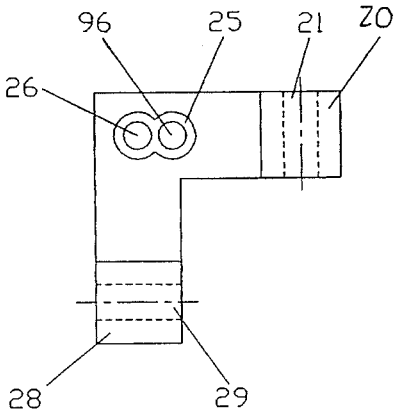

FIG. 94A and FIG. 94B disclose a variation of the present invention "L" side attachment strap with fully attached retention strap 35 where aperture 96 is located before aperture 26 in the strap end portion 24 comprising loop portion 20, where each aperture referred to above has a corresponding aperture in strap end 23. This variation is not symmetric. FIG. 94A discloses the right hand version while FIG. 94B discloses the left hand version.

Figure 95:
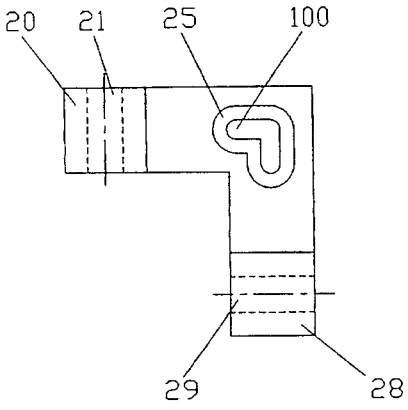
FIG. 95 discloses a variation of the present invention "L" side attachment strap with fully attached retention strap 35 that has an "L" shaped slot in each strap end section.
Figure 96:
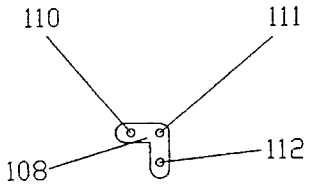
FIG. 96 discloses a washer that can be used in conjunction with the variation presented in FIG. 95.

FIG. 95 discloses a variation of the present invention "L" side attachment strap with fully attached retention strap 35 that has an "L" shaped slot 100. This slot 100 is formed by removing the area between the three apertures, 96, 26 and 97, located in strap end 24 as shown in FIG. 86, the area between the corresponding apertures in strap end 23 would also have to be removed. This slot 100 will allow one screw 36 and one T-Nut assembly to be placed anywhere in the slot 100 then clamped down, resulting in greater variability in fit. However, a washer 108 with apertures 110, 111 and 112 as depicted in FIG. 96 could be utilized to keep the screw 36 from moving, if a movement problem arose. The washer 108 in FIG. 96, can be placed inside recess 25 so that the apertures 110, 111 and 112 in washer 108 overlap slot 100. When one of the apertures in the washer 108, slot 100 and the aperture in the helmet 31 are aligned, the screw 36 can then be placed in the T-Nut, that originates inside the helmet, and this variation of the present invention "L" side attachment strap with fully attached retention strap 35 would be secured to the helmet 31. The washer 108 could also be used to provide a clamping force to help keep this variation of the present invention "L" side attachment strap with fully attached retention strap 35 tightly secured to the helmet. This variation is symmetric.

Figure 97A:
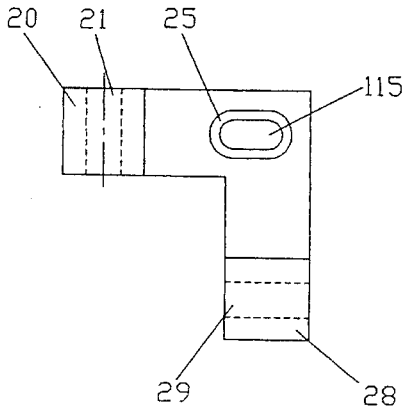
FIG. 97A and 97B disclose a variation of the present invention "L" side attachment strap with a fully attached retention strap 35 that has a slot in each strap end section.
Figure 97B:
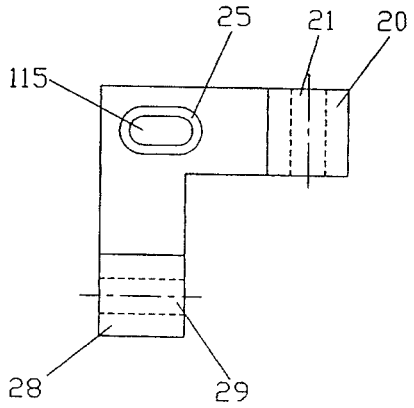
Figure 98:
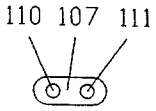
FIG. 98 discloses a washer that can be used in conjunction with the variation presented in FIG. 97A and 97B.

FIG. 97A and FIG. 97B disclose a variation of the present invention "L" side attachment strap with fully attached retention strap 35 comprising slot 115. Slot 115 is formed when the area between apertures 96 and 26 in strap end 24 is removed as shown in FIG. 94A and 94B. The area between the corresponding apertures in strap end 23 would also have to be removed. This slot 115 will allow for one screw 36 and one T-Nut to be placed anywhere in the slot 115 and then clamped down to secure the piece to the helmet 31. This results in greater variability in fit. However, a washer 107 with apertures 110 and 111 as disclosed in FIG. 98 could be utilized to keep the screw 36 from moving. The washer 107 can be placed in recess 25 so that the apertures 110 and 111 in washer 107 overlap slot 115 of this variation of the present invention "L" side attachment strap with fully attached retention strap 35. This variation is not symmetric. FIG. 97A discloses the right hand version while FIG. 97B discloses the left hand version.

Figure 99A:
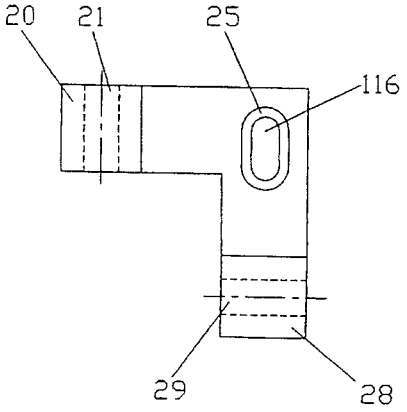
FIG. 99A and 99B disclose a variation of the present invention "L" side attachment strap with fully attached retention strap 35 that has a slot in each strap end section.
Figure 99B:
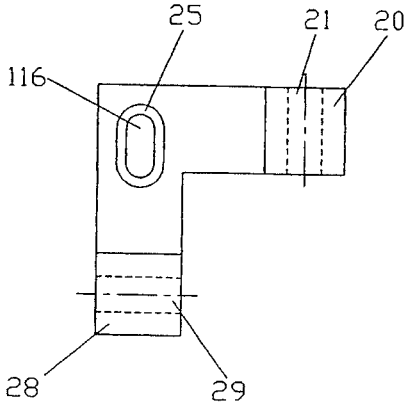
Figure 100:
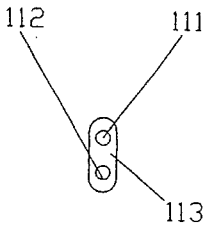
FIG. 100 discloses a washer that can be used in conjunction with the variation presented in FIG. 99A and 99B.

FIG. 99A and FIG. 99B disclose a variation of the present invention "L" side attachment strap 35 comprising slot 116. Slot 116 is formed when the area between apertures 26 and 97 in strap end 24 is removed as shown in FIG. 87A and 87B. The area between corresponding apertures in strap end 23 would also have to be removed. This slot 116 will allow for one screw 36 and one T-Nut to be placed anywhere in the slot 116 and then clamped down to secure this variation and the guard 33 to the helmet. This results in greater variability in fit. However, a washer 113 as disclosed in FIG. 100, could be utilized to keep the screw 36 from moving. The washer 113 can be placed in recess 25 so that the apertures 111 and 112 in washer 113 overlap slot 116 of this variation of the present invention "L" side attachment strap with fully attached retention strap 35. This variation is not symmetric. FIG. 99A discloses the right hand version while FIG. 99B discloses the left hand version.

While this invention has been described as having a preferred design, it will be understood that it is capable of further modification. This application is, therefore, intended to cover any variations, uses, or adaptations of the invention following the general principles thereof and including such departures from the present disclosure as come with known customary practice in the art to which this invention pertains and fall within the limits of the appended claims.

I claim:

1. In a helmet that has a faceguard constructed of a series of bars, including bars in the rear section that extend in an inclined vertical direction, and a first front attachment means for attaching the guard to the front of the helmet such that the guard is hinged at the top of the helmet and can swing in the fore and aft directions, the improvement comprising:

at least two separate straps attached to the helmet at at least a common attachment point, forming a unitary positively restricting side attachment means connected to the helmet, said side attachment means having at least two portions which engage the face guard along two separate areas thereof, to positively restrict face guard movement to a significant degree in the fore and aft directions and in the inclined vertical direction, wherein respective axes of at least some of said at least two portions are non-parallel.

2. The helmet according to claim 1 wherein the at least two separate straps comprise a main attachment strap and a retention strap each with a loop, each loop having a aperture with a longitudinal axis, where the axes of the loops are non-parallel.

3. The helmet of claim 2 wherein the direction of the axes of the loops are essentially in the inclined vertical direction and the fore and aft directions.

4. In a helmet according to claim 2, wherein a centerline bisects each of the main attachment strap and the retention strap in its longest dimension, and a first and second strap end section are provided on each of the main attachment strap and the retention strap, each having at least one aperture.

5. In a helmet according to claim 4, wherein the main attachment strap's end sections further have a notch formed therein.

6. The helmet according to claim 5, wherein the main attachment strap's end sections have indentations formed therein and the retention strap's end sections form protrusions.

7. In a helmet according to claim 6, wherein the protrusions of the retention strap fit snugly into the indentations of the main attachment strap.

8. In a helmet according to claim 7, wherein at least one aperture of the retention strap's end sections is aligned with at least one aperture of the main attachment strap's end sections.

* * * * *